US011179946B2

(12) United States Patent
Eto

(10) Patent No.: US 11,179,946 B2
(45) Date of Patent: Nov. 23, 2021

(54) LIQUID SUPPLY UNIT AND LIQUID INJECTION DEVICE

(71) Applicant: KYOCERA Document Solutions Inc., Osaka (JP)

(72) Inventor: Daisuke Eto, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/363,131

(22) Filed: Mar. 25, 2019

(65) Prior Publication Data

US 2019/0291456 A1 Sep. 26, 2019

(30) Foreign Application Priority Data

Mar. 26, 2018 (JP) ..... JP2018-057664
Sep. 19, 2018 (JP) ..... JP2018-174991
Jan. 8, 2019 (JP) ..... JP2019-001066

(51) Int. Cl.
*B41J 2/17* (2006.01)
*B41J 2/175* (2006.01)
*B41J 2/14* (2006.01)

(52) U.S. Cl.
CPC ..... *B41J 2/17596* (2013.01); *B41J 2/14* (2013.01); *B41J 2/17509* (2013.01); *B41J 2/17556* (2013.01)

(58) Field of Classification Search
None
See application file for complete search history.

(56) References Cited

U.S. PATENT DOCUMENTS

2005/0073559 A1 4/2005 Aruga et al.
2010/0085396 A1* 4/2010 Yokota ..... B41J 2/175 347/7
2010/0238227 A1* 9/2010 Nystrom ..... B41J 2/17593 347/19
2011/0025786 A1* 2/2011 Price ..... B41J 2/17513 347/85

(Continued)

FOREIGN PATENT DOCUMENTS

CN 102529389 7/2012
WO 03/041964 5/2003

OTHER PUBLICATIONS

Chinese Office Action dated May 8, 2020.

*Primary Examiner* — Erica S Lin
(74) *Attorney, Agent, or Firm* — Gerald E. Hespos; Michael J. Porco; Matthew T. Hespos

(57) ABSTRACT

A liquid supply unit supplies predetermined liquid from a liquid storage container storing the liquid to a liquid injection head for injecting the liquid. The liquid supply unit includes a pressure chamber, a first supply passage, a second supply passage, a bypass supply passage and a pressurizing mechanism. The pressure chamber is capable of storing the liquid. The first supply passage allows communication between the liquid storage container and the pressure chamber. The second supply passage allows communication between the liquid injection head and the pressure chamber. The bypass supply passage has an upstream end in a liquid supply direction connected to the first supply passage and a downstream end joining the second supply passage. The pressurizing mechanism is arranged in the bypass supply passage and pressurizes the liquid flowing in the bypass supply passage.

17 Claims, 43 Drawing Sheets

(56) References Cited

U.S. PATENT DOCUMENTS

| | | | | |
|---|---|---|---|---|
| 2012/0075390 | A1 | 3/2012 | Park et al. | |
| 2015/0151549 | A1* | 6/2015 | Kikkawa | B41J 2/175 347/85 |

* cited by examiner

PRESSURIZED PURGE MODE

DECOMPRESSION MODE 441
419
43S
41
661
66
6
61
67
9
43
43A
43C
43B
62
62A
63
42
45
UP
DOWN
LEFT
RIGHT

<PRINT MODE>

<PRESSURIZED PURGE MODE>

<CIRCULATION MODE>

ENLARGEMENT OF PART A4

ENLARGEMENT OF PART A5

LIQUID SUPPLY UNIT AND LIQUID INJECTION DEVICE

INCORPORATION BY REFERENCE

This application is based on Japanese Patent Application No. 2018-57664 filed with the Japan Patent Office on Mar. 26, 2018, Japanese Patent Application No. 2018-174991 filed with the Japan Patent Office on Sep. 19, 2018 and Japanese Patent Application No. 2019-1066 filed with the Japan Patent Office on Jan. 8, 2019, the contents of which are hereby incorporated by reference.

BACKGROUND

The present disclosure relates to a liquid supply unit for supplying liquid stored in a liquid storage container to a liquid injection head and a liquid injection device to which the liquid supply unit is applied.

For example, in an ink jet printer, a liquid injection head for injecting a tiny amount of ink (liquid) to a print object is used. Ink is supplied to this liquid injection head from an ink cartridge (liquid storage container) storing the ink through a predetermined supply passage. Conventionally, a liquid injection device is known in which a liquid supply unit (valve unit) including a pressure chamber for setting a discharge hole of a liquid injection head to a negative pressure is arranged in a supply passage in the case of supplying ink from an ink cartridge to the liquid injection head by a water head difference. By disposing the liquid supply unit for generating the negative pressure, unlimited dripping of the ink from the discharge hole is suppressed even if the ink is supplied by the water head difference.

A conventional liquid supply unit adopts such a structure that a part of a pressure chamber set to a negative pressure is defined by a flexible film and a pressing plate (pressure receiving plate) attached to this flexible film directly presses a movable valve. The movable valve is biased in a direction opposite to a direction of the pressing by a biasing member. If a negative pressure degree of the pressure chamber increases due to the suction of ink by the liquid injection head, the movable valve is pressed against the pressing plate to move according to a displacement of the flexible film, an ink supply passage into the pressure chamber is opened and the ink flows into the pressure chamber. If the negative pressure degree of the pressure chamber decreases due to this inflow of the ink, the movable valve is moved in a reverse direction by a biasing force of the biasing member and the pressure chamber returns to a sealed state.

SUMMARY

A liquid supply unit according to one aspect of the present disclosure supplies predetermined liquid from a liquid storage container storing the liquid to a liquid injection head for injecting the liquid. The liquid supply unit includes a pressure chamber, a first supply passage, a second supply passage, a bypass supply passage and a pressurizing mechanism. The pressure chamber is capable of storing the liquid. The first supply passage allows communication between the liquid storage container and the pressure chamber. The second supply passage allows communication between the liquid injection head and the pressure chamber. The bypass supply passage has an upstream end in a liquid supply direction connected to the first supply passage and a downstream end joining the second supply passage. The pressurizing mechanism is arranged in the bypass supply passage and pressurizes the liquid flowing in the bypass supply passage.

A liquid injection device according to another aspect of the present disclosure includes a liquid injection head configured to inject predetermined liquid, and the above liquid supply unit configured to supply the liquid from a liquid storage container storing the liquid to the liquid injection head.

BRIEF DESCRIPTION OF THE DRAWINGS

FIGS. 6A and 6B are diagrams schematically showing a cross-section of the head unit along a front-rear direction, wherein FIG. 6A shows a state where a print mode is being performed and FIG. 6B shows a state where a circulation mode is being performed, FIGS. 10A and 10B are perspective views of the liquid supply unit, wherein FIG. 10A is the perspective view viewed from a first chamber side and FIG. 10B is the perspective view viewed from a second chamber side, FIGS. 28A and 28B are enlarged views of a part A3 of FIG. 25, wherein FIG. 28A is a sectional view showing a state of the backflow prevention mechanism in the print mode and FIG. 28B is a sectional view showing a state of the backflow prevention mechanism in the pressurized purge mode.

DETAILED DESCRIPTION

[Overall Configuration of Printer]

Figure 1:
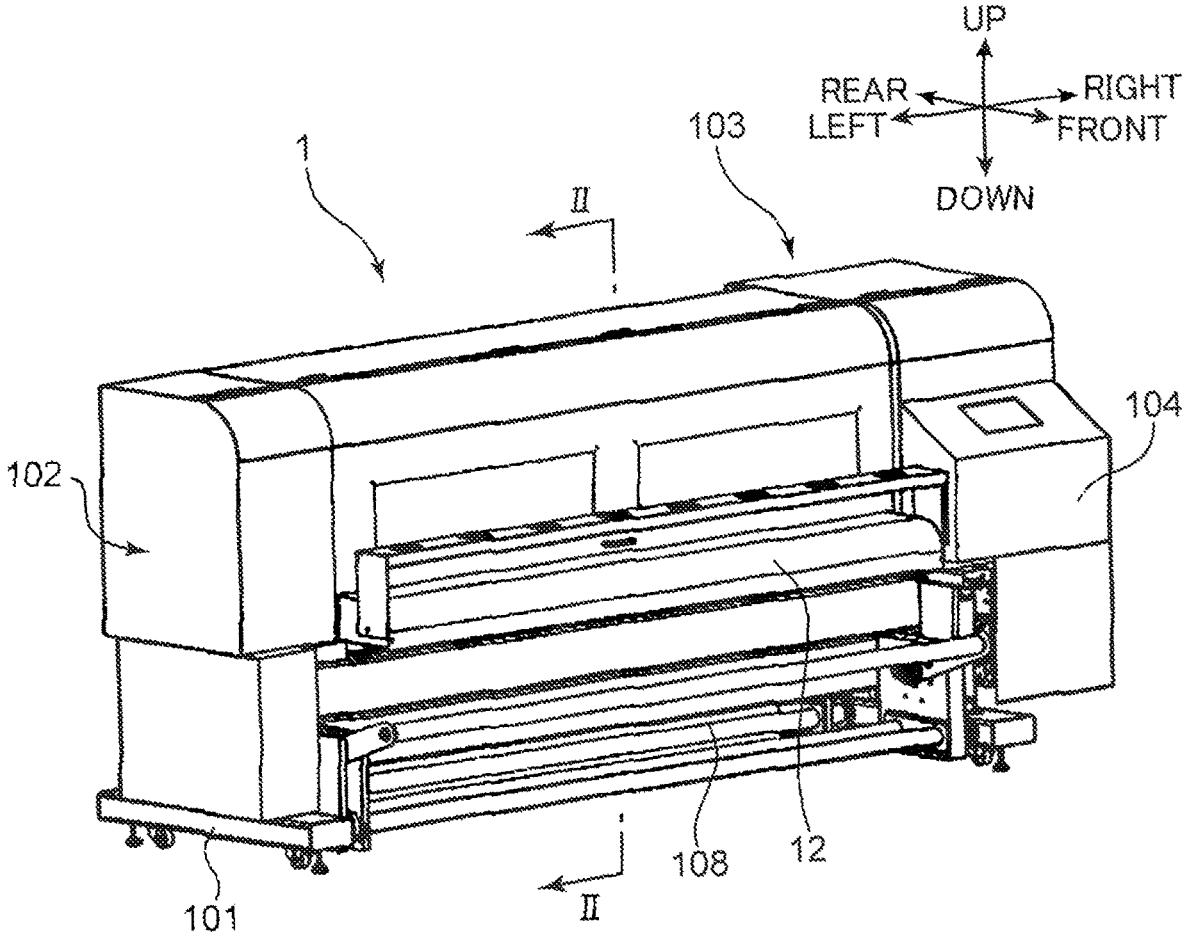
FIG. 1 is a perspective view showing the external appearance of an ink jet printer to which the present disclosure is applied.
Figure 2:
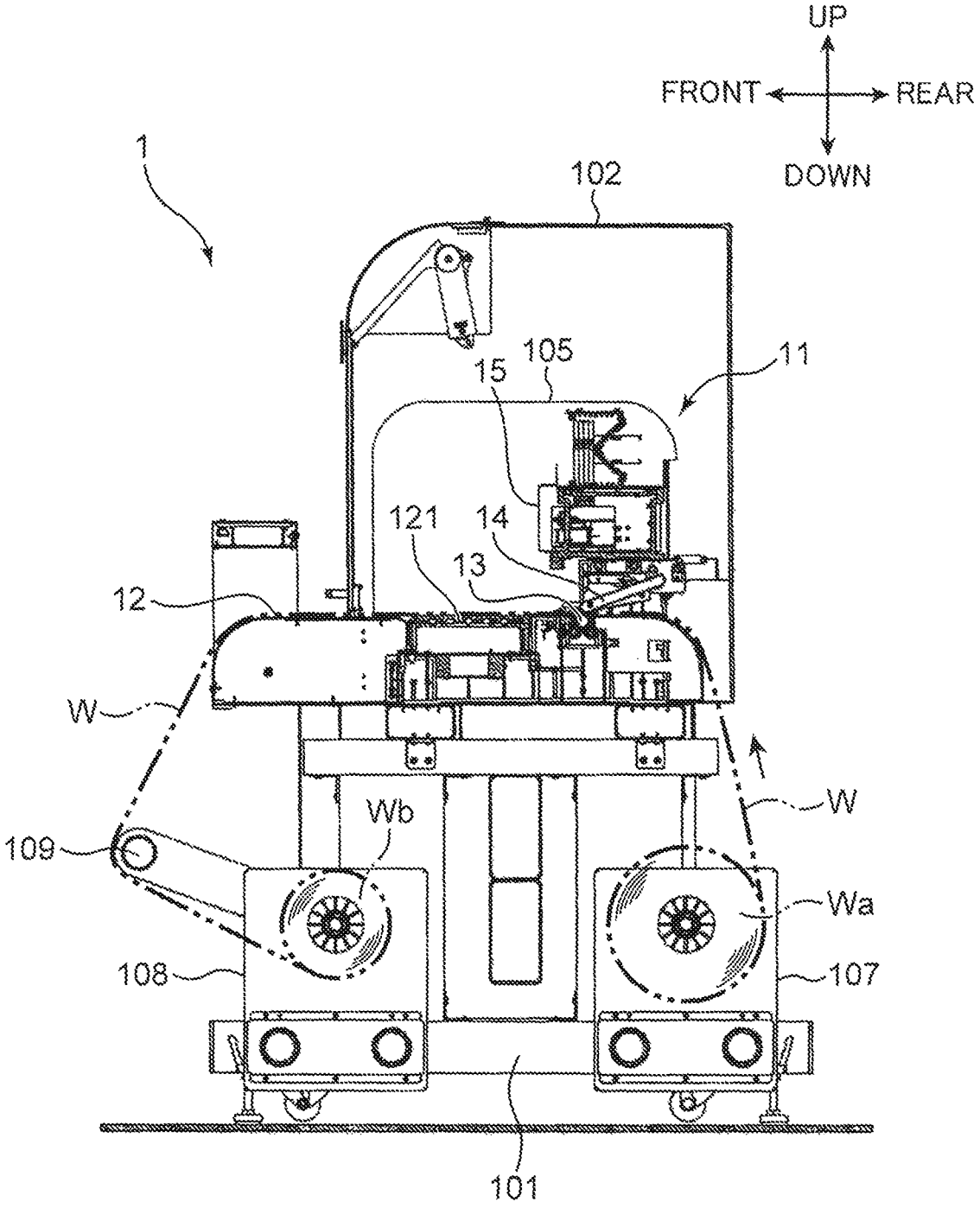
FIG. 2 is a sectional view along line II-II of FIG. 1.
Figure 3:
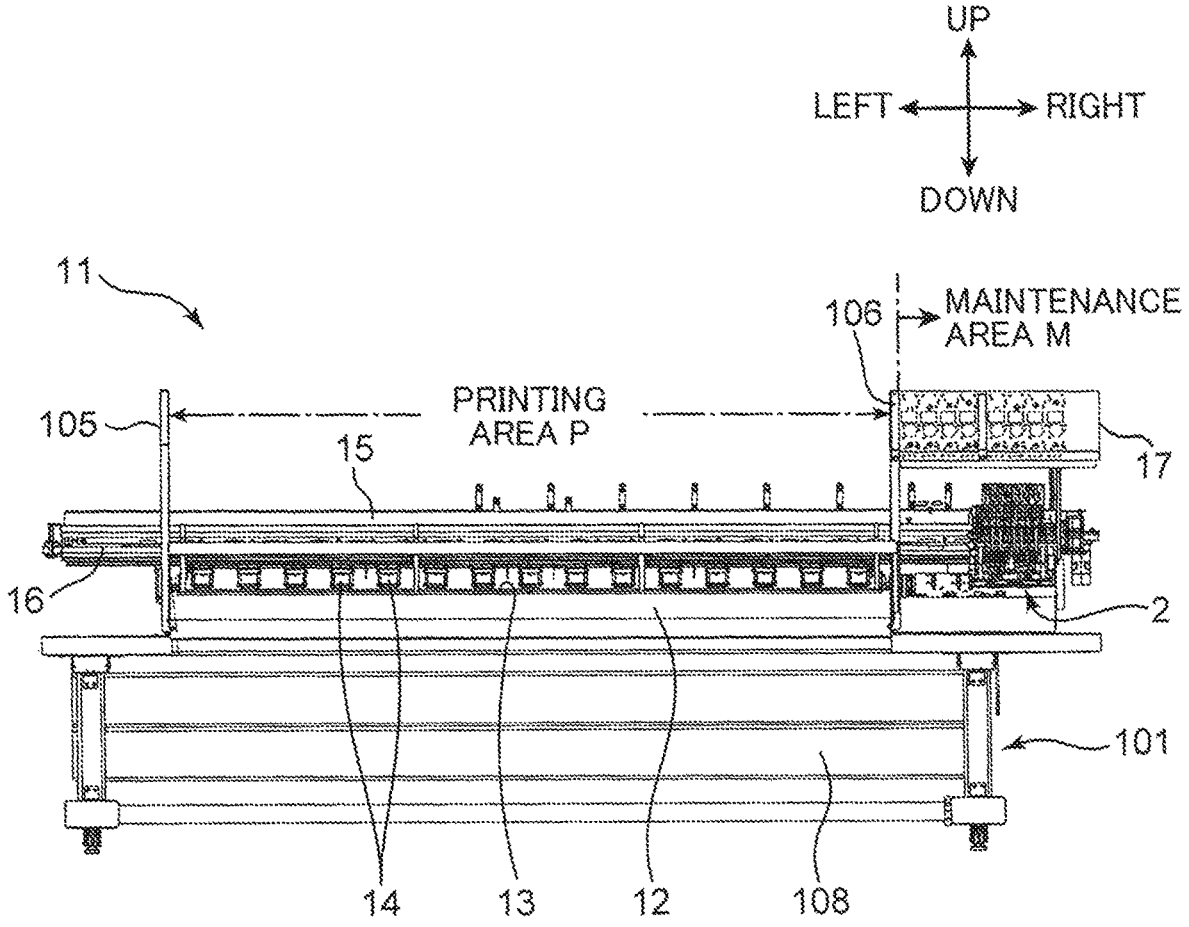
FIG. 3 is a front view of the ink jet printer with an outer cover removed.

Hereinafter, one embodiment of the present disclosure is described with reference to the drawings. First, an ink jet printer to which a liquid supply unit or a liquid injection device according to the present disclosure is applied is described. FIG. 1 is a perspective view showing the external appearance of an ink jet printer 1 according to the embodiment, FIG. 2 is a sectional view along line II-II of FIG. 1, and FIG. 3 is a front view of the printer 1 with an outer cover 102 removed. Note that front-rear, lateral and vertical directions are indicated in FIGS. 1 to 3 and figures described later, but this is only for the convenience of description and not intended to limit directions at all.

The printer 1 (liquid injection device) is a printer for performing a printing process of printing characters and images on various works W such as paper sheets, resin sheets or cloth fabrics, and particularly a printer suitable for a printing process on large-size and long works. The printer 1 includes a base frame 101 with casters and an apparatus body 11 placed on the base frame 101 and configured to perform the printing process.

The apparatus body 11 includes a work conveyance path 12, a conveyor roller 13, pinch roller units 14 and a carriage 2. The work conveyance path 12 is a conveyance path extending in a front-rear direction for loading a work W, to which the printing process is applied, into the apparatus body 11 from a rear side and unloading the work W from a front side. The conveyor roller 13 is a roller extending in a lateral direction and configured to generate a drive force for intermittently feeding the work W along the work conveyance path 12. The pinch roller unit 14 is arranged to face the conveyor roller 13 from above and includes a pinch roller which forms a conveyance nip together with the conveyor roller 13. A plurality of the pinch roller units 14 are arranged at predetermined intervals in the lateral direction.

The carriage 2 is a movable body on which units for performing the printing process on the work W are mounted and which can reciprocate along the lateral direction on the base frame 101. A carriage guide 15 with a guide rail for guiding reciprocal movements of the carriage 2 stands to extend in the lateral direction on a rear side of the base frame 101. A timing belt 16 is so assembled with the carriage guide 15 as to be able to circulate in the lateral direction. The carriage 2 includes a fixing portion for the timing belt 16, and moves in the lateral direction while being guided by the guide rail as the timing belt 16 circulates in a forward or reverse direction.

The printing process is performed by intermittently feeding the work W by the conveyor roller 13 and the pinch roller units 14 and moving the carriage 2 in the lateral direction while the work W is stopped to print and scan the work W (inject ink to the work W). Note that, in the work conveyance path 12, a platen 121 (see FIG. 2) additionally provided with a function of sucking the work W is arranged below a passage path of the carriage 2. During the printing process, the carriage 2 performs printing and scanning with the work W sucked to the platen 121.

The apparatus body 11 is covered by an outer cover 102. A side station 103 is arranged in a region to the right of the outer cover 102. An immovable ink cartridge shelf 17 for holding ink cartridges IC (FIGS. 5 and 6) for storing ink (predetermined liquid) for the printing process is housed in the side station 103.

A carriage retraction area 104 serving as a retraction space for the carriage 2 is present in a front part of the side station 103. As shown in FIG. 3, a left frame 105 and a right frame 106 stand on the base frame 101 while being spaced apart in the lateral direction by a distance corresponding to the work conveyance path 12. The classification of work areas is as follows. An area between these left and right frames 105, 106 serves as a printing area P (processing area) where the printing process can be performed. The carriage guide 15 has a lateral width longer than the printing area P, and the carriage 2 is movable to a right outer side of the printing area P. An area on a right end side of the carriage guide 15, i.e. an area to the right of and adjacent to the printing area P is a maintenance area M. When the printing process is not performed, the carriage 2 is retracted to the maintenance area M (carriage retraction area 104). Further, a pressurized purge process to be described later is also performed in this carriage retraction area 104.

A feeding unit 107 housing a feed roll Wa, which is a winding body of the work W having the printing process applied thereto, is provided on a rear side of the base frame 101. Further, a winding unit 108 housing a winding roll Wb, which is a winding body of the work W after the printing process, is provided on a front side of the base frame 101. The winding unit 108 includes an unillustrated drive source for rotationally driving a winding shaft of the winding roll Wb, and winds the work W while applying predetermined tension to the work W by a tension roller 109.

[Configuration of Carriage with Liquid Injection Head of First Embodiment]

Figure 4:
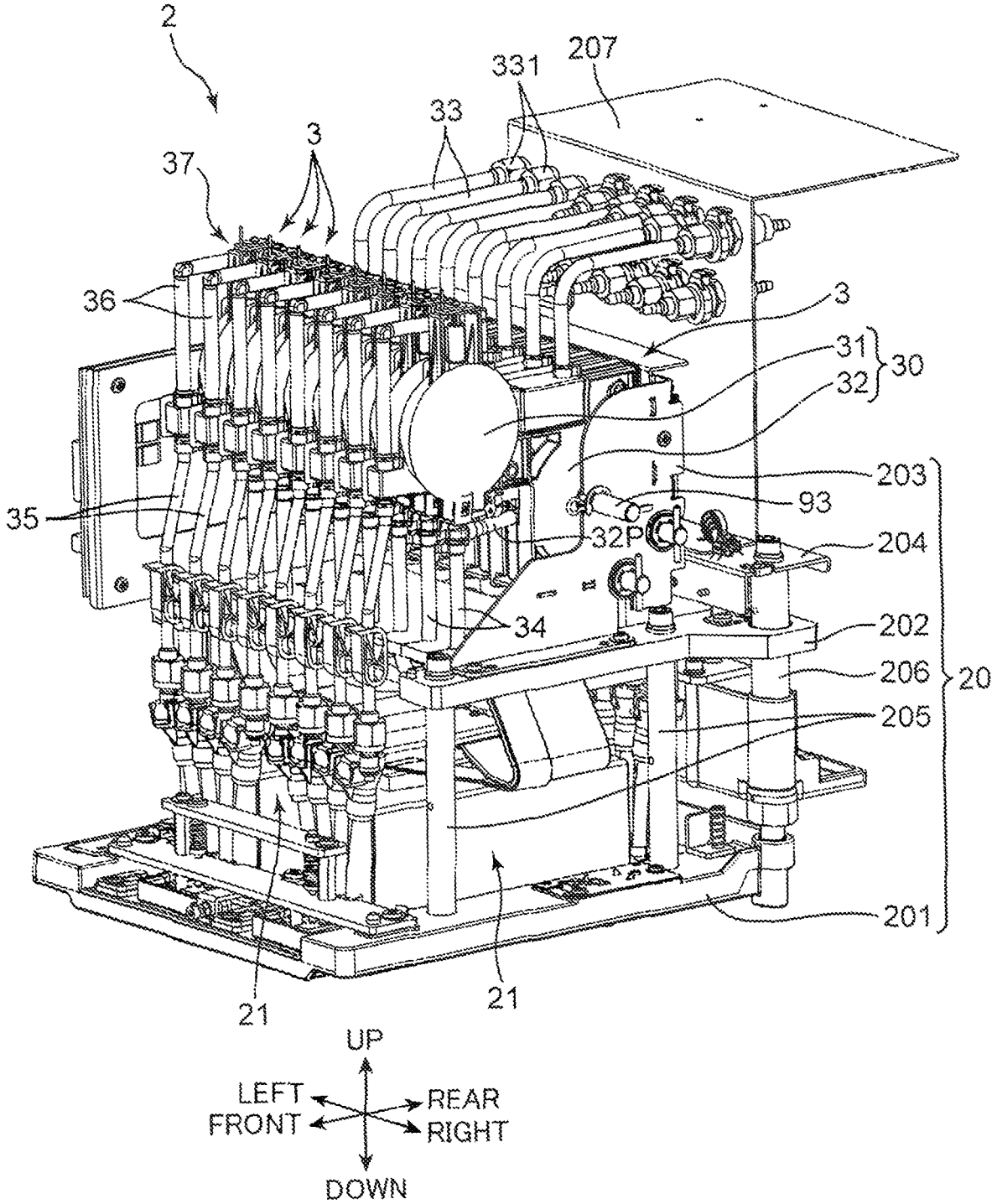
FIG. 4 is an overall perspective view of a carriage mounted in the ink jet printer.

FIG. 4 is an overall perspective view of the carriage 2. Head units 21 (liquid injection heads) according to the first embodiment for injecting the ink (liquid) to the work W and liquid supply units 3 for supplying the ink from the ink cartridges IC (FIG. 5) to the head units 21 are mounted on the carriage 2. FIG. 4 shows an example in which two head units 21 and eight liquid supply units 3 are mounted on the carriage 2. Specifically, four liquid supply units 3 are equipped for each head unit 21 to supply respective inks of cyan, magenta, yellow and black. Note that the ink of a different color is filled into each liquid supply unit 3, and inks of at most eight colors may be injected from the two head units 21.

The carriage 2 includes the head units 21 and a carriage frame 20 for holding the head units 21. The carriage frame 20 includes a lower frame 201 located at a lowermost position, an upper frame 202 arranged above and at a distance from the lower frame 201, a rack 203 mounted on the upper surface of the upper frame 202 and a back surface frame 204 mounted on the rear surface of the upper frame 202. The lower frame 201 and the upper frame 202 are coupled by coupling support columns 205 extending in the vertical direction. An unillustrated ball screw mechanism is mounted on the back surface frame 204, and a nut portion driven by that ball screw is mounted on the lower frame 201. Further, the back surface frame 204 is provided with guiding support columns 206 extending in the vertical direction. By the drive of the ball screw mechanism, a coupled body of the lower frame 201 and the upper frame 202 can move in the vertical direction while being guided by the guiding support columns 206. That is, a body part of the carriage 2 is movable in the vertical direction with respect to the back surface frame 204. Further, a back surface plate 207, to which an upstream end 331 of an upstream pipe 33 to be described later is attached, stands on the back surface frame 204.

The head units 21 are mounted on the lower frame 201. Since the body part of the carriage 2 is movable in the vertical direction as described above, vertical height positions of the head units 21 with respect to the work W are adjustable. The liquid supply units 3 are mounted on the lower frame 202. The eight liquid supply units 3 are supported on the upper frame 202 while being aligned in the lateral direction in the rack 203. A guided portion to be guided by the guide rail of the carriage guide 15, a fixing portion to the timing belt 16 and the like are provided on the back surface frame 204.

Figure 5:
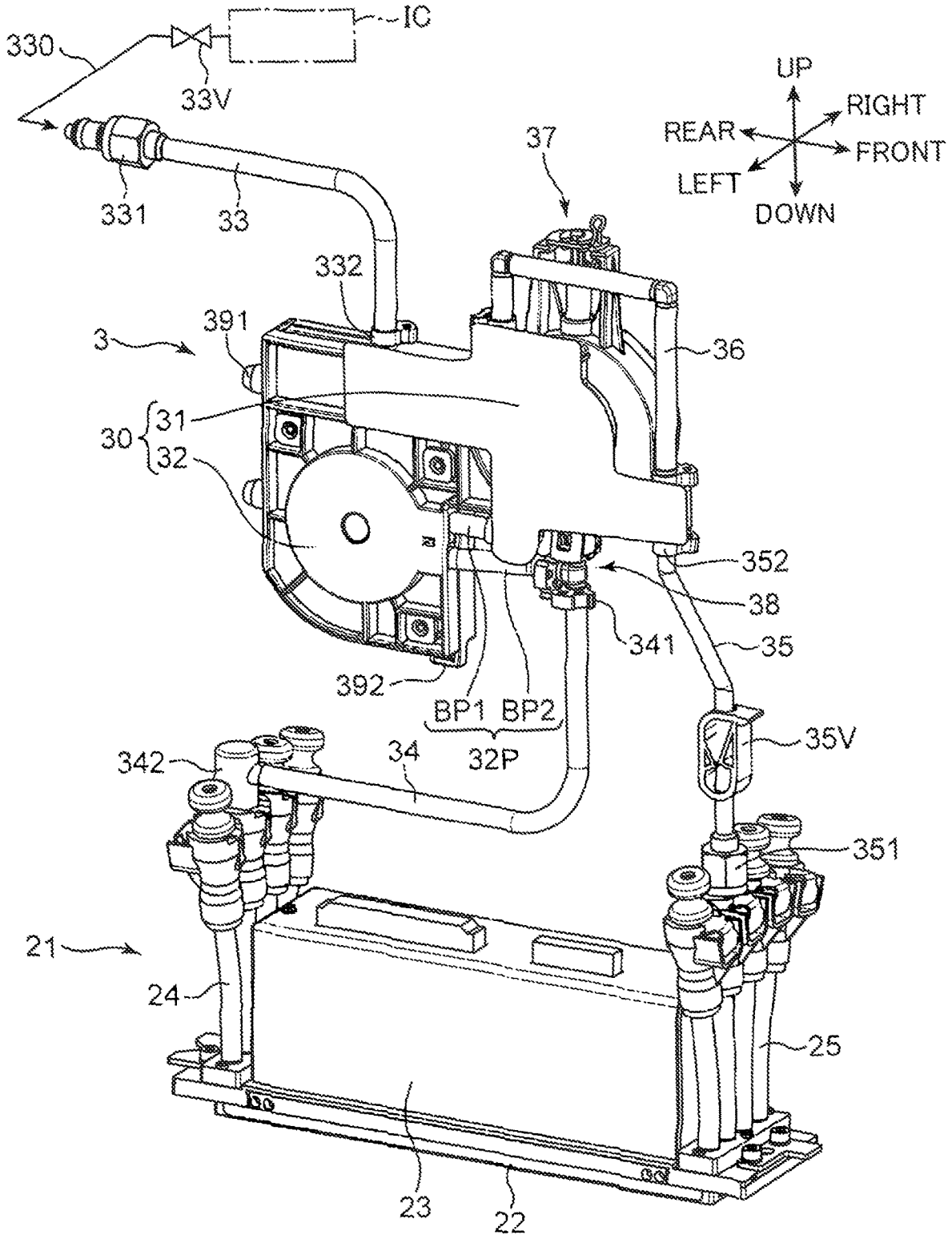
FIG. 5 is a perspective view showing one liquid supply unit and one head unit according to a first embodiment.

FIG. 5 is a perspective view showing one liquid supply unit 3 and one head unit 21 according to the first embodiment. The liquid supply unit 3 includes a body portion 30 with a tank portion 31 and a pump portion 32, the upstream pipe 33 (part of a first supply passage) arranged on an upstream side of the body portion 30 in an ink supply direction (liquid supply direction), a downstream pipe 34 (part of a second supply passage) arranged on a downstream side of the body portion 30, a return pipe 35 (return path) serving as a path for returning the ink from the side of the head unit 21 to the side of the liquid supply unit 3, a monitor pipe 36 and a bypass pipe 32P (bypass supply passage).

Figure 7:
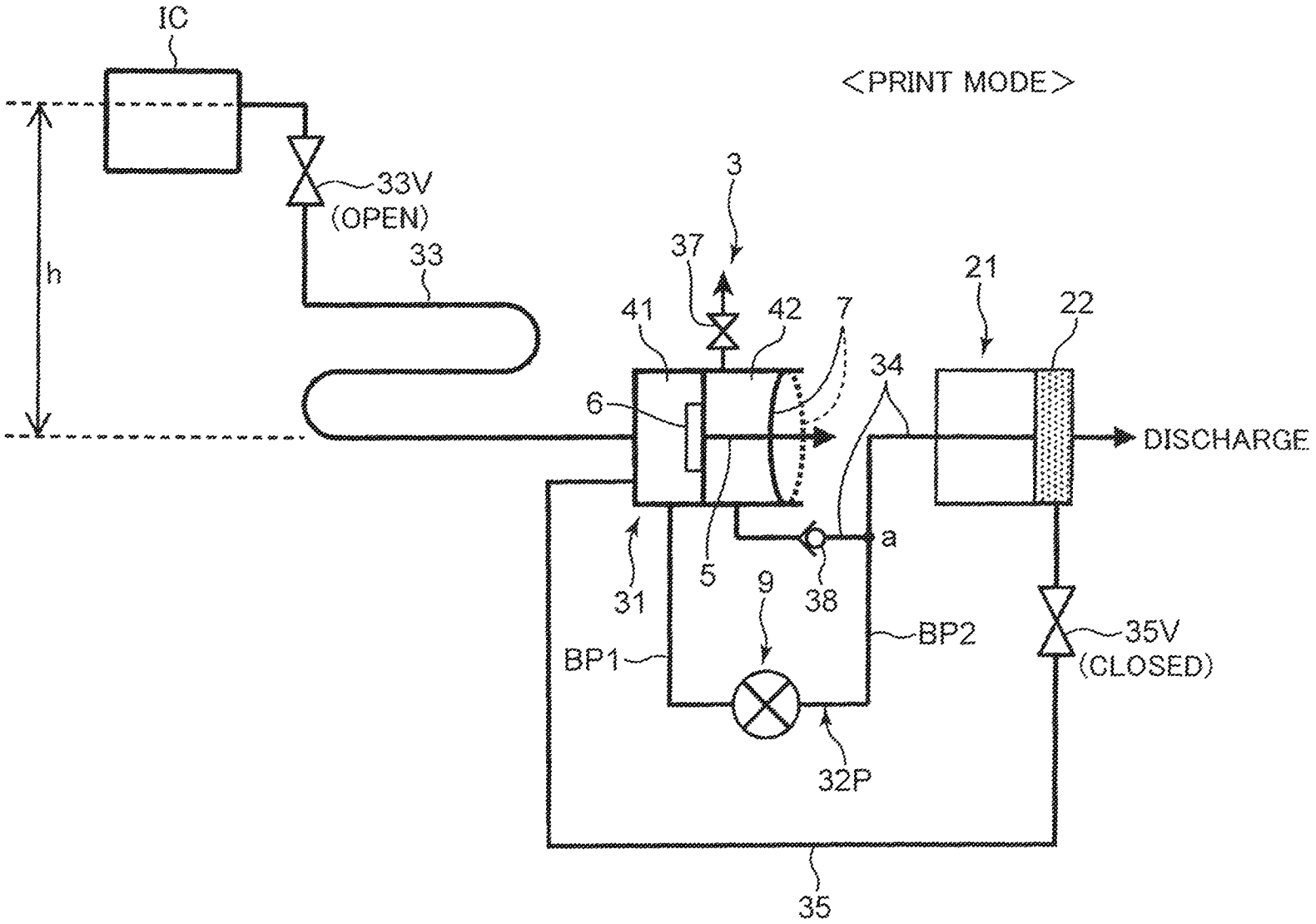
FIG. 7 is a block diagram showing a liquid supply system in the first embodiment in a state where the print mode is being performed.
Figure 8:
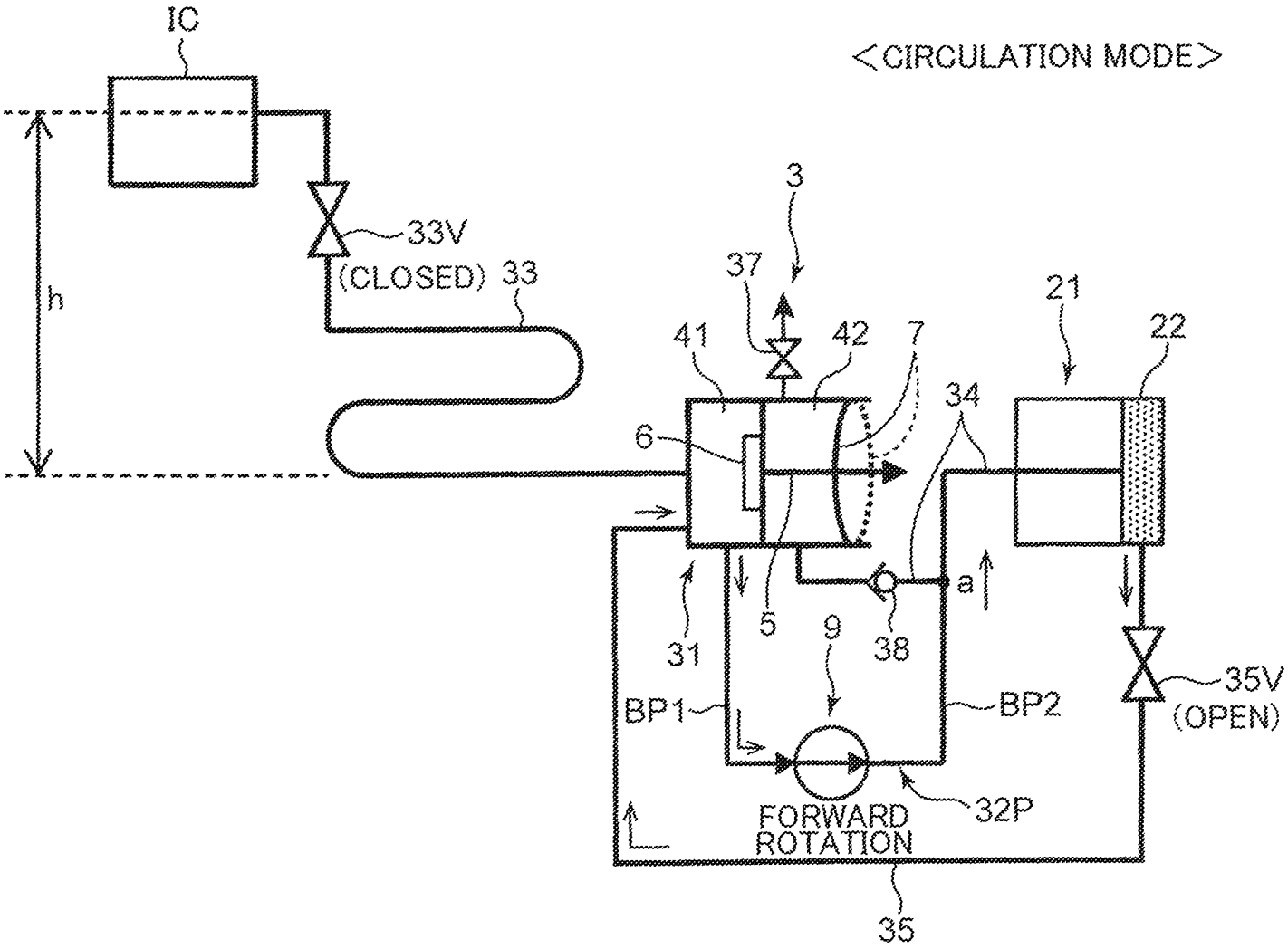
FIG. 8 is a block diagram showing a state where the circulation mode is being performed.

The tank portion 31 is a region forming a space for temporarily storing the ink to be supplied to the head unit 21 under a negative pressure environment. The pump portion 32 is a region for housing a pump 9 (pressurizing mechanism; FIGS. 7 to 9) to be operated during a decompression process for forming the negative pressure environment, a pressurized purge process for cleaning the head unit 21 (ink discharging portion 22) and a circulation process for circulating the ink between the head unit 21 and the liquid supply unit 3.

The upstream pipe 33 is a supply pipe allowing communication between the tank portion 31 (second chamber 42) and the ink cartridge IC (liquid storage container). The upstream end 331 of the upstream pipe 33 is connected to a terminal end part of a tube 330 extending from the ink cartridge IC, and a downstream end 332 is connected to an inlet part of the tank portion 31. A supply valve 33V functioning to open and close the upstream pipe 33 is mounted in the tube 330. When the supply valve 33V is opened, a state is entered where the ink can be supplied from the ink cartridge IC to the tank portion 31. When the supply valve 33V is closed, the ink cannot be supplied.

The downstream pipe 34 is a supply pipe allowing communication between the tank portion 31 (second chamber 42) and the head unit 21. An upstream end 341 of the downstream pipe 34 is connected to an outlet part of the tank portion 31 via a backflow prevention mechanism 38 to be described later, and a downstream end 342 thereof is connected to the head unit 21. The return pipe 35 is a pipe allowing communication between the head unit 21 and the tank portion 31 (second chamber 42). An upstream end 351 of the return pipe 35 is connected to the head unit 21, and a downstream end 352 thereof is connected to the tank portion 31. A clip 35V for opening and closing the return pipe 35 is mounted on the return pipe 35. FIG. 5 shows a state where the clip 35V squeezes the return pipe 35 to close the return pipe 35. The monitor pipe 36 is a pipe for indicating an ink level in the tank portion 31. The bypass pipe 32P is a conduit for feeding the ink to the downstream pipe 34 without via the negative pressure environment (second chamber 42) of the tank portion 31. The bypass pipe 32P includes a bypass upstream pipe BP1 arranged upstream of the pump portion 32 and a bypass downstream pipe BP2 arranged downstream of the pump portion 32.

The head unit 21 includes the ink discharging portion 22, a control unit 23, an end tube 24 and a collection tube 25. The ink discharging portion 22 is a nozzle part for discharging ink droplets toward the work W. A piezo method using a piezo element, a thermal method using a heating element or the like can be adopted as a method for discharging ink droplets in the ink discharging portion 22. The control unit 23 includes a control board for controlling the piezo element or the heating element provided in the ink discharging portion 22 and controls an operation of discharging ink droplets from the ink discharging portion 22.

The end tube 24 is a tube linking the downstream end 342 of the downstream pipe 34 and the ink discharging portion 22. The downstream end 342 is a cap-type socket and attachable to an upper end fitting part of the end tube 24 in a single operation. A collection tube 25 is a tube linking the ink discharging portion 22 and the upstream end 351 of the return pipe 35. Note that the collection tube 25 is also used to discharge preservation solution sealed in the liquid supply unit 3 during initial usage. During initial usage, the downstream end 342 of the downstream pipe 34 is attached to the upper end fitting part of the end tube 24 and a separate tube is connected to the collection tube 25 to open a storage space for the preservation solution, whereby an operation of discharging the preservation solution is performed.

Figure 6A:
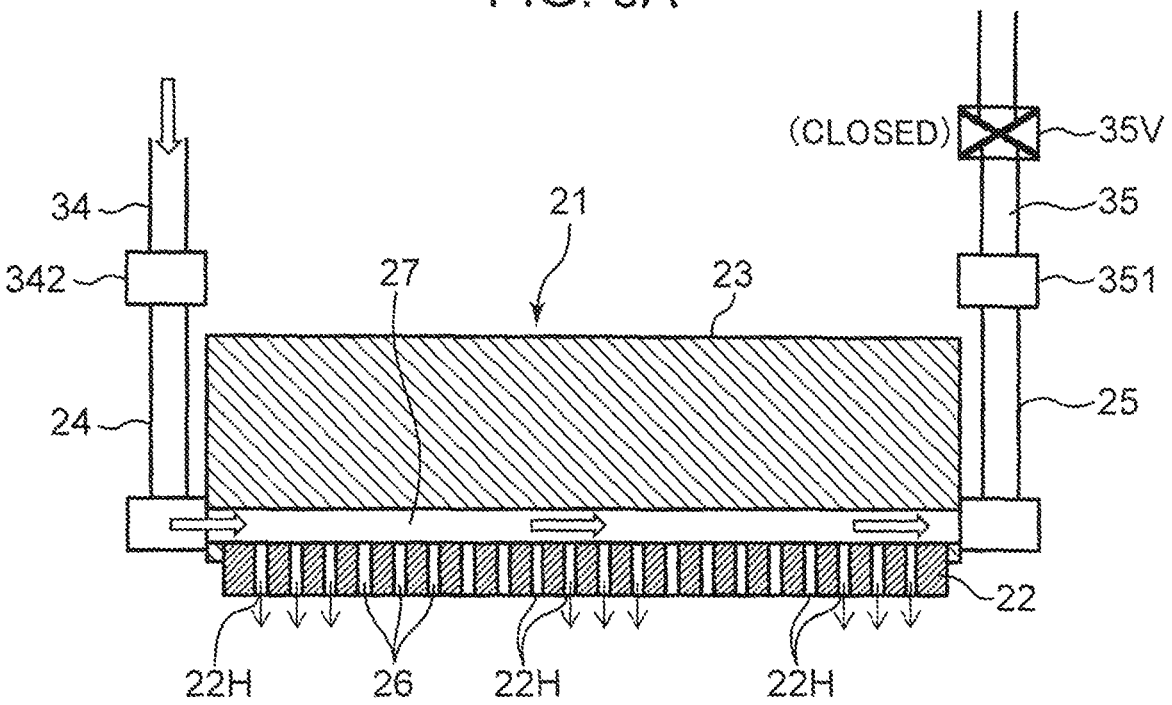
Figure 6B:
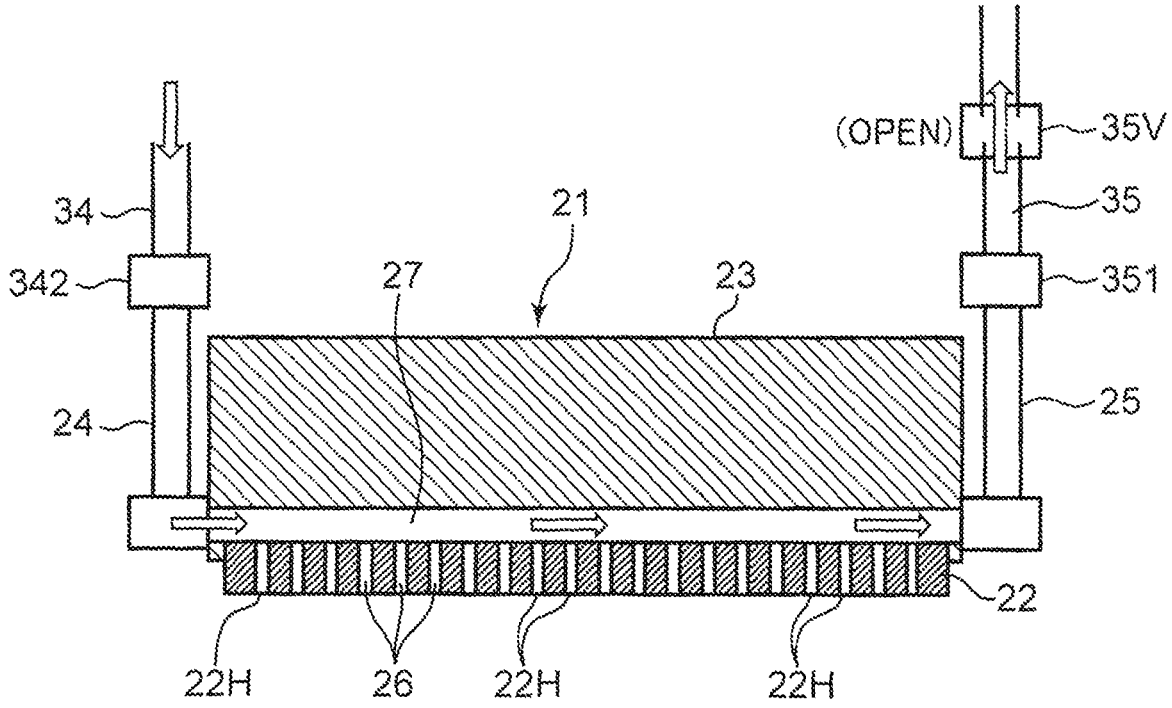

FIGS. 6A and 6B are views schematically showing a cross-section of the head unit 21 along the front-rear direction, wherein FIG. 6A shows a state where the clip 35V is closed (print mode) and FIG. 6B shows a state where the clip 35V is opened (circulation mode). The ink discharging portion 22 includes a plurality of ink discharge holes 22H (liquid discharge opening) for discharging the ink toward the work W. Individual passages 26 for individually supplying the ink to the ink discharge holes 22H and a common passage 27 for supplying the ink to these individual passages 26 are provided inside the head unit 21.

The common passage 27 is an ink passage extending in a horizontal direction. An upstream end of each individual passage 26 communicates with the common passage 27. The downstream end 342 of the downstream pipe 34 communicates with an upstream side of the common passage 27 via the end tube 24. The upstream end 351 of the return pipe 35 communicates with a downstream side of the common passage 27 via the collection tube 25. In other words, the upstream side of the common passage 27 and the downstream side of the common passage 27 respectively communicate with the tank portion 31 (second chamber 42) through the downstream pipe 34 and through the return pipe 35.

If the ink is supplied to the head unit 21 from the downstream pipe 34 with the return pipe 35 closed by the clip 35V as shown in FIG. 6A, the ink is discharged from the ink discharge holes 22H via the common passage 27 and the respective individual passages 26. On the other hand, if the ink is supplied to the head unit 21 from the downstream pipe 34 with the clip 35V opened to open the return pipe 35 as shown in FIG. 6B, the ink exclusively returns to the tank portion 31 through the return pipe 35. In this case, if the return pipe 35 is set to a negative pressure, the ink does not leak from the ink discharge holes 22H.

[Summary of Liquid Supply System]

In this embodiment, the device is configured such that the ink cartridge IC is arranged above the head unit 21 and the ink is supplied to the head unit 21 by a water head difference. In the case of supplying the ink by the water head difference, the ink is constantly discharged from the ink discharging portion 22 of the head unit 21 if the ink is supplied at normal pressure. Thus, it is necessary to dispose a negative pressure generating portion for generating a negative pressure environment in the ink supply path and set the ink discharging portion 22 to a suitable negative pressure. The tank portion 31 of the liquid supply unit 3 functions as the above negative pressure generating portion.

FIG. 7 is a block diagram schematically showing the liquid supply system adopted in the carriage 2 of this embodiment. The ink cartridge IC is arranged at a position higher than the ink discharging portion 22 by a height h. This height h serves as the water head difference and the ink in the ink cartridge IC is supplied to the head unit 21 by this water head difference. The liquid supply unit 3 is incorporated at an intermediate position of the ink supply path between the ink cartridge IC and the head unit 21. The tank portion 31 of the liquid supply unit 3 includes a first chamber 41 (upstream chamber/part of the first supply passage) set to a pressure (first pressure) higher than an atmospheric pressure by receiving the water head difference and the second chamber 42 (pressure chamber) arranged downstream of the first chamber 41 in the ink supply direction and set to a negative pressure (second pressure decompressed from the first pressure). The first chamber 41 is a chamber in which a negative pressure operation is not performed and to which a pressure P by the water head difference is applied in addition to the atmospheric pressure. This pressure P is expressed by $P=\rho gh$ [Pa] when $\rho$ denotes water density (ink can be handled equivalent to water in density), g denotes a gravitational acceleration and h denotes the water head difference. The first chamber 41 communicates with the ink cartridge IC via the upstream pipe 33. The second chamber 42 communicates with the ink discharging portion 22 via the downstream pipe 34.

An on-off valve 6 (opening/closing member) coupled to a pressing member 5 is arranged on a wall surface partitioning between the first chamber 41 and the second chamber 42. Further, a wall portion defining the second chamber 42 is partially constituted by an atmospheric pressure detection film 7 (flexible film member). When a pressure in the second chamber 42 reaches a negative pressure exceeding a predetermined threshold value, the atmospheric pressure detection film 7 detects the atmospheric pressure to be displaced. This displacement force is applied to the pressing member 5, a posture of the on-off valve 6 coupled to the pressing member 5 changes from a closing posture to an opening posture, and the first chamber 41 and the second chamber 42 are allowed to communicate. An ink supply route during a normal printing process is a route passing through the upstream pipe 33, the first chamber 41, the second chamber 42 and the downstream pipe 34. In addition to this, the bypass pipe 32P for short-circuiting the first chamber 41 and the downstream pipe 34 without via the second chamber 42 is provided. An upstream end of the bypass pipe 32P is connected to the upstream pipe 33 via the first chamber 41 and a downstream end thereof joins the downstream pipe 34 (joint part a). The pump 9 capable of rotating in forward and reverse rotation directions is arranged in the bypass pipe 32P.

FIG. 7 is also a diagram showing a state where the print mode in which the liquid supply unit performs the printing process is performed. In this print mode, the supply valve 33V of the upstream pipe 33 is opened, whereas the clip 35V of the return pipe 35 is closed. Further, in the print mode, a predetermined amount of the ink is filled in each of the first and second chambers 41, 42 and the second chamber 42 is set to a predetermined negative pressure. The pressure in the first chamber 41 is the atmospheric pressure+ρgh [Pa] due to the water head difference as described above and the ink can be supplied from the ink cartridge IC by the water head difference any time. As basic setting of the print mode, the on-off valve 6 for setting the second chamber 42 to a negative pressure is set in the closing posture and the first and second chambers 41, 42 are separated. The pump 9 is in a stopped state. The pump 9 is a tube pump and the bypass pipe 32P is in a closed state when the pump 9 is stopped. Thus, the downstream pipe 34 and the ink discharging portion 22 are also maintained at the negative pressure.

To smoothly fill the ink into the second chamber 42, an air vent mechanism 37 is attached to the second chamber 42. A predetermined amount of the ink needs to be initially filled into the second chamber 42 during initial usage, after maintenance and the like. The air vent mechanism 37 promotes the initial filling by allowing the second chamber 42 set in the negative pressure environment to temporarily communicate with the atmosphere (by venting air in the second chamber 42). Further, the ink stored in the second chamber 42 may generate air bubbles by heating. The air vent mechanism 37 is also used in removing air based on the air bubbles from the second chamber 42.

When the head unit 21 operates and the ink discharging portion 22 discharges ink droplets, the ink in the second chamber 42 is consumed and, accordingly, a degree of the negative pressure in the second chamber 42 progresses. That is, the ink discharging portion 22 sucks the ink from the second chamber 42 in a state separated from the atmosphere and enhances a negative pressure degree of the second chamber 42 every time discharging ink droplets. When the pressure in the second chamber 42 reaches a negative pressure exceeding the predetermined threshold value as the ink in the second chamber 42 decreases, the atmospheric pressure detection film 7 detects the atmospheric pressure to be displaced as described above. By this displacement force, the posture of the on-off valve 6 changes from the closing posture to the opening posture through the pressing member 5 and the first and second chambers 41, 42 communicate. Thus, the ink flows from the first chamber 41 into the second chamber 42 due to a pressure difference between the both chambers.

As the ink flows into the second chamber 42, the negative pressure degree of the second chamber 42 is gradually alleviated and approaches the atmospheric pressure. Simultaneously, the displacement force applied to the pressing member 5 from the atmospheric pressure detection film 7 also becomes gradually smaller. When the pressure in the second chamber 42 reaches a negative pressure below the predetermined threshold value, the posture of the on-off valve 6 returns to the closing posture and the first and second chambers 41, 42 are separated again. At this time, the ink is replenished into the first chamber 41 from the ink cartridge IC by the water head difference by an amount flowed into the second chamber 42 from the first chamber 41. In the print mode, such an operation is repeated.

The liquid supply system of this embodiment is capable of performing the circulation mode, a pressurized purge mode and a decompression mode in addition to the above print mode. The circulation mode is a mode in which the ink is circulated using the return pipe 35 to remove air contained in the ink passages (individual passages 26, common passage 27) in the head unit 21. The pressurized purge mode is a mode for supplying high-pressure ink to the ink discharging portion 22 and causing the ink discharging portion 22 to discharge the ink in order to recover or prevent ink clogging. The decompression mode is a mode for setting the second chamber 42 at normal pressure to the predetermined negative pressure during initial usage, after maintenance and the like.

FIG. 8 is a block diagram showing a state where the circulation mode is being performed. In this circulation mode, the supply valve 33V is closed to close the upstream pipe 33, whereas the clip 35V is opened to open the return pipe 35. Further, the pump 9 arranged in the bypass pipe 32P is driven in a forward rotation direction. As shown in FIG. 6A, the upstream end 351 of the return pipe 35 communicates with the downstream end of the common passage 27 in the head unit 21. On the other hand, the downstream end 352 of the return pipe 35 communicates with the first chamber 41. Further, the downstream end 352 of the return pipe 35 also communicates with the second chamber 42 via the first chamber 41 directly communicating therewith and the on-off valve 6.

If the pump 9 is driven in the forward rotation direction in the circulation mode, the ink circulates through a circulation path composed of the bypass downstream pipe BP2, a part of the downstream pipe 34 downstream of the joint part a, the common passage 27 in the head unit 21, the return pipe 35 and the bypass upstream pipe BP1. At this time, since the supply valve 33V is closed, the return pipe 35 and the common passage 27 are set to a negative pressure by an ink suction operation of the pump 9. Accordingly, the ink does not leak from the ink discharge holes 22H. By the execution of the circulation mode, air having entered the head unit 21 can be collected into the liquid supply unit 3 (first chamber 41). In this way, the air can be prevented from staying in the individual passages 26 and the ink discharge holes 22H and a discharge failure of the ink can be suppressed. Note that the air collected into the first chamber 41 can be transferred to the second chamber 42 through the on-off valve 6. Then, this air is released to outside by the air vent mechanism 37.

Figure 9A:
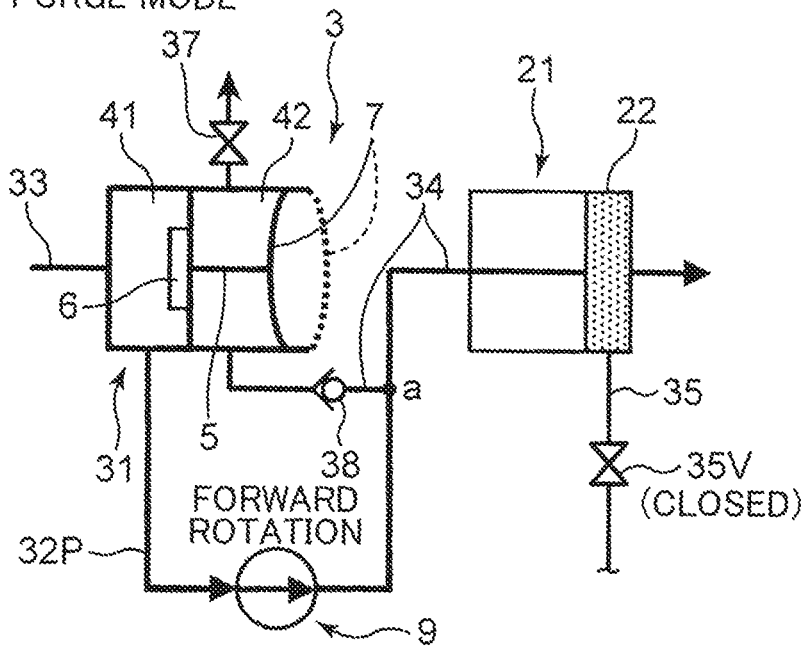
FIG. 9A is a diagram showing a state where a pressurized purge mode is being performed and FIG. 9B is a diagram showing a state where a decompression mode is being performed.

FIG. 9A is a diagram showing a state where the pressurized purge mode is being performed. In the pressurized purge mode, the pump 9 is driven in the forward rotation direction. The clip 35V is closed. By the forward drive of the pump 9, the ink directly moves from the upstream pipe 33 toward the downstream pipe 34 via the first chamber 41 and the bypass pipe 32P while bypassing the second chamber 42. That is, the ink pressurized in the pump 9 is supplied to the ink discharging portion 22. In this way, the ink is forcibly discharged from the ink discharging portion 22 to clean the ink discharging portion 22. Note that an operation similar to that in the pressurized purge mode is also performed when the preservation solution sealed in the liquid supply unit 3 is discharged during initial usage.

As just described, in this embodiment, a path passing through the bypass passage 32P in parallel with a path passing through the second chamber 42 is provided in a liquid supply path from the ink cartridge IC to the head unit 21. The pump 9 is arranged in the bypass passage 32P. Thus, the ink pressurized using the bypass passage 32P can be supplied to the head unit 21 without via the second chamber 42 having a negative pressure mechanism. Specifically, an operation of pressurizing and purging the ink discharging portion 22 can be easily performed by a simple configuration of arranging the bypass passage 32P and the pump 9 in parallel with the second chamber 42.

Further, the backflow prevention mechanism 38 is provided to prevent the pressurized ink from flowing back to the second chamber 42 through the downstream pipe 34 when the pressurized purge mode is performed. The backflow prevention mechanism 38 is arranged in the downstream pipe 34 on a side upstream of the joint part a of the downstream pipe 34 and the downstream end of the bypass pipe 32P. Since a side of the downstream pipe 34 upstream of the joint part a is closed by the backflow prevention mechanism 38, all the high-pressure ink generated in the bypass pipe 32P flows toward the ink discharging portion 22. Thus, the breakage of the atmospheric pressure detection film 7 defining the second chamber 42 is prevented.

Figure 9B:
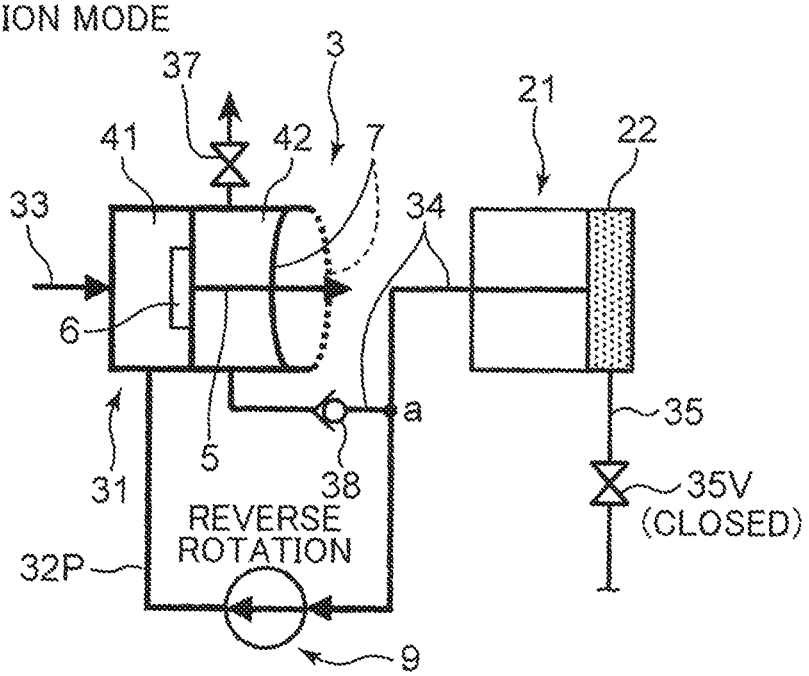

FIG. 9B is a diagram showing a state where the decompression mode is being performed. In the decompression mode, the pump 9 is driven in the reverse rotation direction. The clip 35V is closed. When the pump 9 is driven in the reverse rotation direction, the ink discharging portion 22 and the second chamber 42 are decompressed through the downstream pipe 34 and the bypass pipe 32P. The ink discharging portion 22 and the second chamber 42 are set to a predetermined negative pressure, i.e. a negative pressure at which ink droplets do not leak from the ink discharging portion 22 even if the ink is supplied by the water head difference, by this decompression mode. Note that if the ink discharging portion 22 is set to an excessive negative pressure, ink discharge by the drive of the piezo element or the like in the ink discharging portion 22 may be impeded. Thus, the ink discharging portion 22 and the second chamber 42 are desirably set, for example, to a weak negative pressure of about −0.2 to −0.7 kPa.

[Overall Structure of Liquid Supply Unit]

Figure 10A:
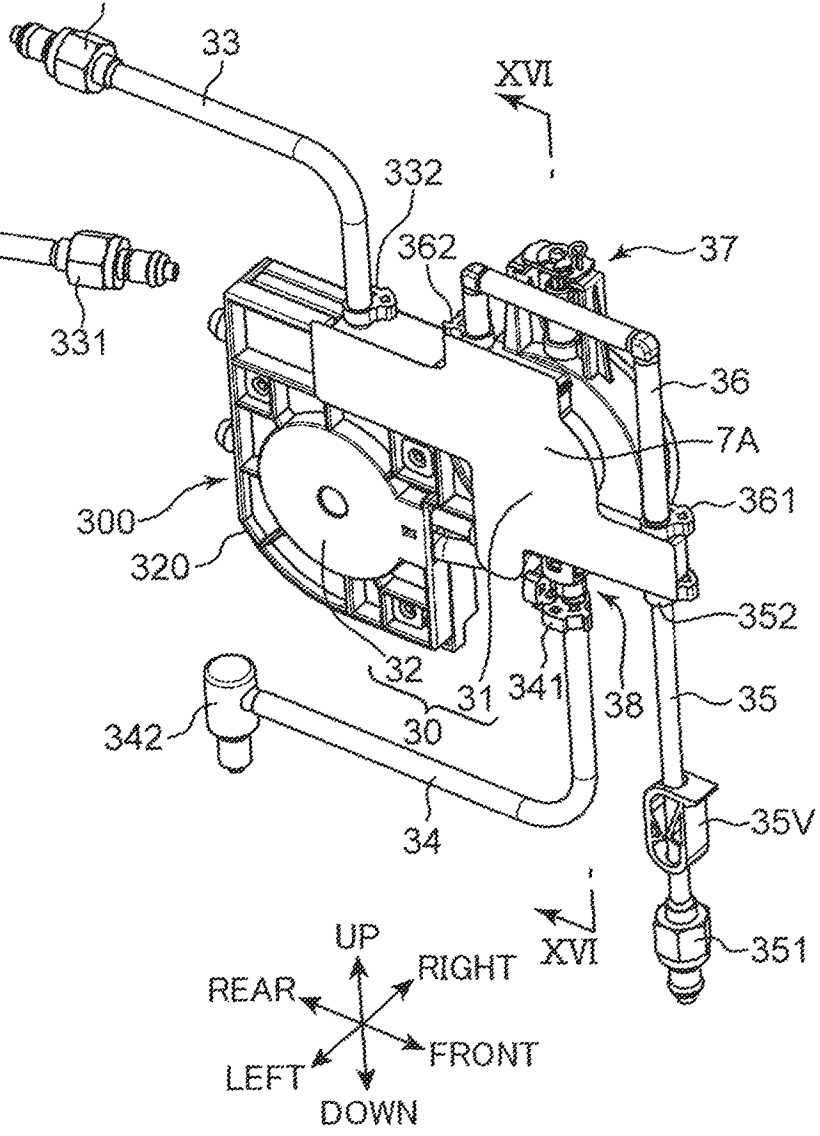
Figure 10B:
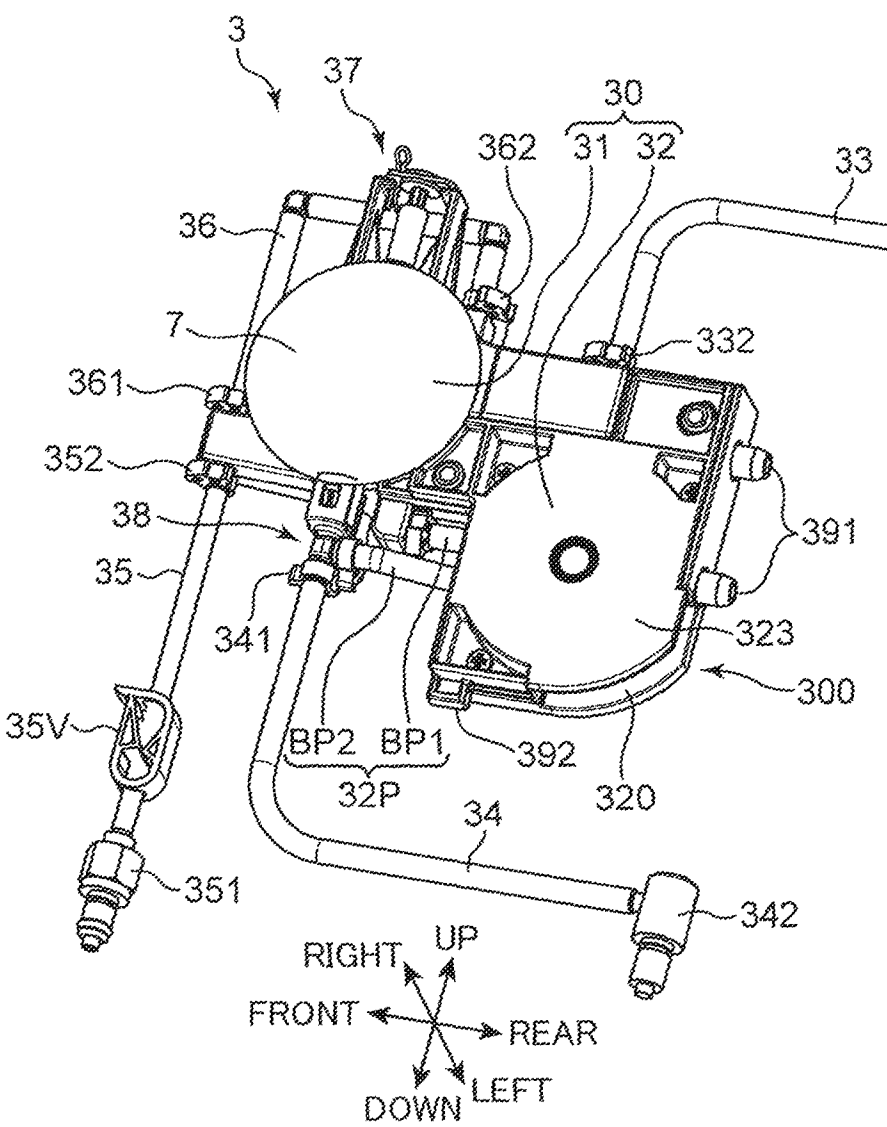
Figure 11:
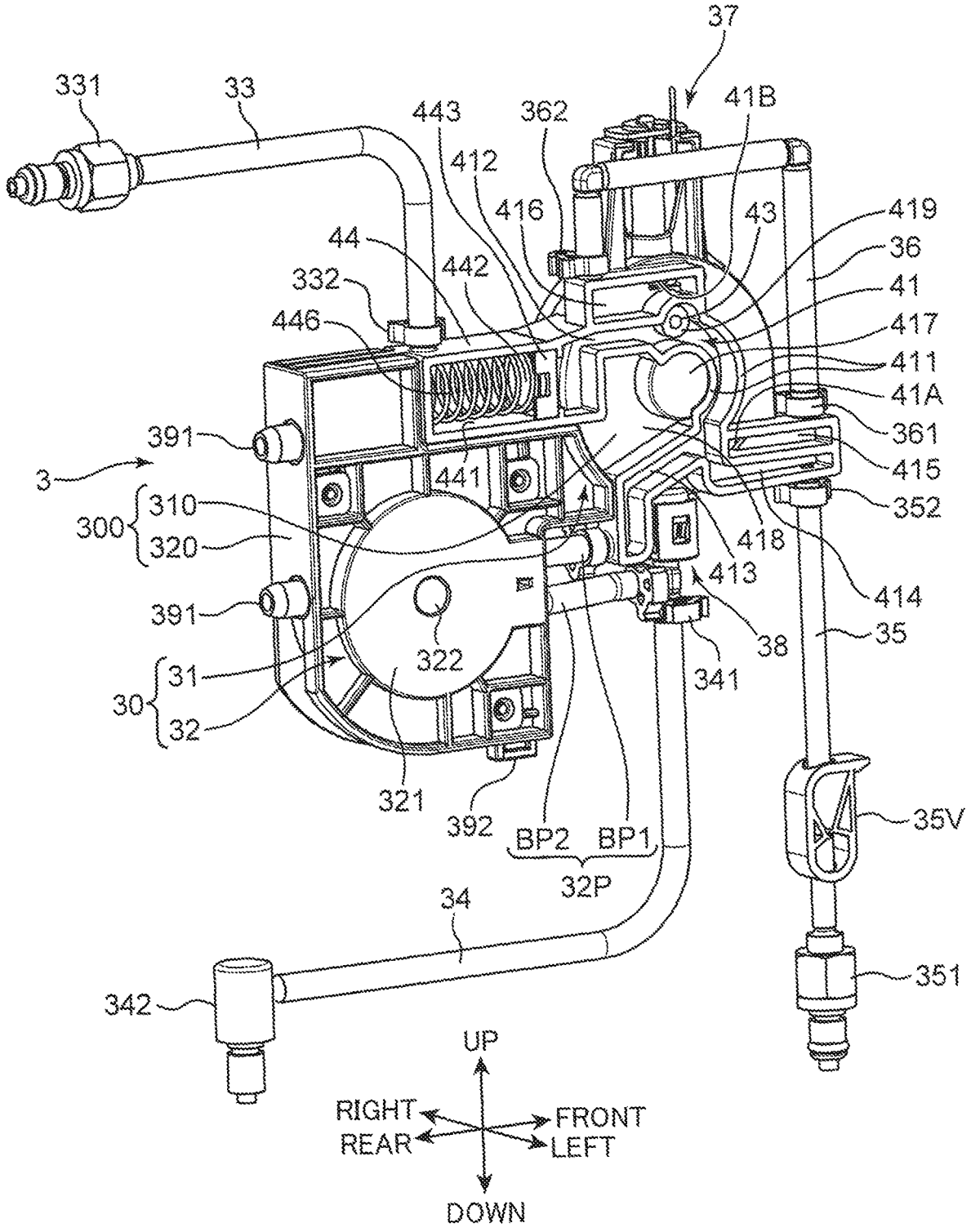
FIG. 11 is a perspective view of the liquid supply unit with a sealing film on the first chamber side removed.
Figure 12B:
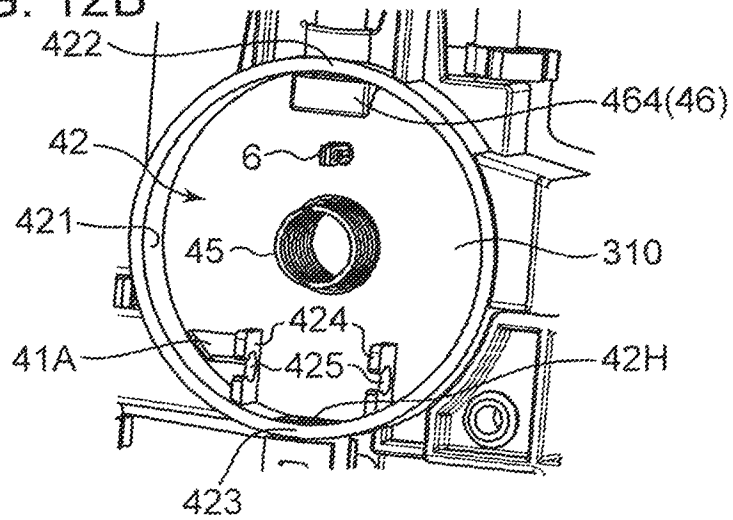
FIGS. 12A to 12C are perspective views of the liquid supply unit with an atmospheric pressure detection film on the second chamber side removed.
Figure 12C:
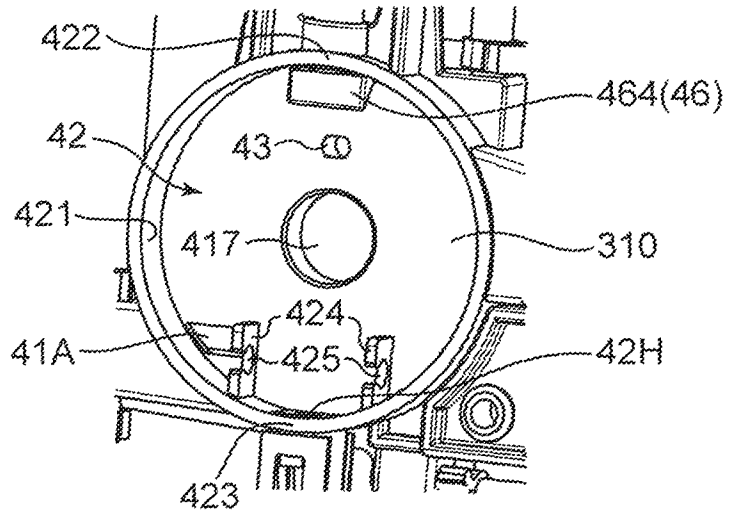
Figure 12A:
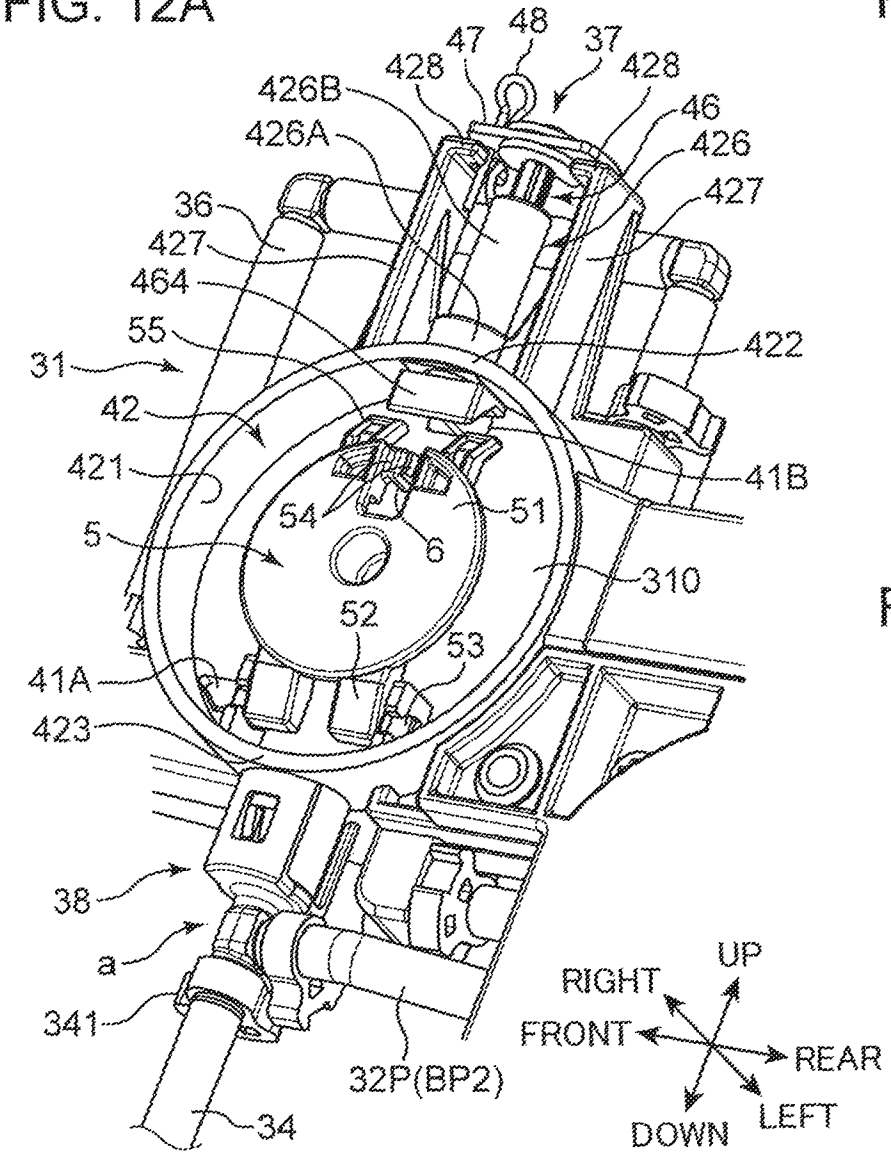
Figure 13:
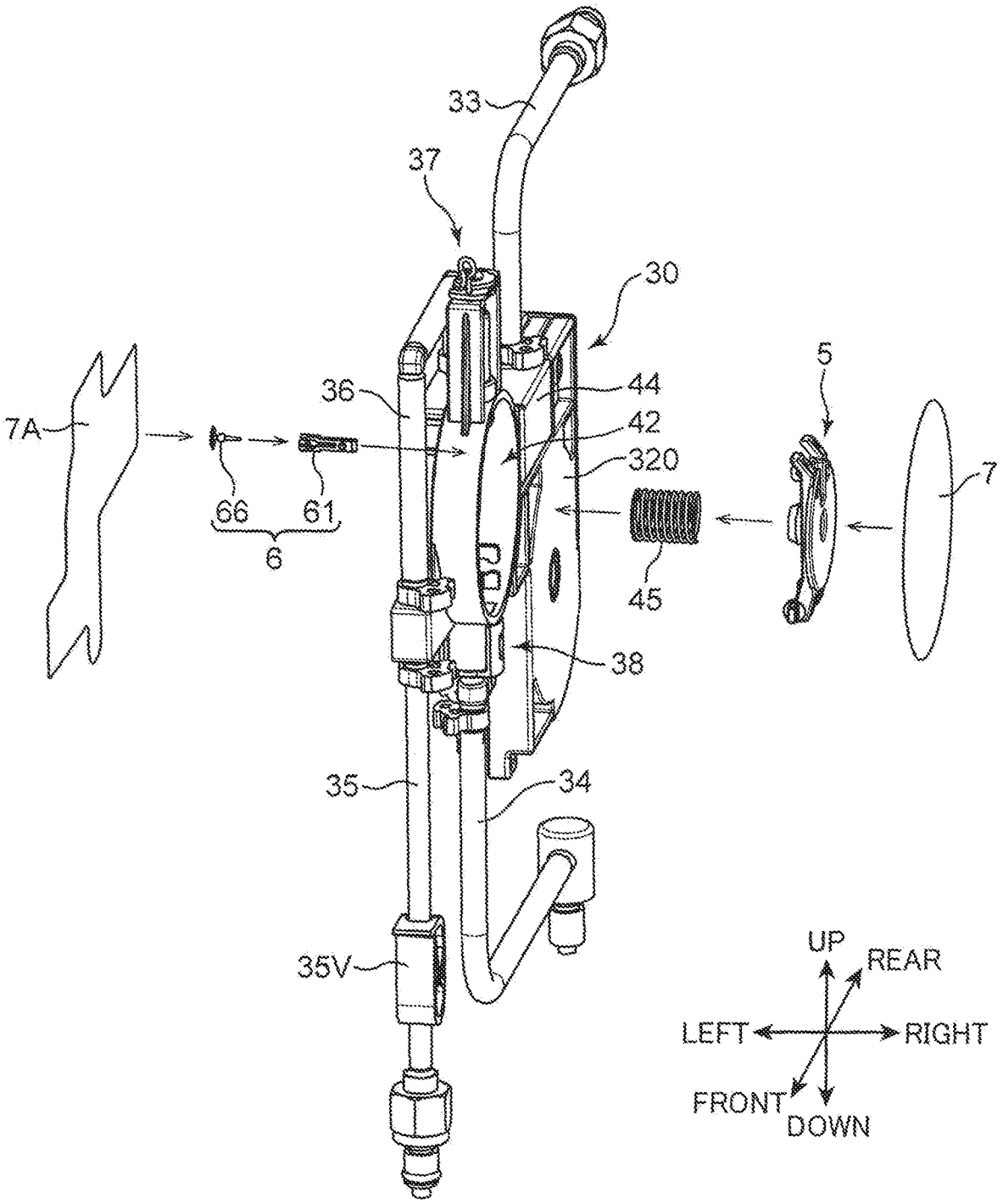
FIG. 13 is an exploded perspective view of the liquid supply unit.

Next, the structure of the liquid supply unit 3 according to this embodiment which enables the execution of each mode of the liquid supply system described above is described in detail. FIGS. 10A and 10B are perspective views of the liquid supply unit 3, wherein FIG. 10A is the perspective view viewed from the side of the first chamber 41 and FIG. 10B is the perspective view viewed from the side of the second chamber 42. FIG. 11 is a perspective view of the liquid supply unit 3 with a sealing film 7A on the side of the first chamber 41 removed, and FIGS. 12A to 12C are respectively perspective views of the liquid supply unit 3 with the atmospheric pressure detection film 7 on the side of the second chamber 42 removed. FIG. 13 is an exploded perspective view of the liquid supply unit 3.

As preliminarily described on the basis of FIGS. 7 to 9B, the liquid supply unit 3 includes the body portion 30 having the tank portion 31 and the pump portion 32, the upstream pipe 33, the downstream pipe 34, the return pipe 35, the bypass pipe 32P, the air vent mechanism 37, the backflow prevention mechanism 38, the pressing member 5, the on-off valve 6 and the atmospheric pressure detection film 7. Besides these, the liquid supply unit 3 includes the monitor pipe 36 for monitoring an ink liquid surface in the second chamber 42, and the sealing film 7A constituting a part of a wall surface defining the first chamber 41.

The body portion 30 includes a base board 300 (FIG. 11) formed of a flat plate extending in the front-rear direction. A front side of the base board 300 is a tank portion base plate 310 (wall portion) serving as a board of the tank portion 31 and a rear side thereof is a pump portion housing 320 forming a housing structure in the pump portion 32. The first chamber 41 is arranged on a left surface side of the tank portion base plate 310, and the second chamber 42 is arranged on a right surface side thereof. The first and second chambers 41, 42 are spaces capable of storing the ink. The tank portion base plate 310 is perforated to form a communication opening 43 allowing communication between the first chamber 41 and the second chamber 42. The aforementioned on-off valve 6 is arranged in this communication opening 43.

As shown in FIG. 11, the first chamber 41 is a narrow space roughly U-shaped in a left side view. This first chamber 41 is defined by a first partition wall 411 projecting leftward from the tank portion base plate 310. The first partition wall 411 is composed of a pair of wall pieces facing at a predetermined distance from each other. An inflow portion 412, which is an upstream end of the first chamber 41, communicates with a filter chamber 44 to be described later. The ink supplied from the upstream pipe 33 to the tank portion 31 flows into the first chamber 41 from the inflow portion 412 via the filter chamber 44.

The first chamber 41 is shaped to extend horizontally forward from the inflow portion 412 and be subsequently curved downward. A bypass communication chamber 413 and a return communication chamber 414 are connected in a branched manner to a downstream end of the first chamber 41. The bypass communication chamber 413 is a section for linking the first chamber 41 and the bypass upstream pipe BP1. An upstream end of the bypass upstream pipe BP1 is connected to a wall portion defining the vicinity of the lower end of the bypass communication chamber 413. The return communication chamber 414 is a section for linking the first chamber 41 and the return pipe 35. The downstream end 352 of the return pipe 35 is connected to a wall portion defining the vicinity of the front end of the return communication chamber 414. Note that the return communication chamber 414 is handled as a part of the return pipe 35 in FIGS. 7 and 8.

A lower monitor communication chamber 415 is arranged above the return communication chamber 414 and an upper monitor communication chamber 416 is arranged above a horizontal part of the first chamber 41. An upstream end 361 of the monitor pipe 36 communicates with the lower monitor communication chamber 415 and a downstream end 362 of the monitor pipe 36 communicates with the upper monitor communication chamber 416. Also with reference to FIG. 12, the tank portion base plate 310 is perforated with a lower communication hole 41A and an upper communication hole 41B arranged above the lower communication hole 41A. The lower monitor communication chamber 415 communicates with the second chamber 42 through the lower communication hole 41A, and the upper monitor communication chamber 416 communicates with the second chamber 42 through the upper communication hole 41B. That is, an ink liquid level in the monitor pipe 36 is linked with that in the second chamber 42.

In this embodiment, the monitor pipe 36 is formed of a transparent resin tube. Accordingly, a user can know the ink liquid level in the second chamber 42 by seeing the monitor pipe 36. In this embodiment, as shown in FIG. 4, the plurality of liquid supply units 3 are arranged in parallel in the lateral direction in the carriage 2. Thus, even if a transparent film is used as the atmospheric pressure detection film 7 located on the right side surface, the liquid supply units 3 other than the one in a rightmost part cannot allow the ink liquid level in the second chamber 42 to be seen.

However, in this embodiment, the monitor pipe 36 stands in front of the liquid supply unit 3. Thus, the user can know the ink liquid level in each second chamber 42 by seeing the monitor pipe 36 of each liquid supply unit 3 from the front of the carriage 2.

A spring seat 417 formed of a hollow cylindrical cavity is provided to project leftward near a vertical center of the first chamber 41. The spring seat 417 is a cavity for housing a biasing spring 45 to be described later and is open toward the second chamber 42. The first chamber 41 is set to surround substantially half around an outer peripheral wall of this spring seat 417. A spacer chamber 418 is provided behind the spring seat 417. The spacer chamber 418 is provided to make the volume of the first chamber 41 as small as possible. If the volume of the first chamber 41 increases, the amount of the stored ink increases. A swinging force is applied to the liquid supply unit 3 when the carriage 2 moves. If the weight of the ink increases, the atmospheric pressure detection film 7 and the sealing film 7A may be peeled off or broken due to an inertial force. Note that, if there is no such concern, the spacer chamber 418 may be omitted and the first chamber 41 may be, for example, formed to surround the spring seat 417.

The communication opening 43 is arranged at a position above the spring seat 417 in the first chamber 41. A hollow cylindrical boss portion 419 is provided to project leftward from the tank portion base plate 310 in the first chamber 41. The communication opening 43 is provided to penetrate through this boss portion 419 in the lateral direction. The first chamber 41 is a chamber in which a decompression process and the like are not performed and to which the pressure $P=\rho gh$ by the water head difference is applied in addition to the atmospheric pressure. If the ink flows into the first chamber 41 from the inflow portion 412, the ink starts being pooled successively in the bypass communication chamber 413 and the return communication chamber 414. If the ink liquid level exceeds the communication opening 43, a state is entered where the ink can be supplied to the second chamber 42 through the communication opening 43. Further, if the pump 9 is operated, the ink stored in the first chamber 41 is sucked through the bypass upstream pipe BP1 and the pressurized ink is supplied toward the head unit 21 through the bypass downstream pipe BP2 and the downstream pipe 34.

Mainly with reference to FIGS. 12A to 12C and 13, the second chamber 42 has a circular shape in a right side view. The aforementioned pressing member 5 and on-off valve 6 and the biasing spring 45 and a lever member 46 to be described later are mounted into this second chamber 42. FIG. 12A shows a state where these four members are mounted in the second chamber 42, FIG. 12B shows a state where the pressing member 5 is removed, and FIG. 12C shows a state where the on-off valve 6 and the biasing spring 45 are further removed.

The second chamber 42 is defined by a second partition wall 421 projecting rightward from the tank portion base plate 310. The second partition wall 421 is a wall having a hollow cylindrical shape. The second chamber 42 is positioned to face the first chamber 41 located on the left side across the tank portion base plate 310. The aforementioned spring seat 417 is recessed in the tank portion base plate 310 at a center position of a region surrounded by the hollow cylindrical second partition wall 421, i.e. at a position concentric with the second partition wall 421. The biasing spring 45 is housed in a recess of this spring seat 417. The communication opening 43 is arranged on the spring seat 417 on a vertical line passing through a center point of the spring seat 417.

The lever member 46 for venting air in the second chamber 42 is arranged on the side of an upper end part 422 of the second chamber 42. The second partition wall 421 is perforated with a supply hole 42H in a lower end part 423 (lowermost part of the second chamber 42). The upstream end 341 of the downstream pipe 34 communicates with this supply hole 42H via the backflow prevention mechanism 38. The second chamber 42, the backflow prevention mechanism 38 and the downstream pipe 34 are so vertically arranged that the backflow prevention mechanism 38 is located below the second chamber 42 in correspondence with the supply hole 42H and the joint part a of the downstream pipe 34 and the downstream end of the bypass pipe 32P (bypass downstream pipe BP2) is located below the backflow prevention mechanism 38. The ink stored in the second chamber 42 is supplied to the downstream pipe 34 through the supply hole 42H and the backflow prevention mechanism 38 by being sucked to the ink discharging portion 22. The backflow prevention mechanism 38 is described in detail later.

A pair of front and rear supporting plates 424 project rightward from the tank portion base plate 310 near the lower end part 423. Each of the pair of supporting plates 424 includes a pivotally supporting portion 425 for pivotally supporting the pressing member 5 to be described later. The aforementioned lower communication hole 41A is perforated in the tank portion base plate 310 at a position in front of and adjacent to the front supporting plate 424. Further, the upper communication hole 41B is perforated in the tank portion base plate 310 near the upper end part 422.

A boss portion 426 and holding frames 427 project upward on the upper end part 422 of the second chamber 42. The boss portion 426 is a tubular body extending vertically upward, and internally includes a boss hole 42A (FIG. 22A), which is an opening allowing communication between the second chamber 42 and the atmosphere. The holding frames 427 are composed of a pair of frame pieces arranged to sandwich the boss portion 426 in the front-rear direction. Locking claws 428 bent in directions toward each other are provided on the upper ends of the holding frames 427. The boss portion 426 and the holding frames 427 constitute a part of the air vent mechanism 37, and the lever member 46 (FIG. 20A) to be described in detail later is mounted.

With reference to FIG. 11, the filter chamber 44 is arranged upstream of the first chamber 41 in the ink supply direction. The filter chamber 44 constitutes, together with the upstream pipe 33, a path for supplying the ink from the ink cartridge IC to the first chamber 41. The filter chamber 44 has an inner wall surface 441 defining a space in the form of a rectangular tube having a rectangular cross-sectional shape in the lateral direction and extending in the ink supply direction. Although described in detail later (FIG. 19A), the filter chamber 44 is a space for housing a filter member 442 for removing foreign matters in the ink, a holding member 443 for this filter member 442, a coil spring 446 for fixing the filter member 442 and the like. An inflow opening 44H for the ink (FIG. 19B) is perforated in a top wall of the filter chamber 44. An inflow port 447 (FIG. 25) formed of a receiving plug stands on the top wall in correspondence with the inflow opening 44H. The downstream end 332 of the upstream pipe 33 is inserted and connected to the inflow port 447.

With reference to FIGS. 10A, 10B and 13, an opening in the left surface side of the first chamber 41 is sealed by the sealing film 7A made of resin. The sealing film 7A has such an outer shape as to be able to cover not only the first chamber 41, but also the bypass communication chamber 413, the return communication chamber 414, the lower monitor communication chamber 415, the upper monitor communication chamber 416 and the filter chamber 44. The sealing film 7A seals the openings of the respective chambers by having a peripheral edge part welded or adhered to opening end surfaces of the first partition wall 411 and the other walls.

An opening in the right surface side of the second chamber 42 is sealed by the atmospheric pressure detection film 7 formed of a flexible film member made of resin. The atmospheric pressure detection film 7 has a circular outer shape matching a wall shape of the second partition wall 421 of the second chamber 42 in a right side view. The atmospheric pressure detection film 7 seals the opening of the second chamber 42 by having a peripheral edge part thereof welded or adhered to an opening end surface of the second partition wall 421. Note that the atmospheric pressure detection film 7 is welded or adhered without particular tension being applied thereto.

The pump portion 32 is arranged obliquely behind and adjacent to the tank portion 31 and includes a pump cavity 321 for housing the pump 9 and a cam shaft insertion hole 322 into which a cam shaft 93 (FIG. 4) for pivotally supporting an eccentric cam 91 (FIG. 25) of the pump 9 is inserted. The pump cavity 321 is a hollow cylindrical cavity arranged in the pump portion housing 320. The cam shaft insertion hole 322 is a boss hole provided at a position concentric with the pump cavity 321. An opening in a right surface side of the pump cavity 321 is sealed by a pump cover 323 (FIG. 10B). Two positioning pins 391 project on the rear surface of the pump portion housing 320 and a rib 392 project on the lower surface of the pump portion housing 320. These positioning pins 391 and rib 392 function as positioning members when the liquid supply unit 3 is mounted into the carriage 2.

In the liquid supply unit 3 of this embodiment, the tank portion 31 and the pump portion 32 are integrally formed. Specifically, the tank portion base plate 310 serving as the board of the tank portion 31 and the pump portion housing 320 provided with the pump cavity 321 are integrated, and the pump 9 for pressurized purging is mounted in the liquid supply unit 3 itself. In this way, the device configuration of the carriage 2 can be made compact and simple.

[Details of Negative Pressure Supply Mechanism]

Next, a negative pressure supply mechanism for supplying the ink from the first chamber 41 to the second chamber 42 as the ink in the second chamber 42 decreases is described in detail. The negative pressure supply mechanism includes the pressing member 5, the on-off valve 6 and the atmospheric pressure detection film 7 whose operations are summarily described above on the basis of FIG. 7 and further includes the biasing spring 45 (first biasing member). The on-off valve 6 is arranged in the communication opening 43 and the posture thereof changes between the closing posture for closing the communication opening 43 and the opening posture for opening the communication opening 43. The biasing spring 45 biases the on-off valve 6 in a direction toward the closing posture. The pressing member 5 can press the on-off valve 6 in a direction toward the opening posture. The atmospheric pressure detection film 7 is displaced based on a negative pressure generated as the ink in the second chamber 42 decreases, and transmits that displacement force to the pressing member 5.

<Pressing Member>

Figure 14A:
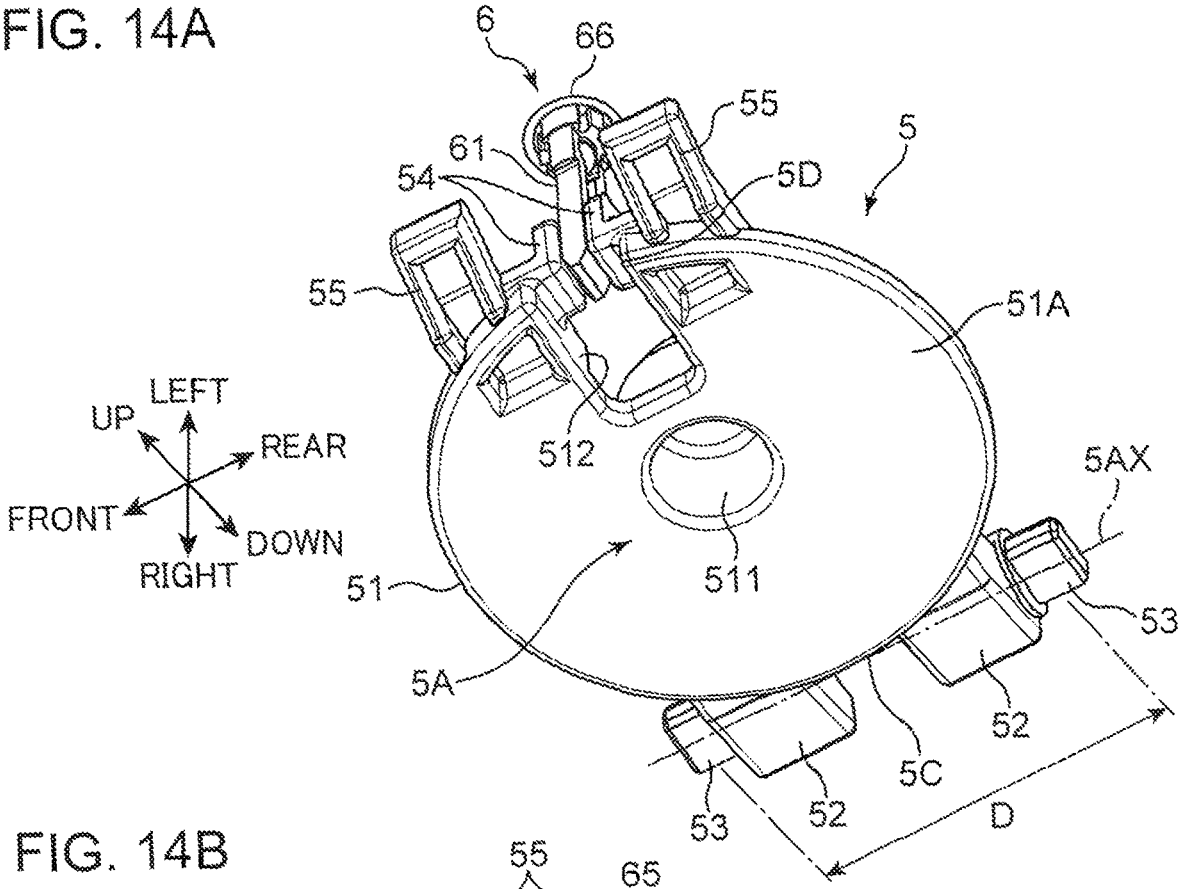
FIG. 14A is a perspective view of a pressing member and FIG. 14B is a perspective view of the pressing member viewed in a different direction.
Figure 14B:
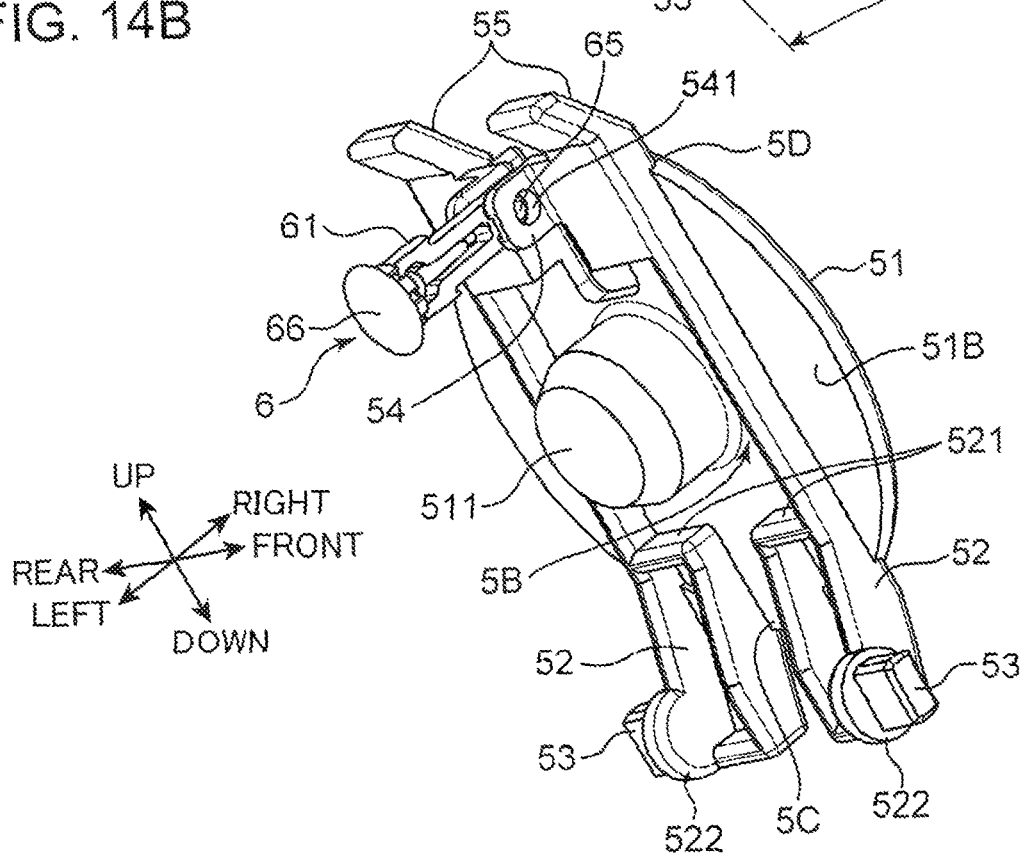

FIGS. 14A and 14B are perspective views of the pressing member 5 viewed in different directions, wherein the on-off valve 6 is also shown. The pressing member 5 is a member rotatably arranged in the second chamber 42. The pressing member 5 includes a disk portion 51 formed of a circular flat plate, a pair of arm portions 52 extending downward from a lower end side 5C of the disk portion 51, pivot portions 53 provided on extending tip parts (lower end parts) of the respective arm portions 52, a pair of link bosses 54 (pressing portion) arranged on an upper end side 5D of the disk portion 51 and receiving slopes 55 configured to interfere with the lever member 46. The pair of pivot portions 53 are pivotally supported by the pivotally supporting portions 425 (FIG. 12) of the pair of supporting plates 424 arranged in the second chamber 42. In this way, the disk portion 51 is rotatable about an axis of the pivot portions 53.

The disk portion 51 is a disk having a diameter, which is about half the inner diameter of the hollow cylindrical second partition wall 421 defining the second chamber 42. The second partition wall 421 and the disk portion 51 in a state pivotally supported by the pivotally supporting portions 425 are substantially concentrically arranged. The disk portion 51 has a first surface 51A facing the atmospheric pressure detection film 7 and a second surface 51B facing the on-off valve 6 (facing the tank portion base plate 310). A spring fitting projection 511 is provided to project from the second surface 51B in a radial center of the disk portion 51. A right end part of the biasing spring 45 formed of a coil spring is fit to the spring fitting projection 511 on the side of the second surface 51B. Note that a region of the spring fitting projection 511 is formed into a cylindrical recess on the side of the first surface 51A.

The disk portion 51 includes a pressure receiving portion 5A for receiving a displacement force from the atmospheric pressure detection film 7 and a biased portion 5B for receiving a biasing force from the biasing spring 45. The pressure receiving portion 5A is set at a predetermined position of the first surface 51A of the disk portion 51. In this embodiment, the pressure receiving portion 5A is a region of a peripheral edge part of the spring fitting projection 511 on the first surface 51A. The biased portion 5B is a region of the spring fitting projection 511, which is on the side of the second surface 51B and to which the biasing spring 45 is fit. Specifically, the biased portion 5B is set at a position corresponding to the pressure receiving portion 5A.

If the pressure receiving portion 5A receives no displacement force from the atmospheric pressure detection film 7, the disk portion 51 is in a state close to an upright state. However, the right end of the biasing spring 45 is in contact with the biased portion 5B and the first surface 51A is in contact with the inner surface of the atmospheric pressure detection film 7 by that biasing force. On the other hand, if the pressure receiving portion 5A receives a displacement force equal to or larger than the biasing force of the biasing spring 45 from the atmospheric pressure detection film 7, the disk portion 51 rotates leftward about the axis of pivot portions 53 and is inclined leftward from the upright state.

The pair of arm portions 52 are arranged apart from each other in the front-rear direction on the lower end side 5C of the disk portion 51. Upper end parts 521 of the pair of arm portions 52 extend further upward than the lower end side 5C of the disk portion 51 and are respectively located below both lateral parts of the spring fitting projection 511. Tip parts 522 of the pair of arm portions 52 respectively extend straight downward from the lower end side 5C. The respective pivot portions 53 project in the front-rear direction from the tip parts 522. In particular, the pair of pivot portion 53 project in directions away from each other such that the pivot portion 53 projects forward from the front surface of the front tip part 522 and the pivot portion 53 projects rearward from the rear surface of the rear tip part 522. The pivot portions 53 are fit into the pivotally supporting portions 425 of the supporting plates 424. It contributes to increasing a swing width of the upper end side 5D of the disk portion 51 when the pressing member 5 rotates about the pivot portions 53 to provide the pivot portions 53 on the tip parts 522 of the arm portions 52.

The pair of pivot portions 53 are arranged on an axis of rotation 5AX extending in the front-rear direction. The front and rear pivot portions 53 are arranged at a predetermined distance D from each other. That is, the pair of pivot portions 53 are arranged apart from each other across a part equivalent to a central region in a plane direction of the disk portion 51. The distance D can be set to about 40% to 90% of a diameter of the disk portion 51. In this way, pivot points formed by the pair of pivot portions 53 are pivot points spaced wide apart to sandwich the central region of the disk portion 51. Thus, the disk portion 51 rotating about the pivot points is less likely to be twisted about an axis perpendicular to the axis of rotation 5AX. Therefore, the rotating operation of the disk portion 51 can be stabilized.

The pair of link bosses 54 project leftward from the second surface 51B near the upper end side 5D of the disk portion 51. In particular, the disk portion 51 is provided with a cutout portion 512 extending radially inward with the upper end side 5D serving as an opening edge, and the link bosses 54 formed of rectangular flat plates respectively stand from front and rear end edges facing a space of the cutout portion 512. Each link boss 54 includes a link hole 541. This link hole 541 is used to link and connect the pressing member 5 and the on-off valve 6. By this link connection, opening and closing operations of the on-off valve 6 are linked with the rotating operation of the pressing member 5.

In other words, the link bosses 54 serve as pressing portions for pressing and moving the on-off valve 6 in the lateral direction according to the rotating operation of the pressing member 5 rotating about the axis of the pivot portions 53. The pair of link bosses 54 are arranged on the upper end side 5D spaced apart a predetermined distance from the pair of pivot portions 53 arranged on the lower end side 5C. That is, the link bosses 54 serving as the pressing portions are arranged at extremely opposite positions on the disk portion 51 with respect to the pivot portions 53 forming pivot points. Thus, movement amounts of the link bosses 54 and a movement amount of the on-off valve 6 link-connected to the link bosses 54 during the rotation of the pressing member 5 can be increased.

In a relationship of the pressure receiving portion 5A or the biased portion 5B (point of force application) and the pivot portions 53 (fulcrum), the link bosses 54 (point of action) are arranged at positions more distant from the pivot portions 53 than the pressure receiving portion 5A and the biased portion 5B. In other words, the link bosses 54 are arranged on the upper end side 5D of the disk portion 51 to face the pivot portions 53 across the pressure receiving portion 5A and the biased portion 5B. By adopting such an arrangement, a movement force received by the pressure receiving portion 5A or the biased portion 5B can be applied to the link bosses 54 while being amplified by separation distances from these.

<On-Off Valve>

Next, the on-off valve 6 is described. The on-off valve 6 is arranged in the communication opening 43 allowing communication between the first chamber 41 and the second chamber 42. The on-off valve 6 opens and closes the communication opening 43 by moving in the lateral direction in the communication opening 43, following the rotating operation of the pressing member 5 about the pivot portions 53. The on-off valve 6 is link-connected to the link bosses 54 of the disk portion 51 to follow the above rotating operation.

Figure 15A:
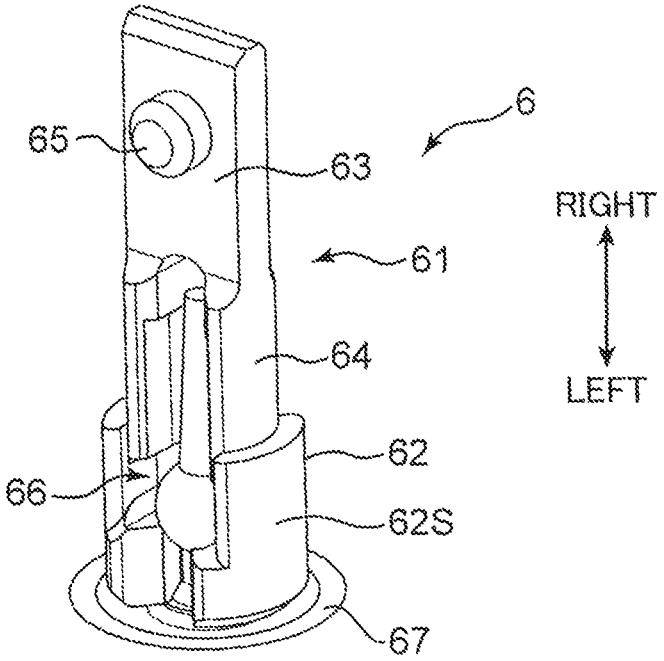
FIG. 15A is a perspective view of an on-off valve and FIG. 15B is an exploded perspective view of the on-off valve.
Figure 15B:
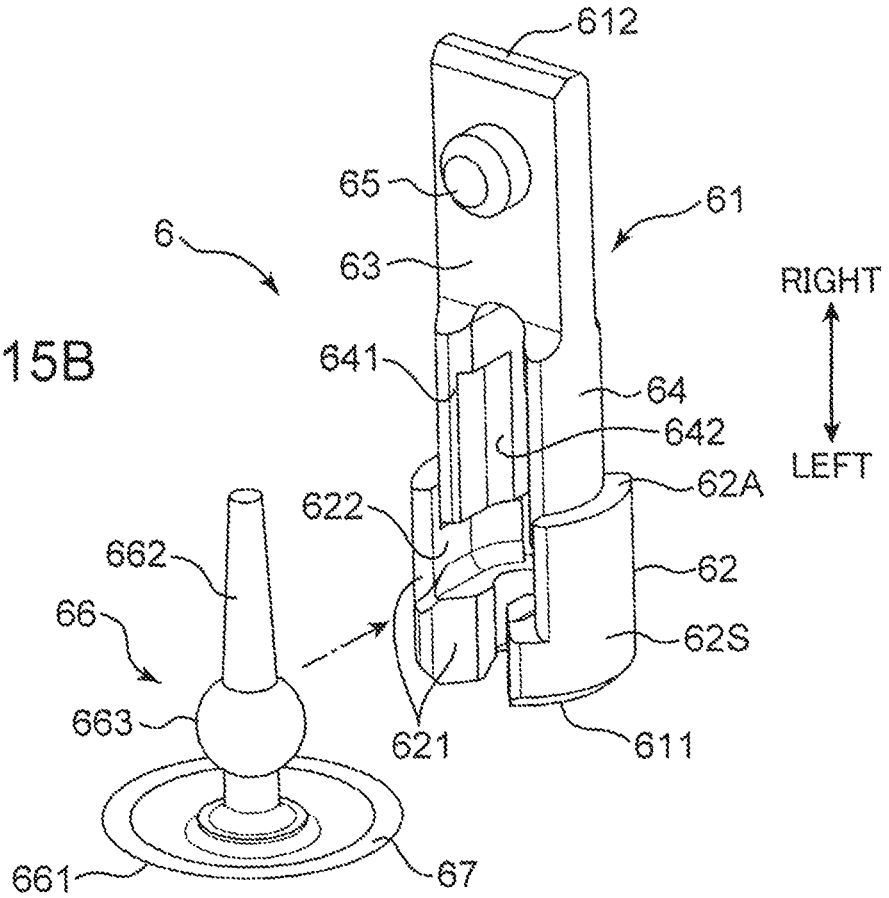
Figure 16A:
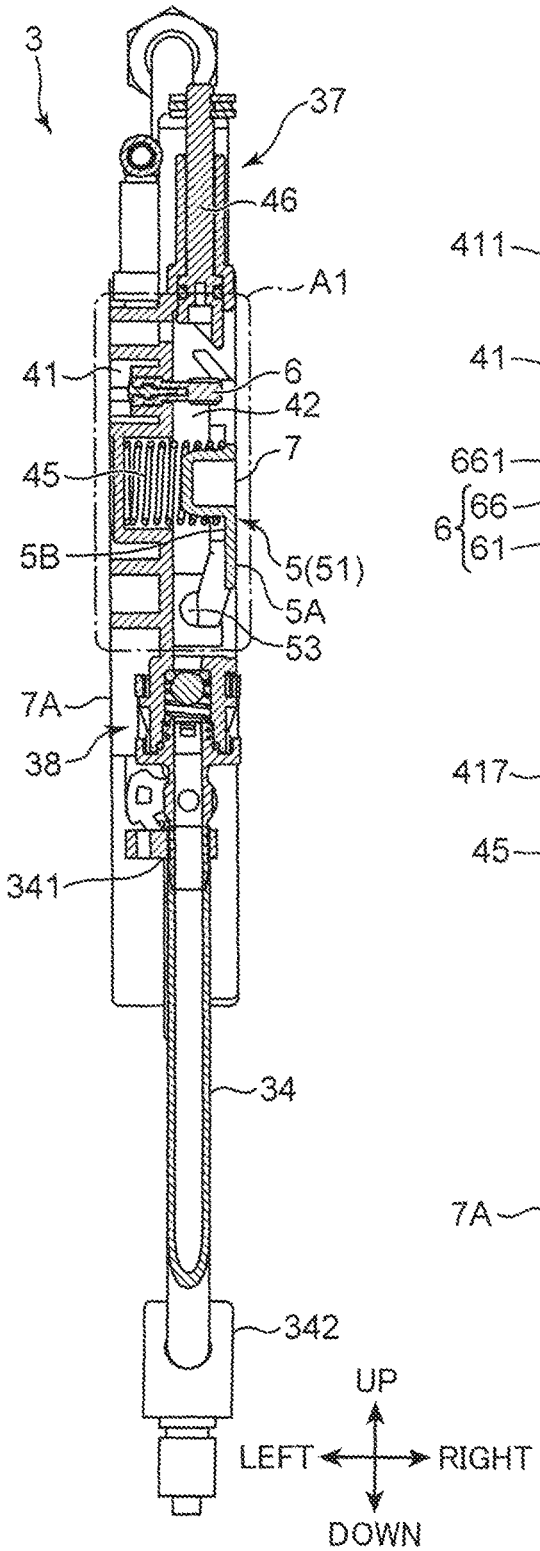
FIG. 16A is a sectional view along line XVI-XVI of FIG. 10A showing a state where the on-off valve is in a closing posture and FIG. 16B is an enlarged view of a part A1 of FIG. 16A.
Figure 16B:
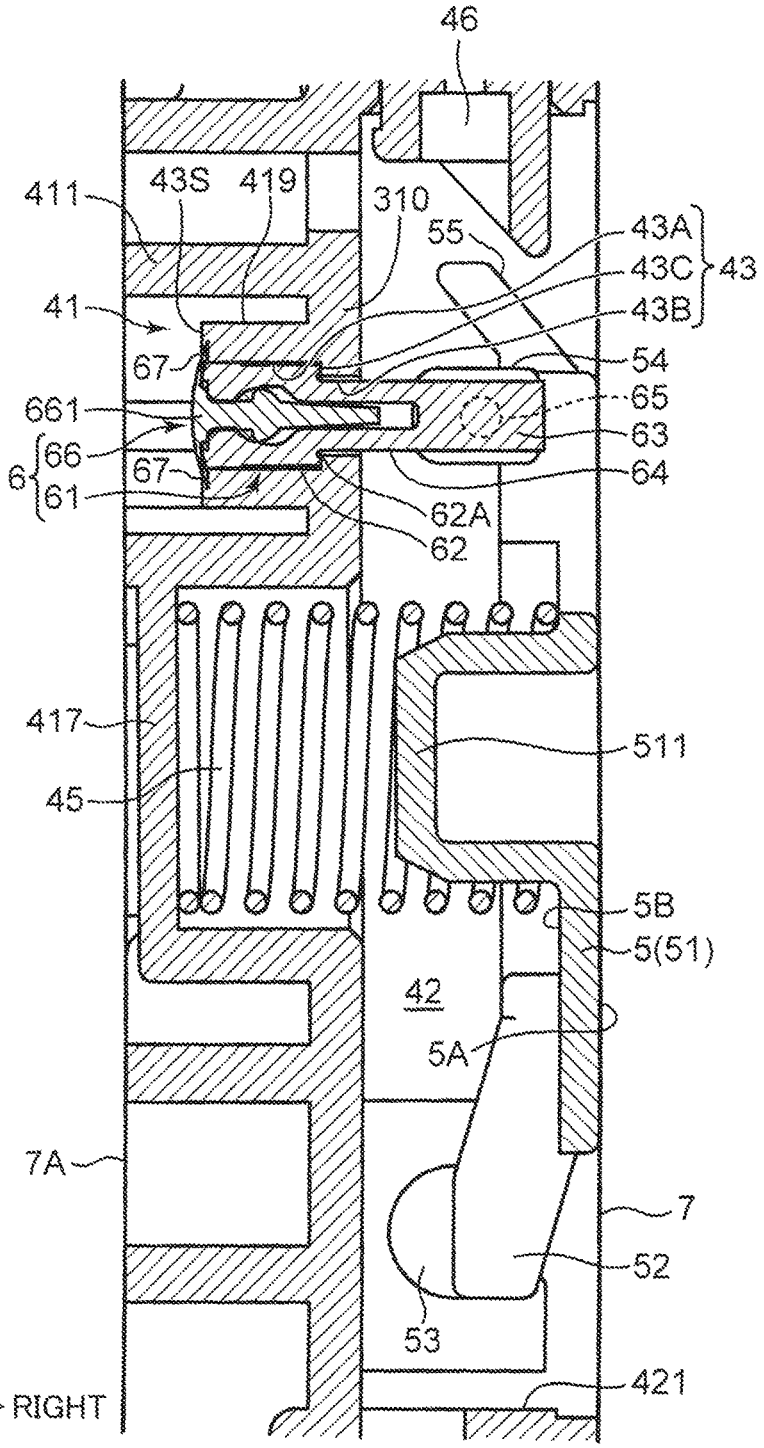

FIG. 15A is a perspective view of the on-off valve 6 and FIG. 15B is an exploded perspective view of the on-off valve 6. FIG. 16A is a sectional view along line XIV-XIV of FIG. 10A and FIG. 16B is an enlarged view of a part A1 of FIG. 16A. The on-off valve 6 is an assembly of a valve holder 61 and an umbrella valve 66 held by the valve holder 61. The communication opening 43 is a hollow cylindrical hole penetrating through the tank portion base plate 310 and the boss portion 419 and includes a large-diameter portion 43A, a small-diameter portion 43B having a smaller inner diameter than the large-diameter portion 43A and a step portion 43C based on a diameter difference between the both.

The valve holder 61 is a semi-cylindrical member including a first end part 611 located on the side of the first chamber 41 (left side) and a second end part 612 located on the side of the second chamber 42 (right side) in a state mounted in the communication opening 43. The valve holder 61 includes a tube portion 62 on the side of the first end part 611, a flat plate portion 63 on the side of the second end part 612, an intermediate portion 64 located between the tube portion 62 and the flat plate portion 63, and link pins 65 disposed on the flat plate portion 63. The umbrella valve 66 is held on the side of the first end part 611 of the valve holder 61.

The tube portion 62 is a tubular part having a largest outer diameter in the valve holder 61. The tube portion 62 includes a guide surface 62S, which is the outer peripheral surface of the tube portion 62, a flow passage cutout 621 formed by cutting a part of the tube portion 62 in a circumferential direction, and a holding groove 622 annularly recessed on an inner peripheral side of the tube portion 62. The tube portion 62 is housed into the large-diameter portion 43A of the communication opening 43, and the guide surface 62S is guided by the inner surface of the large-diameter portion 43A when the on-off valve 6 moves in the lateral direction. The flow passage cutout 621 serves as a flow passage in which the ink flows when the on-off valve 6 is in the opening posture. The holding groove 622 is a groove for holding a locking spherical portion 663 of the umbrella valve 66.

The intermediate portion 64 is a tubular part having a smaller outer diameter than the tube portion 62. The intermediate portion 64 includes an open portion 641, which is an open part connected to the flow passage cutout 621, and a pin housing portion 642 for housing a pin portion 662 of the umbrella valve 66. The intermediate portion 64 is housed in the small-diameter portion 43B of the communication opening 43 and the outer peripheral surface thereof is also guided by the inner surface of the small-diameter portion 43B. On a boundary part between the tube portion 62 and the intermediate portion 64, an annular contact portion 62A formed by a step based on an outer diameter difference between the both is present. The annular contact portion 62A faces and comes into contact with the step portion 43C of the communication opening 43.

The flat plate portion 63 is a part projecting rightward from the communication opening 43 with the on-off valve 6 mounted in the communication opening 43. The flat plate portion 63 has a pair of front and back flat surfaces extending in the lateral direction. The link pins 65 respectively project in the vertical direction from the pair of flat surfaces. These link pins 65 are fit into the link holes 541 provided in the link bosses 54 of the pressing member 5 as shown in FIG. 14B. By this fitting, the pressing member 5 and the on-off valve 6 can be link-connected and translate a rotational motion of the pressing member 5 into a linear motion of the on-off valve 6.

The umbrella valve 66 is an article made of rubber and includes an umbrella portion 661, the pin portion 662 extending rightward from the umbrella portion 661 and the locking spherical portion 663 integrally provided to the pin portion 662. The umbrella portion 661 has an umbrella diameter larger than an inner diameter of the large-diameter portion 43A of the communication opening 43. A peripheral edge part on an inner side (right surface side) of the umbrella portion 661 is a sealing surface 67. The sealing surface 67 can seal the communication opening 43 by coming into contact with a sealing wall surface 43S, which is a wall surface around the communication opening 43 and a projecting end surface of the boss portion 419 (closing posture). On the other hand, if the sealing surface 67 is separated from the sealing wall surface 43S, the sealed state is released (opening posture). Note that the umbrella shape of the umbrella portion 661 is inverted (FIGS. 29A and 29B) if a predetermined pressure is applied to the right surface side of the umbrella portion 661.

The pin portion 662 is a rod-like part extending in the lateral direction and serving as a support column for the umbrella portion 661. The pin portion 662 is inserted into the tube portion 62 of the valve holder 61 and the pin housing portion 642 of the intermediate portion 64. That is, the umbrella portion 661 can come into contact with the first end part 661 of the valve holder 61, whereas the pin portion 662 can be fit into an inner tube portion of the valve holder 61. The locking spherical portion 663 is a part formed by spherically bulging a part of the pin portion 662 near a left end and to be fit into the holding groove 622. By fitting the locking spherical portion 663 into the holding groove 622, the umbrella valve 66 is held in the valve holder 61 with lateral movements restricted. Specifically, the umbrella valve 66 moves in the lateral direction integrally with the valve holder 61.

<Biasing Spring>

The biasing spring 45 is a coil spring interposed between the second surface 51B of the disk portion 51 and the tank portion base plate 310 and supporting (biasing) the second surface 51B. In particular, as shown in FIG. 16B, a right end side of the biasing spring 45 is fit to the spring fitting projection 511 of the disk portion 51, and a left end side thereof is housed in the spring seat 417 recessed in the tank portion base plate 310. When the pressing receiving portion 5A of the disk portion 51 receives a leftward displacement force acting against a rightward biasing force of the biasing spring 45, the disk portion 51 rotates leftward about the axis of the pivot portions 53. Unless receiving the above displacement force, the disk portion 51 is maintained in an upright posture by the biasing force.

<Operation of On-Off Valve>

Next, the opening and closing operations of the on-off valve 6 are described. FIG. 16 show a state where the on-off valve 6 is in the closing posture. This state is a state where the atmospheric pressure detection film 7 is not generating such a displacement force as to rotate the pressing member 5 (disk portion 51), i.e. a state where the sum of a spring pressure (biasing force) of the biasing spring 45 and an inner pressure of the second chamber 42 is larger than the atmospheric pressure. Although the second chamber 42 is set to the negative pressure, the biasing spring 45 biases the biased portion 5B of the disk portion 51 rightward by a biasing force exceeding a displacement force of the atmospheric pressure detection film 7 caused by the negative pressure. Thus, the disk portion 51 does not rotate about the axis of the pivot portions 53 and is maintained in the aforementioned upright posture.

In this case, the on-off valve 6 link-connected to the pressing member 5 by the link bosses 54 is in the closing posture located on a rightmost side. Specifically, the valve holder 61 is pulled rightward via the link bosses 54 by the biasing force of the biasing spring 45. Thus, the annular contact portion 62A of the valve holder 61 butts against the step portion 43C of the communication opening 43 and the sealing surface 67 of the umbrella valve 66 comes into contact with the sealing wall surface 43S. Therefore, the communication opening 43 is sealed by the umbrella valve 66. The biasing spring 45 can be said to indirectly bias the on-off valve 6 in the direction toward the closing posture by biasing the disk portion 51 rightward.

Figure 17A:
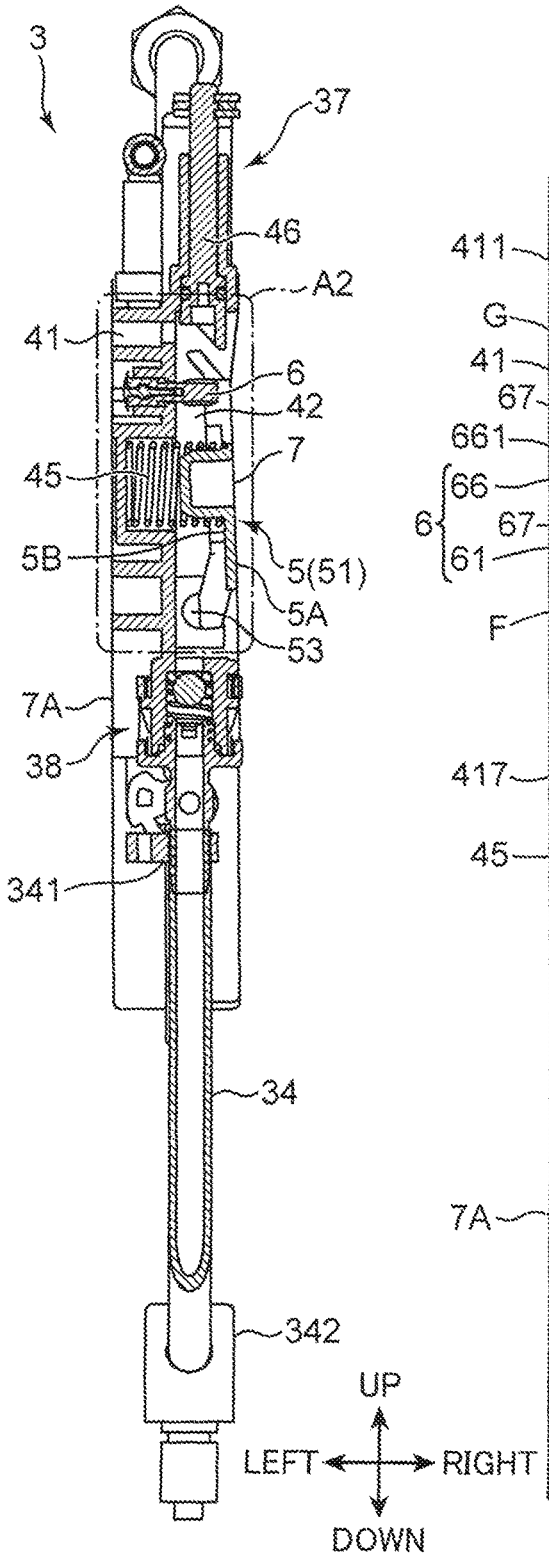
FIG. 17A is a sectional view, corresponding to FIG. 16A, showing a state where the on-off valve is in an opening posture
Figure 17B:
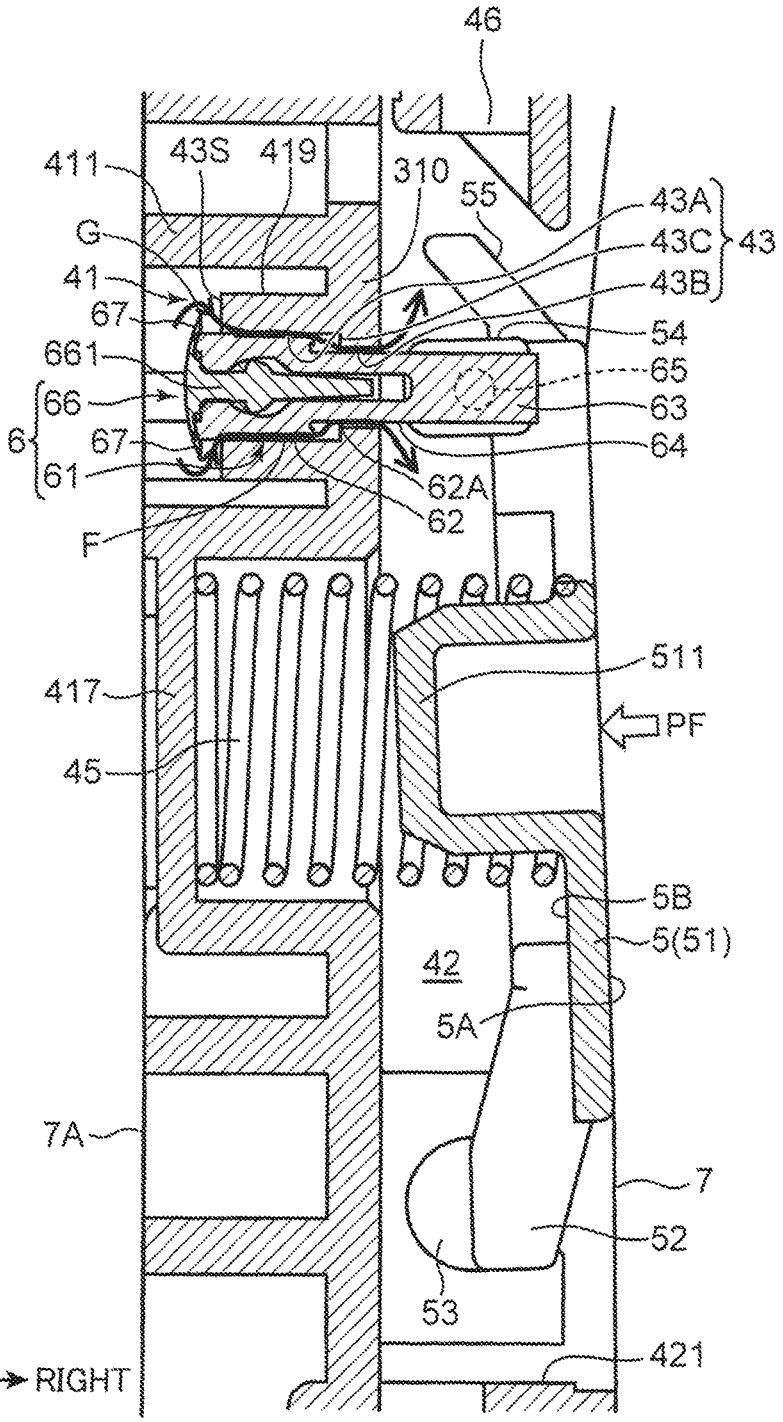
FIG. 17B is an enlarged view of a part A2 of FIG. 17A, FIGS. 18A and 18B are diagrams showing a positional relationship between a pivot point and a pressing portion in the pressing member and the operation of the pressing member.

FIG. 17A is a sectional view, corresponding to FIG. 16A, showing the state where the on-off valve 6 is in the opening posture and FIG. 17B is an enlarged view of a part A2 of FIG. 17A. As the ink discharging portion 22 continues the operation of discharging ink droplets from the state of FIG. 16B, the negative pressure degree of the second chamber 42, which is a sealed space, gradually increases as the ink decreases. Eventually, when the second chamber 42 reaches a negative pressure exceeding the predetermined threshold value, the atmospheric pressure detection film 7 applies a pressing force acting against the biasing force of the biasing spring 45 to the pressure receiving portion 5A of the disk portion 51. Specifically, a state is entered where the sum of the spring pressure of the biasing spring 45 and the inner pressure of the second chamber 42 is less than the atmospheric pressure.

In this case, the disk portion 51 rotates leftward about the axis of the pivot portions 53 against the biasing force of the biasing spring 45. By this rotation, the link bosses 54 generate a pressing force PF to move the on-off valve 6 leftward and changes the posture of the on-off valve 6 to the opening posture. That is, the pressing force is transmitted from the link holes 541 of the link bosses 54 to the link pins 65 of the valve holder 61, and the valve holder 61 linearly moves leftward while the guide surface 62S is guided by the inner surface of the communication opening 43. According to this movement, the umbrella valve 66 also moves leftward and the sealing surface 67 thereof is separated from the sealing wall surface 43S. That is, a gap G is formed between the sealing surface 67 and the sealing wall surface 43S. Thus, the sealing of the communication opening 43 by the umbrella valve 66 is released.

When the on-off valve 6 reaches the opening posture, the ink flows from the first chamber 41 into the second chamber 42 due to a pressure difference between the first chamber 41 set to the pressure, which is the sum of the atmospheric pressure and ρgh, and the second chamber 42 with a progressed negative pressure degree as indicated by an arrow F in FIG. 17B. Specifically, the ink flows into the second chamber 42 through a flow passage composed of the gap G between the sealing surface 67 of the umbrella valve 66 and the sealing wall surface 43S, the flow passage cutout 621 prepared in the tube portion 62 of the valve holder 61 and the open portion 641 prepared in the intermediate portion 64.

As the ink flows into the second chamber 42, the negative pressure degree of the second chamber 42 is gradually alleviated. Eventually, when the sum of the spring pressure of the biasing spring 45 and the inner pressure of the second chamber 42 becomes more than the atmospheric pressure, the disk portion 51 is pushed back rightward by the biasing force of the biasing spring 45. Specifically, when the second chamber 42 reaches a negative pressure below the predetermined threshold value, the disk portion 51 rotates rightward about the axis of the pivot portions 53 by being pressed by the biasing force of the biasing spring 45. In this way, the on-off valve 6 also linearly moves rightward by being pulled by the link bosses 54. At some stage, the annular contact portion 62A of the valve holder 61 butts against the step portion 43C of the communication opening 43 and the sealing surface 67 of the umbrella valve 66 comes into contact with the sealing wall surface 43S. Thus, the on-off valve 6 returns to the closing posture.

<Functions and Effects of Negative Pressure Supply Mechanism>

Figure 18A:
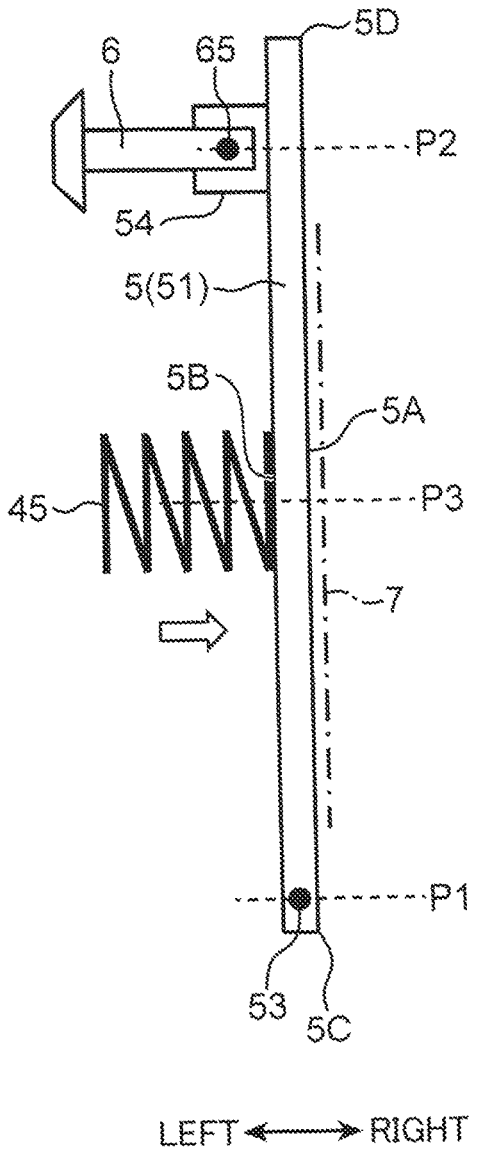
Figure 18B:
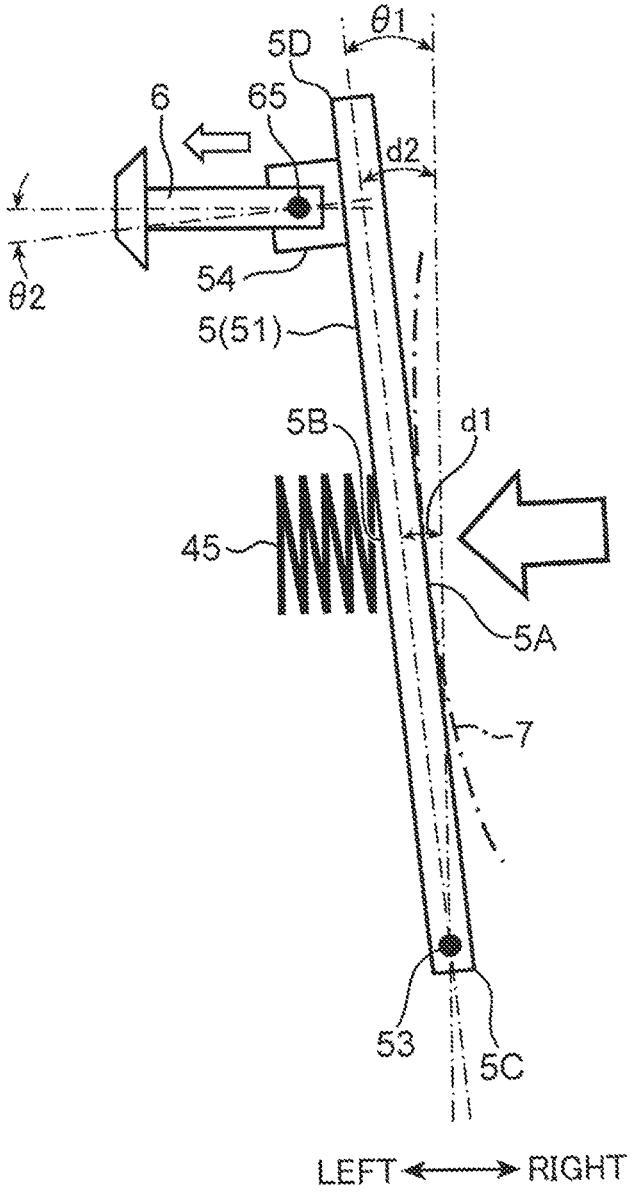

Functions and effects of the negative pressure supply mechanism of this embodiment having the above configuration are described using diagrams of FIGS. 18A and 18B. FIG. 18A shows a state where the pressing member 5 (disk portion 51) is in the hanging posture and the on-off valve 6 is in the closing posture, and FIG. 18B shows a state where the pressing member 5 is rotated to reach an oblique posture and the on-off valve 6 is in the opening posture.

First, the pressing member 5 has pivot points, which are the pivot portions 53, and are pivotally supported by the supporting plates 425 disposed in the second chamber 42. Thus, if the pressure receiving portion 5A receives a displacement force of the atmospheric pressure detection film 7, the pressing member 5 rotates about the axis of the pivot portions 53. That is, an unstable moving force, which is a displacement of the atmospheric pressure detection film 7, can be translated into a stable moving force, which is rotation about the axis of the pivot portions 53. Thus, the displacement force of the atmospheric pressure detection film 7 can be efficiently transmitted to the on-off valve 6 through the link bosses 54 (pressing portions). For example, if a pressing member for the on-off valve 6 does not have any pivot point, such as by being attached to the atmospheric pressure detection film 7, such a behavior becomes unstable and a pressing force is unstably transmitted to the on-off valve 6. However, since the pressing member 5 can generate a stable pressing force according to this embodiment, the posture of the on-off valve 6 can be changed between the closing posture and the opening posture at a desired timing and the ink can be stably supplied to the head unit 21.

Further, the pivot portions 53 are arranged on the lower end side 5C of the pressing member 5, whereas the link bosses 54 are arranged on the upper end side 5D of the pressing member 5 at a predetermined distance from the pivot portions 53. That is, as shown in FIG. 18A, if the pivot points by the pivot portions 53 are a fulcrum P1 and the link bosses 54 for inputting a movement force to the on-off valve 6 are a point of action P2, the point of action P2 is arranged at a position extremely opposite to the fulcrum P1 in the pressing member 5. A point of force application P3 at which a rotational force is applied to the pressing member 5 is, in this embodiment, a position where the pressure receiving portion 5A and the biased portion 5B are arranged, and located between the fulcrum P1 and the point of action P2.

Thus, movement amounts of the link bosses 54 during the rotation of the pressing member 5 can be increased and, consequently, a linear movement amount of the on-off valve 6 in the lateral direction can be increased. It is assumed that a pressing force of the atmospheric pressure detection film 7 is applied to the point of action P2 (pressure receiving portion 5A) and the pressing member 5 rotates by an angle θ1 about the axis of the pivot portions 53 as shown in FIG. 18B. In this case, an actual movement amount of the pressing member 5 at the position of the pressure receiving portion 5A is d1, but a movement amount at the positions of the link bosses 54 (link pins 65) is d2, which is obtained by amplifying d1 by a distance difference of the point of action P2 and the point of force application P3 from the fulcrum P1.

As described with reference to FIGS. 16A to 17B, the on-off valve 6 is not a member for opening and closing the communication opening 43 in dependence on the pressing force, but a member for opening and closing the communication opening 43 by moving in the lateral direction in the communication opening 43. Further, as a leftward movement amount of the on-off valve 6 increases, the gap G becomes larger to reduce inflow resistance of the ink. If the ink in the second chamber 42 is suddenly consumed, a large pressing force is applied from the atmospheric pressure detection film 7, wherefore the movement amount d1 also becomes relatively larger. The on-off valve 6 can be moved leftward by the movement amount d2 obtained by amplifying the movement amount d1. Thus, if the ink is suddenly consumed, the on-off valve 6 can be largely moved and a relatively large amount of the ink can be flowed into the second chamber 42.

In contrast, if the ink in the second chamber 42 is moderately consumed, the pressing force applied from the atmospheric pressure detection film 7 becomes smaller, wherefore the movement amount d1 becomes relatively smaller. Even with such a small movement amount d1, the movement amount d2 is amplified at the positions of the link bosses 54. Thus, the on-off valve 6 can be accordingly moved leftward. Therefore, even if the ink is moderately consumed, the on-off valve 6 can be timely moved with high sensitivity. As just described, the stable supply of the ink from the liquid supply unit 3 to the head unit 21 can be ensured both when a large amount of the ink is discharged from the head unit 21 and a small amount of the ink is discharged from the head unit 21.

Further, an advantage by link-connecting the on-off valve 6 to the pressing member 5 can be cited as an advantage of another perspective. In particular, link connection is formed by the link pins 65 disposed near the right end of the on-off valve 6 and the link holes 541 of the link bosses 54. The biasing spring 45 biases the on-off valve 6 in the direction toward the closing posture by pressing the biased portion 5B of the disk portion 51. Thus, the pressing member 5 (disk portion 51) is inclined leftward by an angle of rotation θ1 as shown in FIG. 18B because of rotation about the axis of the pivot portions 53. However, the on-off valve 6 is not inclined, following the inclination of the disk portion 51, due to the link connection. That is, the on-off valve 6 can rotate about the link pins 54 by an angle of rotation θ2 corresponding to the angle of rotation θ1 and be maintained in a horizontal posture. Therefore, the on-off valve 6 can be linearly moved in the lateral direction in the communication opening 43 and stably operated between the closing posture and the opening posture.

[Details of Filter Chamber]

Figure 19A:
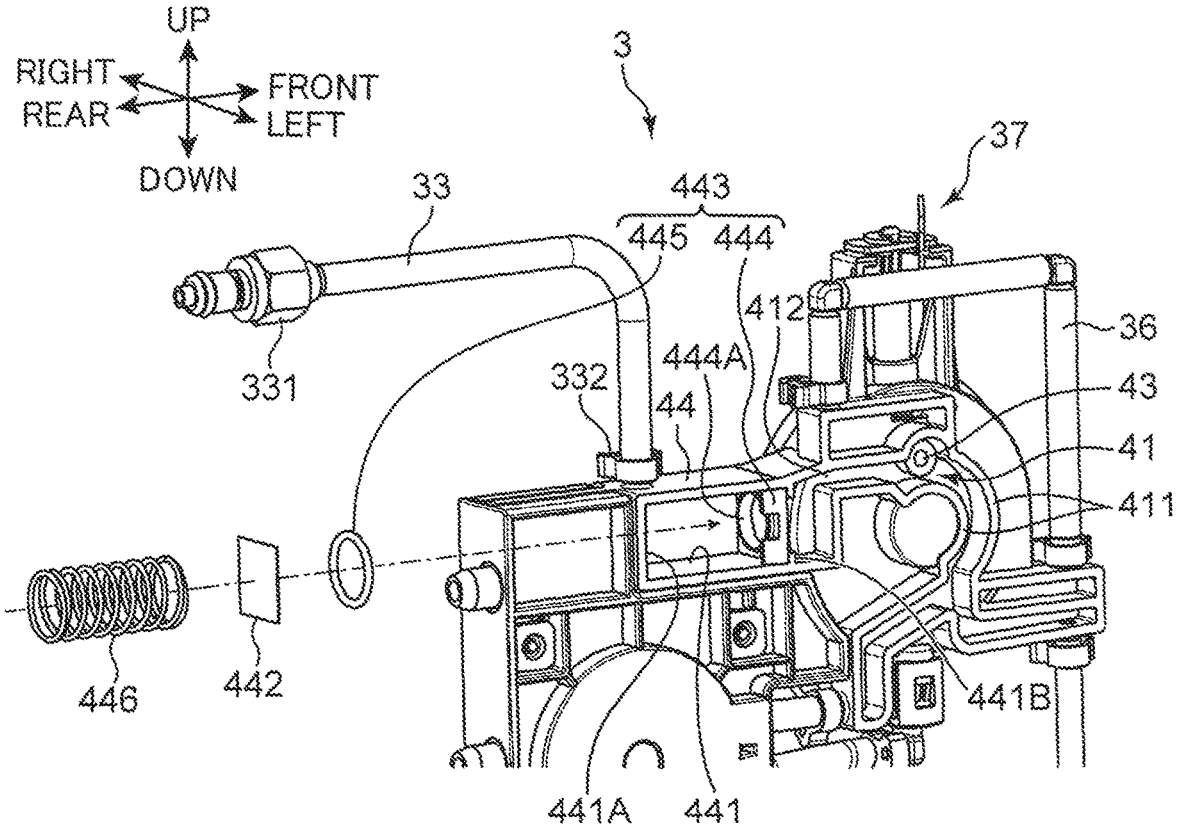
FIG. 19A is an exploded perspective view of a filter chamber and FIG. 19B is a sectional view of the filter chamber along the front-rear direction.
Figure 19B:
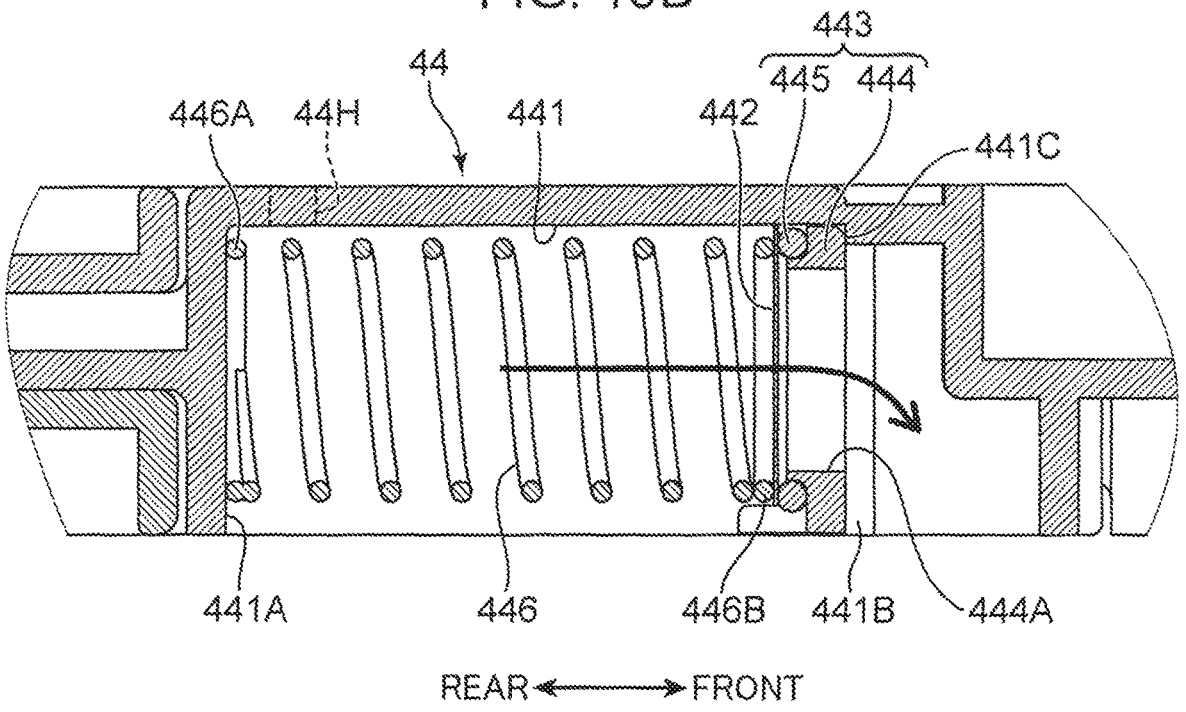

Next, the configuration of the filter chamber 44 is described in detail. FIG. 19A is an exploded perspective view of the filter chamber 44 and FIG. 19B is a sectional view of the filter chamber 44 along the front-rear direction. As described above, the filter chamber 44 has the inner wall surface 441 defining a rectangular tubular space, and the filter member 442, the holding member 443 and the coil spring 446 are housed in that space.

The filter member 442 is a filtering member for removing foreign matters contained in the ink. The foreign matters here are, for example, hair dust and aggregates of the ink liquid. In this embodiment, the ink flows from the first chamber 41 into the second chamber 42 through the communication opening 43 having the on-off valve 6 arranged therein. A negative pressure operation of the pressing member 5 in the second chamber 42 is realized by the on-off valve 6 sealing the communication opening 43. If the ink containing foreign matters is supplied in such an environment, the negative pressure operation can be impeded. In particular, if the foreign matters are jammed by the on-off valve 6, there is a problem that a movement of the on-off valve 6 in the lateral direction is hindered and the second chamber 42 cannot be maintained at the negative pressure. If the foreign matters enter the head unit 21 downstream of the second chamber 42, it is difficult to remove the foreign matters and the ink discharging operation is impeded. The filter member 442 is arranged to prevent an operation failure due to the mixing of such foreign matters.

Various filtering members can be used as the filter member 442 as long as the ink liquid can be passed while the above foreign matters can be trapped. For example, woven and nonwoven fabric filters, sponge filters, mesh filters and the like can be used as the filter member 442. In this embodiment, the filter member 442 formed of a sheet-like member rectangular in a plan view is used. The filter member 412 is set to have substantially the same size as a cross-section of the inner wall surface 441 of the filter member 44 in the lateral direction.

The filter chamber 44 includes an upstream end 441A on an upstream side in the ink supply direction, and a downstream end 441B on a downstream side. The inflow opening 44H is perforated in a top wall of the filter chamber 44 on the side of the upstream end 441A. The inflow port 447 (FIG. 25) stands right above the inflow opening 44H, and the downstream end 332 of the upstream pipe 33 is inserted and connected to the inflow port 447. Thus, the ink supplied from the ink cartridge IC flows toward the upstream end 441A of the filter chamber 44 through the inflow opening 44H. The downstream end 441B communicates with the inflow portion 412, which is the upstream end of the first chamber 41.

The filter member 442 is arranged near the downstream end 441B in this embodiment. Since the jamming of foreign matters by the on-off valve 6 is problematic as described above, the filter member 442 may be arranged upstream of the on-off valve 6. Specifically, the filter member 442 may be arranged at any position of the ink supply path between the ink cartridge IC and the first chamber 41 or at a position upstream of the on-off valve 6 in the first chamber 41. By such an arrangement, the foreign matters are trapped by the filter member 442 before reaching the communication opening 43 or the second chamber 42. Thus, the problem that the foreign matters are jammed by the on-off valve 6 or reach from the second chamber 42 to the head unit 21 can be prevented, and an operation failure of the liquid supply unit 3 due to the mixing of the foreign matters can be prevented.

A structure for holding the filter member 442 is described. As shown in FIG. 19B, the filter member 442 is held (fixed) by being pressed against the holding member 443 by the coil spring 446. A peripheral edge part of the filter member 442 is fixed to the holding member 443. The ink passes through a central area of the filter member 442 excluding the peripheral edge part and foreign matters are trapped at that time (see an arrow in FIG. 19B).

The holding member 443 is arranged near the downstream end 441B in the filter chamber 44, and includes a frame member 444 having an opening 444A serving as a flow passage for the ink and a ring-shaped sealing member 445 supported by the frame member 444. A molded article made of hard resin can be used as the frame member 444, and a molded article made of soft resin or rubber can be used as the sealing member 445. The sealing member 445 is fit into a seat portion provided on the rear surface of the frame member 444. The filter member 442 is in contact with a rear surface side of the sealing member 445. The front surface of the frame member 444 is engaged with a step portion 441C formed on the downstream end 441B of the inner wall surface 441.

The coil spring 446 presses the peripheral edge part of the filter member 442 against the rear surface of the coil spring 445. The coil spring 446 is housed in the filter chamber 44 such that a coil axis extends along the ink supply direction (front-rear direction). In particular, the coil spring 446 is mounted in the filter chamber 44 such that a rear end 446A of the coil spring 446 is locked on the upstream end 441A of the inner wall surface 441 and a front end 446B presses the peripheral edge part of the filter member 442 toward the sealing member 445.

According to the above structure of the filter chamber 44, an opening 444A of the frame member 444 for holding the ring-shaped sealing member 445 is closed by the filter member 442. Thus, the foreign matters in the ink can be reliably trapped by the filter member 442. Further, the filter member 442 and the holding member 443 can be fixed by a pressing force of the coil spring 446 without using adhesive or the like. During the operation of the liquid supply unit 3, the filter member 442 is exposed to the liquid and the peripheral edge part thereof serving as a fixing portion to the holding member 443 is also immersed in the ink. This ink can become solvent such as the adhesive. Thus, if the filter member 442 is fixed using adhesive or the like, the filter member 442 may be peeled off from the holding member 443 or the adhesive melts into the ink to become foreign matters. Such a trouble can be solved according to this embodiment using the pressing force of the coil spring 446. Further, by providing the filter chamber 44 as an exclusive chamber for ink filtering, the assimilability of the filter member 442 into the liquid supply unit 3 can be improved and a filter function can be reliably exhibited.

[Air Vent Mechanism of Second Chamber]

Figure 20A:
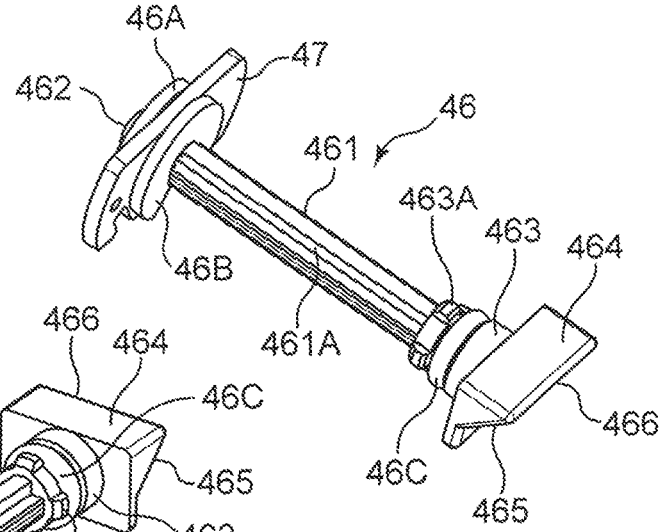
FIGS. 20A and 20B are perspective views of a lever member and FIG. 20C is an exploded perspective view of the lever member.
Figure 20B:
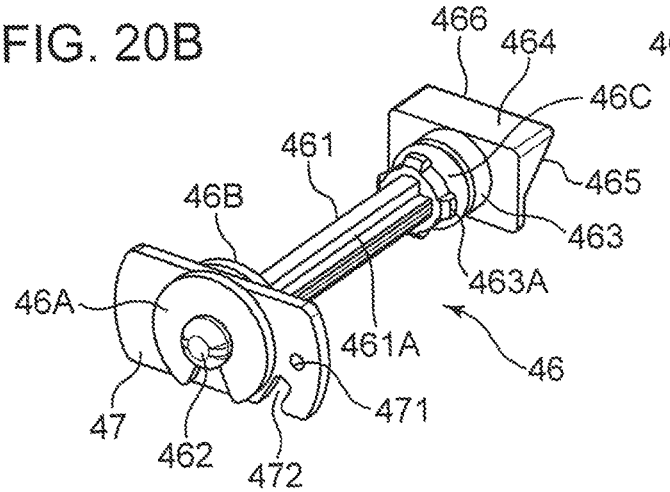
Figure 20C:
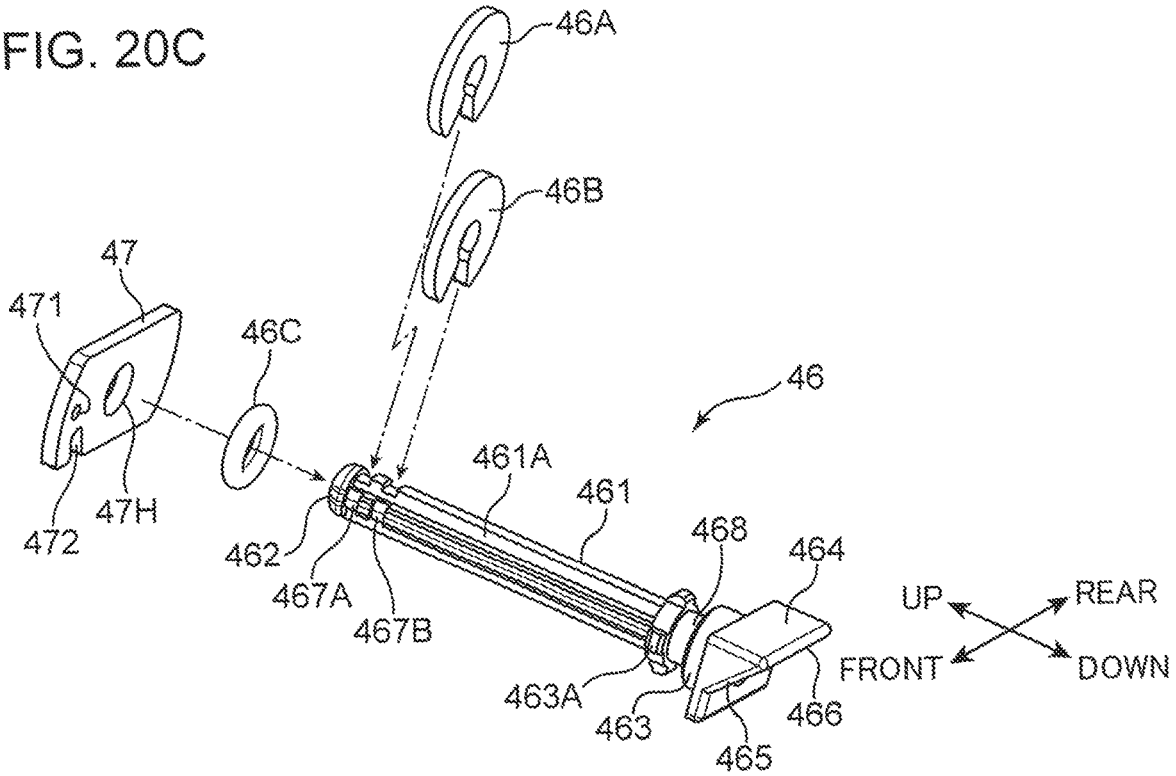
Figure 21A:
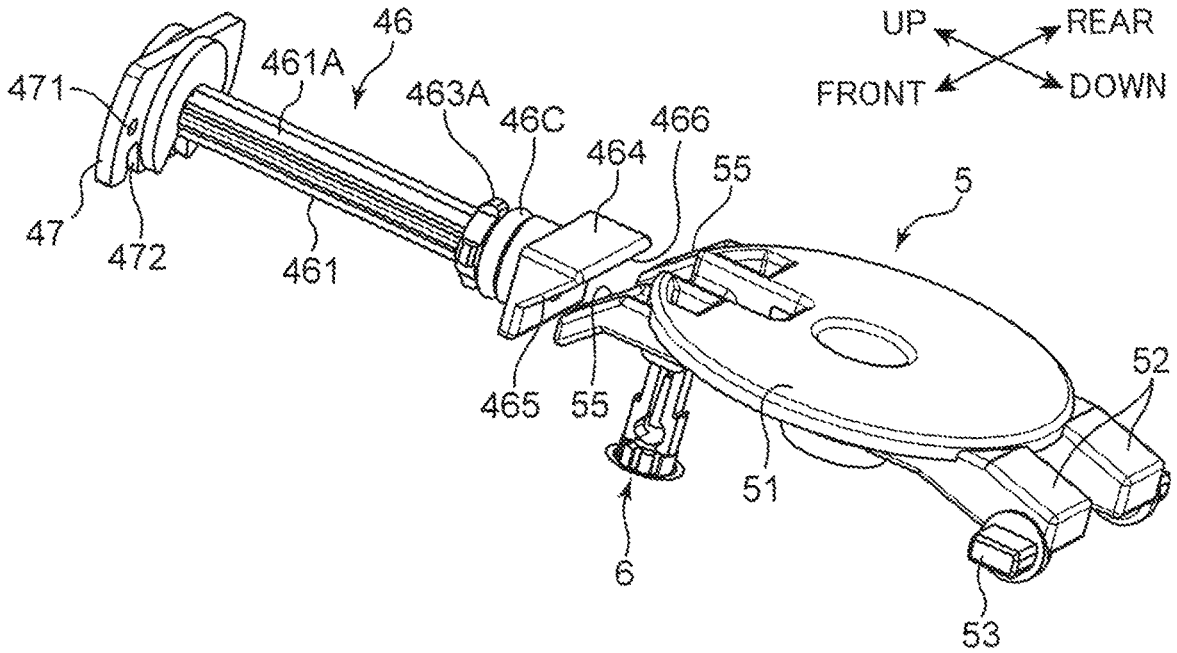
FIGS. 21A and 21B are perspective views of the pressing member, the on-off valve and the lever member.
Figure 21B:
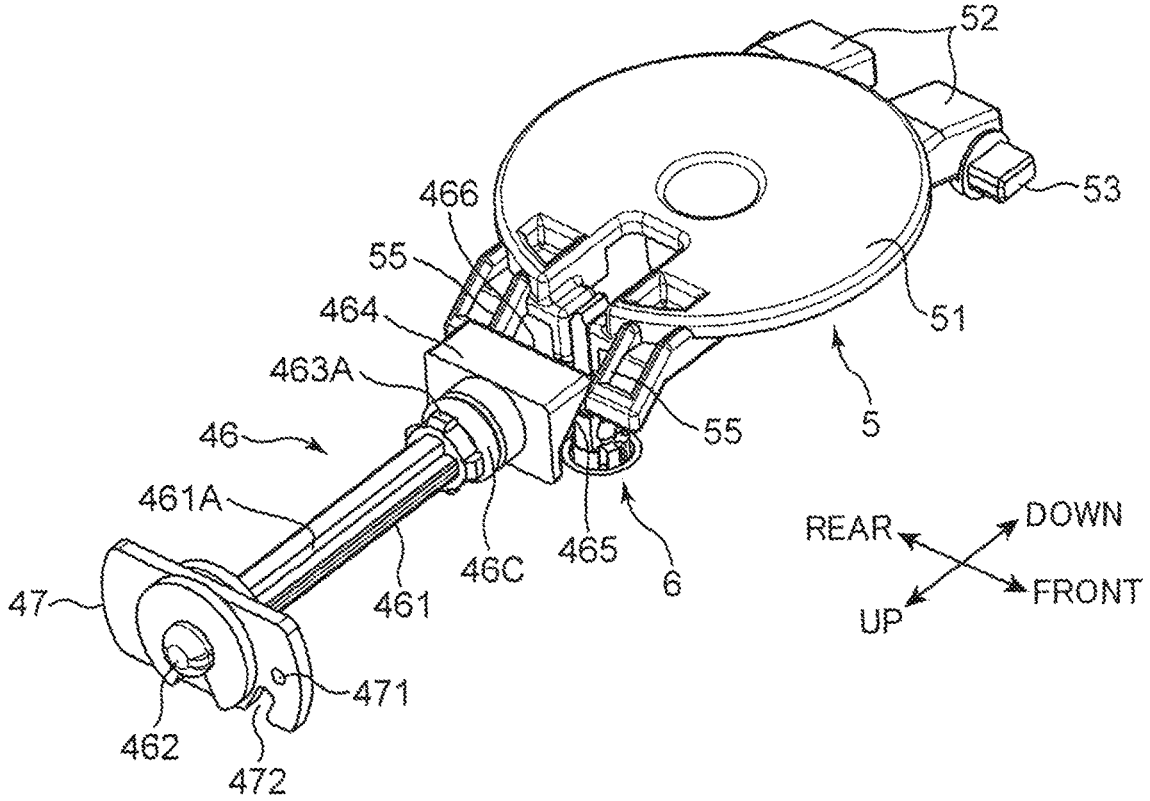
Figure 22A:
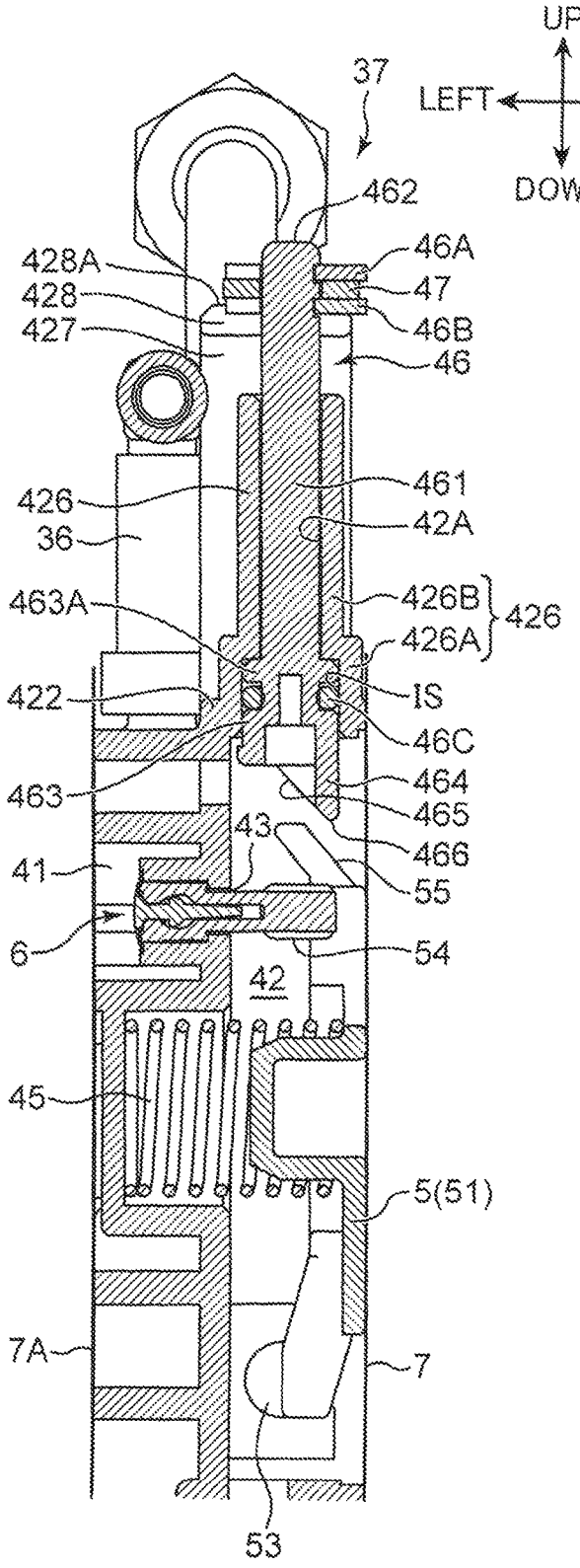
FIG. 22A is a sectional view showing a state before the lever member is operated and FIG. 22B is a sectional view showing a state where air is vented by the operation of the lever member.
Figure 22B:
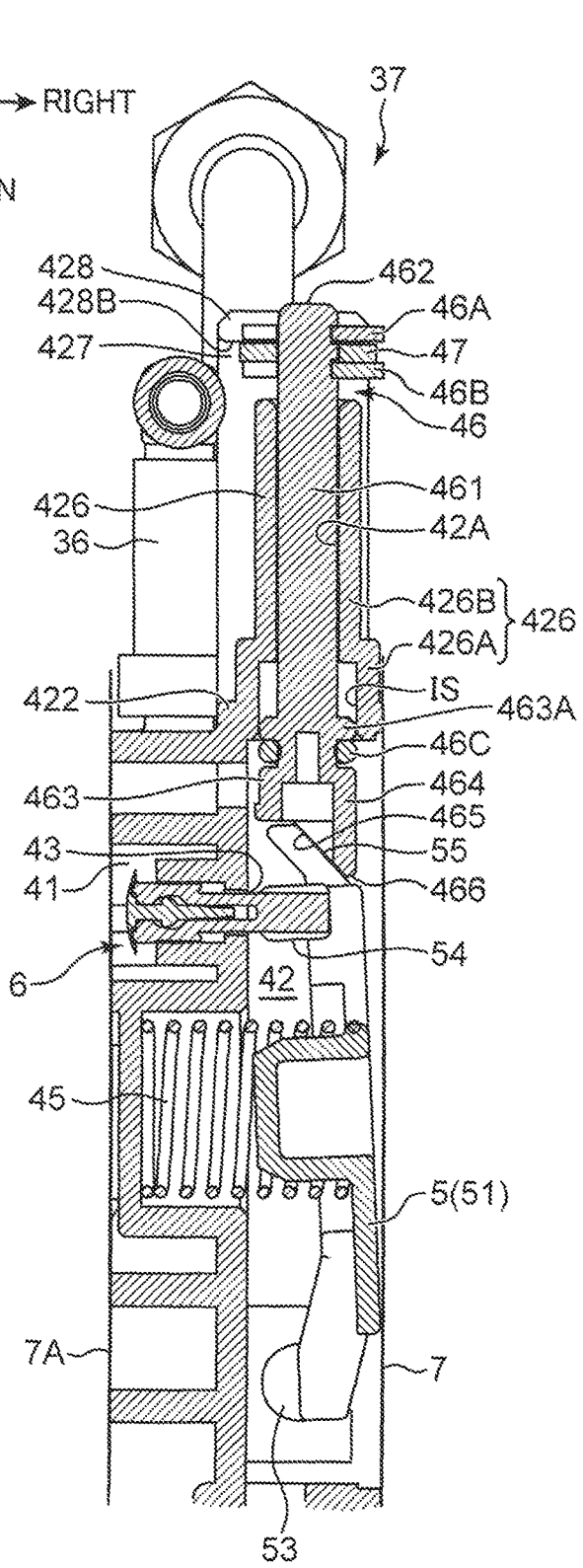

Next, the air vent mechanism 37 attached to the second chamber 42 is described in detail with reference to FIGS. 20A to 22B in addition to FIG. 12A already described. FIGS. 20A and 20B are perspective views of the lever member 46 as a constituent member of the air vent mechanism 37 and FIG. 20C is an exploded perspective view of the lever member 46. FIGS. 21A and 21B are perspective views showing a positional relationship of the pressing member 5, the on-off valve 6 and the lever member 46. FIGS. 22A and 22B are the same sectional views as FIG. 16A showing an air venting operation of the lever member 46. As described above, the air vent mechanism 37 is used in venting air and deaerating air bubbles generated from the ink when the ink is initially filled into the second chamber 42 during initial usage, after maintenance and the like.

The air vent mechanism 37 includes the lever member 46, a sealing ring 46C and a stopper 47 in addition to the aforementioned boss portion 426 projecting on the upper end part 422 of the second chamber 42. As shown in FIG. 12A, the boss portion 426 projects from an uppermost end of the second partition wall 421 defining the second chamber 42 and includes an opening allowing the second chamber 42 to communicate with the atmosphere, i.e. a boss hole 42A having a circular cross-sectional shape and serving as an air vent hole. By providing the boss hole 42A at the uppermost position of the second chamber 42, the second chamber 42 can be reliably deaerated. The boss portion 426 includes a large-diameter portion 426A located right above the upper end part 422 and a small-diameter portion 426B connected to and above the large-diameter portion 426A. An inner diameter of the boss hole 42A is larger in the large-diameter portion 426A than in the small-diameter portion 426B.

As shown in FIG. 20C, the lever member 46 includes a rod-like member 461 to be partially inserted into the boss hole 42A and a pressing piece 464 connected below the rod-like member 361, and has a shovel-like shape. The lever member 46 is one type of a valve member whose posture is changed between a sealing posture for sealing the boss hole 42A and an opening posture for opening the boss hole 42A. In this embodiment, a posture changing operation of the lever member 46 is linked with that of the on-off valve 6 via the pressing member 5. Specifically, the on-off valve 6 is allowed to be in the closing posture when the lever member 46 is in the sealing posture, and the posture of the on-off valve 6 is changed from the closing posture to the opening posture when the lever member 46 is in the opening posture.

The rod-like member 461 of the lever member 46 is a cylindrical body having an outer diameter smaller than a hole diameter of the boss hole 42A and includes an upper end part 462 and a lower end part 463. The upper end part 462 serves as an input portion for receiving an operational pressing force for pressing the lever member 46 downward from a user. The lower end part 463 is linked to the pressing piece 464. As shown in FIGS. 21A and 21B, the pressing piece 464 functions as a transmitting portion for transmitting the operational pressing force applied to the upper end part 462 to the receiving slopes 55 of the pressing member 5. An intermittent projection portion 463A formed by annularly arranging a plurality of small projections in a circumferential direction of the rod-like member 461 is provided at a position somewhat above the lower end part 463.

The pressing piece 464 includes a pressing slope 465 inclined with respect to an axis of the rod-like member 461 and a lower end edge 466 extending in the front-rear direction on a lowermost end. The pressing slope 465 is a slope extending upward with the lower end edge 466 as a starting point. The pressing slope 465 and the lower end edge 466 are parts which interfere with the pair of front and rear receiving slopes 55 of the pressing member 5 when the lever member 46 receives the operational pressing force. A width of the pressing slope 465 in the front-rear direction is set longer than an interval between the pair of receiving slopes 55. The pressing slope 465 and the lower end edge 466 come into contact with the receiving slopes 55 to transmit the operational pressing force to the pressing member 5, whereby the pressing member 5 rotates leftward about the axis of the pivot portions 53 and the posture of the on-off valve 6 is changed from the closing posture to the opening posture.

An upper engaging groove 467A and a lower engaging groove 467B arranged at a distance from each other in the vertical direction are formed near the upper end part 462 of the rod-like member 461. An upper washer 46A is fit into the upper engaging groove 467A, and a lower washer 46B is fit into the lower engaging groove 467B. Further, a sealing groove 468 is provided near the lower end part 463. An outer diameter of the lower end part 463 is set larger than that of the other part of the rod-like member 461, and a part between this lower end part 463 and the intermittent projection portion 463A serves as the sealing groove 468. Further, air vent longitudinal grooves 461A formed of recessed grooves are provided over the entire length of the rod-like member 461 in the front-rear direction. The positions of these air vent longitudinal grooves 461A match those of valley parts of the intermittent projection portion 463A in the circumferential direction.

The sealing ring 46C and the stopper 47 are mounted on the rod-like member 461. The sealing ring 46C is an O-ring having an inner diameter somewhat larger than the rod-like member 461. The sealing ring 46C is inserted onto the rod-like member 461 and fit into the sealing groove 468. The outer peripheral surface of the sealing ring 46C slides in contact with an inner peripheral surface IS of the large-diameter portion 426A of the boss portion 426 with the sealing ring 46C mounted in the sealing groove 468. The stopper 47 is a substantially rectangular plate member and includes a rotation hole 47H into which the rod-like member 461 is inserted. The stopper 47 is mounted at a position near the upper end part 462 and between the upper engaging groove 467A and the lower engaging groove 467B. The upper and lower washers 46A, 46B are respectively fit into the upper and lower engaging grooves 467A, 467B to sandwich the stopper 47 and restrict a movement of the stopper 47 in an axial direction.

The stopper 47 is rotatable about an axis of the rod-like member 461 while being sandwiched by the upper and lower washers 46A, 46B. The stopper 47 is a member planned to come into contact with upper surfaces 428A or lower surfaces 428B (FIG. 22) of the pair of locking claws 428 of the holding frame 427 according to a vertical movement of the lever member 46. During the vertical movement, the stopper 47 is rotated such that a longitudinal direction thereof extends along the lateral direction and passes through a clearance between the pair of locking claws 428. The stopper 47 is formed with a pin hole 471 and a locking recess 472. At least when the stopper 47 comes into contact with the upper surfaces 428A, a pin member 48 in the form of a split pin is fit into the pin hole 471 and the locking recess 472 to prevent the rotation of the stopper 47 and retain the stopper 47, i.e. to fix the stopper 47 as shown in FIG. 12A. The stopper 47, the pin member 48 and the pair of locking claws 428 function as a fixing mechanism for fixing the posture of the lever member 46.

Next, the operation of the lever member 46 is described. FIGS. 22A and 22B are sectional views respectively showing a state before the lever member 46 is operated and a state where air is vented by the operation of the lever member 46. FIG. 22A shows a state where the upper end part 462 of the lever member 46 is receiving no operational pressing force, i.e. a sealing posture in which the lever member 46 seals the boss hole 42A. On the other hand, FIG. 22B shows a state where the upper end part 462 is pressed downward to apply an operational pressing force, i.e. the opening posture in which the lever member 46 opens the boss hole 42A.

The sealing posture is formed by the pin member 48 fixing the stopper 47 and the locking claws 428 with the stopper 47 held in contact with the upper surfaces 428A of the locking claws 428. By this fixing, the lever member 46 is lifted upward. This state forms a state where the intermittent projection portion 463A and the lower end part 463 of the rod-like member 461 are housed in the large-diameter portion 426A of the boss portion 426. That is, the outer peripheral surface of the sealing ring 46C is in contact with the inner peripheral surface IS of the large-diameter portion 426A. Accordingly, the boss hole 42A is sealed. The pressing piece 464 (pressing slope 465 and lower end edge 466) of the lever member 46 is separated from the receiving slopes 55 of the pressing member 5 and applies no force to the pressing member 5. Thus, the on-off valve 6 is maintained in the closing posture.

On the other hand, if the lever member 46 receives an operational pressing force to be lowered and assume the opening posture, the intermittent projection portion 463A and the lower end part 463 are also lowered and, accordingly, the sealing ring 46C is separated from the inner peripheral surface IS. In this way, air passages formed by the valley parts of the intermittent projection portion 463A and the air vent longitudinal holes 461A of the rod-like member 461 and the space in the second chamber 42 communicate. That is, the boss hole 42A is in an opened state and the second chamber 42 communicates with outside air. Thus, a state is formed where the air staying in the second chamber 42 can be discharged to outside through the boss hole 42A.

Further, if the lever member 46 assumes the opening posture, the operational pressing force is transmitted to the pressing member 5. As shown in FIG. 22B, the pressing slope 465 and the lower end edge 466 press the receiving slopes 55. When the receiving slopes 55 are pressed, the pressing member 5 (disk portion 51) rotates leftward about the axis of the pivot portions 53. As described above, if the pressing member 5 rotates leftward, the on-off valve 6 is pressed leftward via the link bosses 54 and the posture of the on-off valve 6 is changed from the closing posture to the opening posture. In this way, the sealing of the communication opening 43 is released and the first and second chambers 41, 42 communicate.

The above opening posture is formed by the stopper 47 being pressed against the lower surfaces 428B of the locking claws 428. Specifically, when the lever member 46 assumes the opening posture, the stopper 47 is pressed down to slip under the locking claws 428. Since the pressing member 5 rotates against the biasing force of the biasing spring 45 by the pressing piece 464 pressing the receiving slopes 55, the biasing force of the biasing spring 45 is applied to the pressing piece 464. That is, the biasing force acts to lift up the lever member 46. The stopper 47 is pressed against the lower surfaces 428B of the locking claws 428 by this biasing force and the opening posture is maintained.

As just described, if the lever member 46 assumes the opening posture, an inlet (communication opening 43) for fluid into the second chamber 42 and an outlet (boss hole 42A) for fluid are ensured. Thus, during initial usage, the operation of filling the ink from the first chamber 41 into the second chamber 42 through the communication opening 43 while air in the second chamber 42 is vented through the boss hole 42A can be smoothly performed, utilizing the supply by the water head difference. Further, if the amount of air in the second chamber 42 increases (confirmed by the monitor pipe 36 since the ink liquid level in the second chamber 42 drops) such as due to the generation of air bubbles from the ink, air can be easily vented from the second chamber 42 by setting the lever member 46 to the opening posture.

In the above embodiment, the posture of the on-off valve 6 is changed to the opening posture in conjunction with the lever member 46 assuming the opening posture, utilizing the pressing member 5 including the pressure receiving portion 5A for receiving a displacement force from the atmospheric pressure detection film 7 and the link bosses 54 for pressing the on-off valve 6 by the displacement force received by the pressure receiving portion 5A. That is, the inlet and outlet for fluid into and from the second chamber 42 can be ensured in a single operation of the lever member 46. Accordingly, the user can easily perform the operation of venting air in the second chamber 42. Further, since the air vent mechanism 37 is arranged on the upper surface of the tank portion 31, the user can perform the air venting operation for each liquid supply unit 3 by accessing from the front of the carriage 2 even with the plurality of liquid supply units 3 mounted in the carriage 2 as shown in FIG. 4.

[Procedure of Air Venting Operation]

Figure 23B:
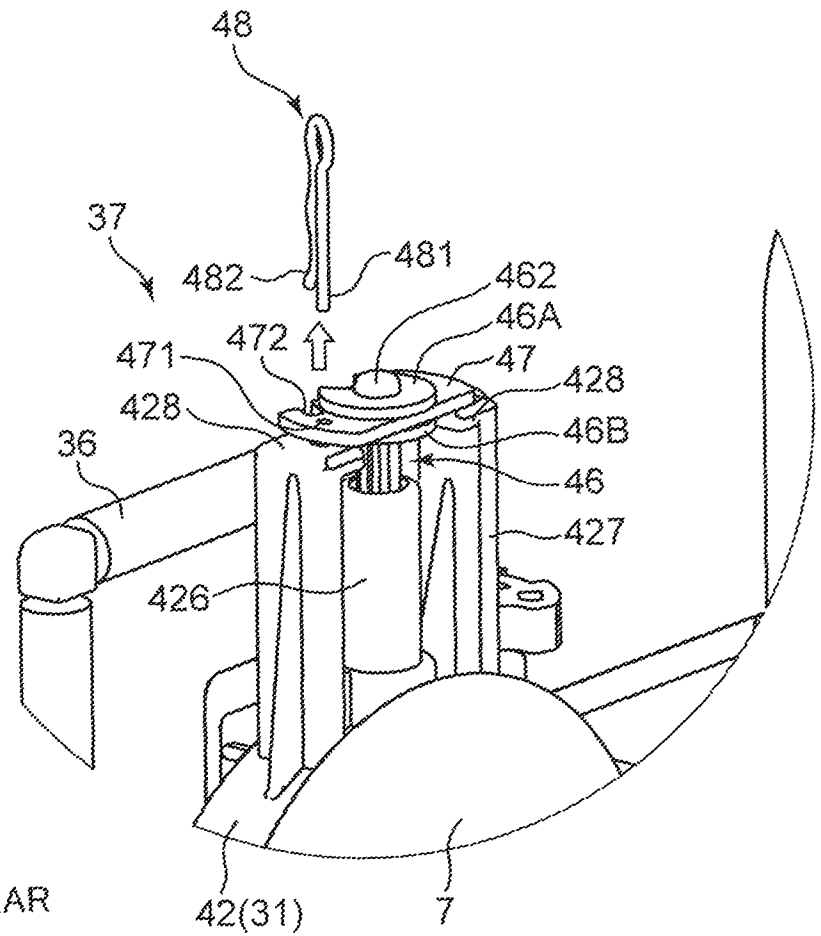
FIG. 23B is a perspective view showing the operation of the lever member.
Figure 23A:
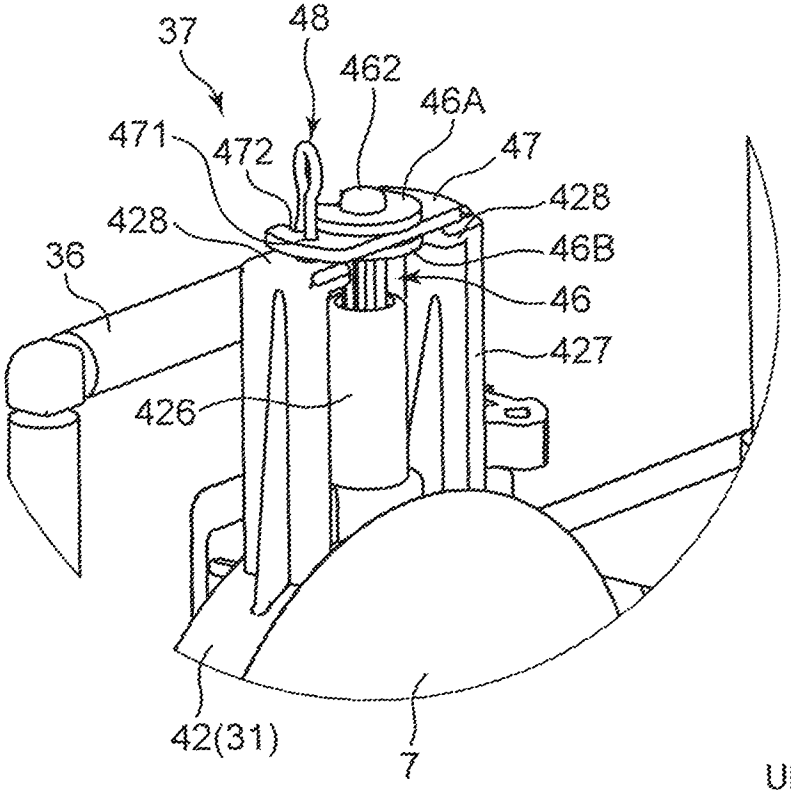
FIG. 23A is a perspective view of an air vent mechanism in a state corresponding to the state of FIG. 22A
Figure 23A:
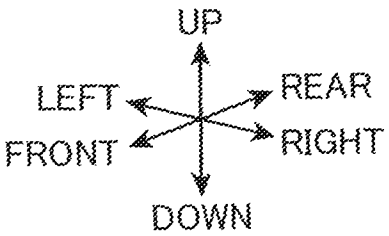
Figure 24B:
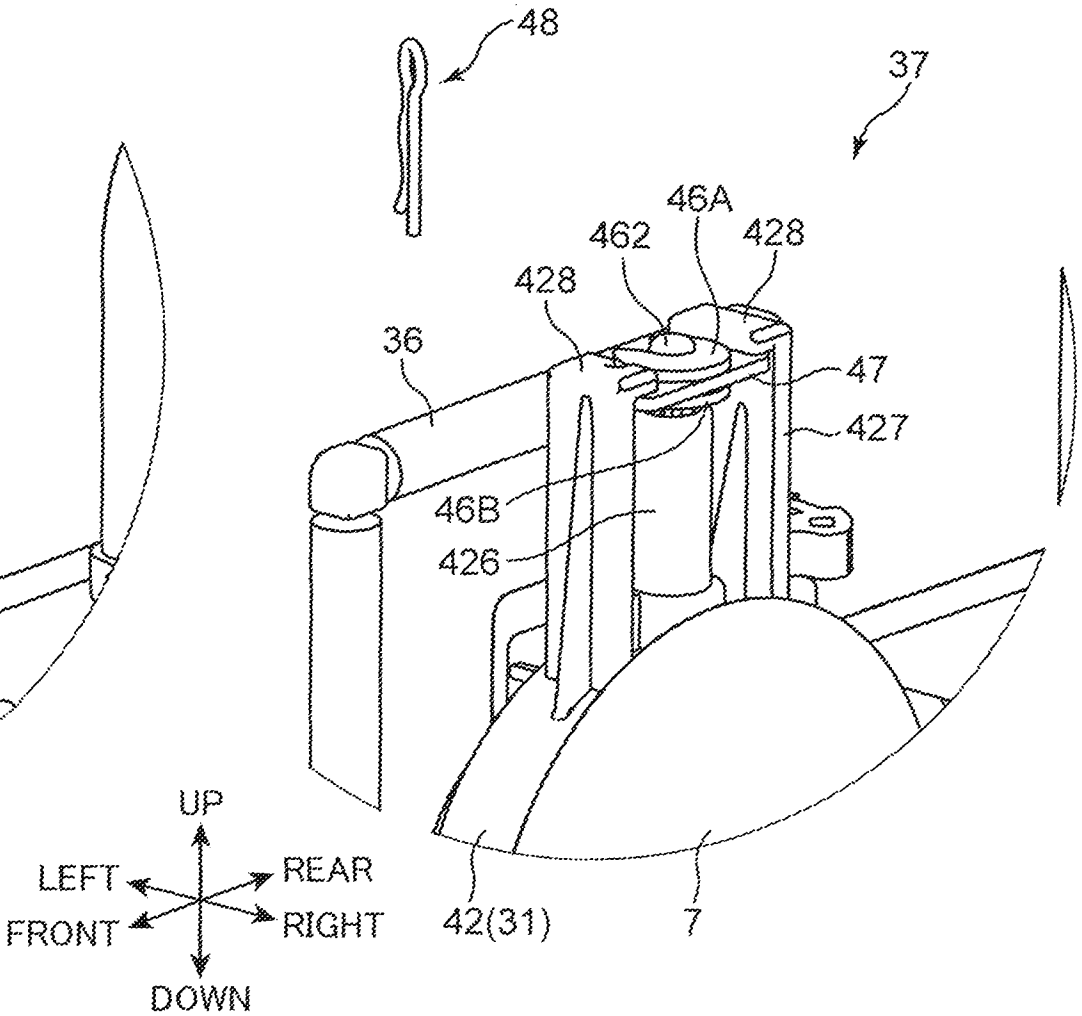
FIG. 24A is a perspective view showing the operation of the lever member and FIG. 24B is a perspective view of the air vent mechanism in a state corresponding to the state of FIG. 22B.

Next, an example of the air venting operation in the air vent mechanism 37 is described on the basis of FIGS. 23A to 24B. FIG. 23A is a perspective view of the air vent mechanism 37 corresponding to the state of FIG. 22A, FIGS. 23B and 24A are perspective views showing the operation of the lever member 46 and FIG. 24B is a perspective view of the air vent mechanism 37 corresponding to the state of FIG. 22B.

In the sealing posture of FIGS. 22A and 23A, the stopper 47 and the locking claws 428 are fixed by the pin member 48 with the stopper 47 held in contact with the upper surfaces 428A of the locking claws 428. The stopper 47 is rotated such that a longitudinal direction thereof faces in the front-rear direction, and a front end side thereof is overlapped above the front locking claw 428 and a rear end side thereof is overlapped above the rear locking claw 428. The pin hole 471 and the locking recess 472 of the stopper 47 are located on the front side by the above rotation. The front locking claw 428 is provided with a cutout portion at a position corresponding to the pin hole 471. A vertical portion 481 of the pin member 48 in the form of a split pin is inserted into the pin hole 471 and an engaging portion 482 having a lower end side curved outward is fit into the locking recess 472, whereby the stopper 47 is fixed to the locking claws 428. In this state, the lever member 46 is hung up, the sealing ring 46C is in contact with the inner peripheral surface IS of the boss hole 42A to exhibit a sealing effect, and the pressing slope 465 and the receiving slopes 55 are separated.

Figure 24A:
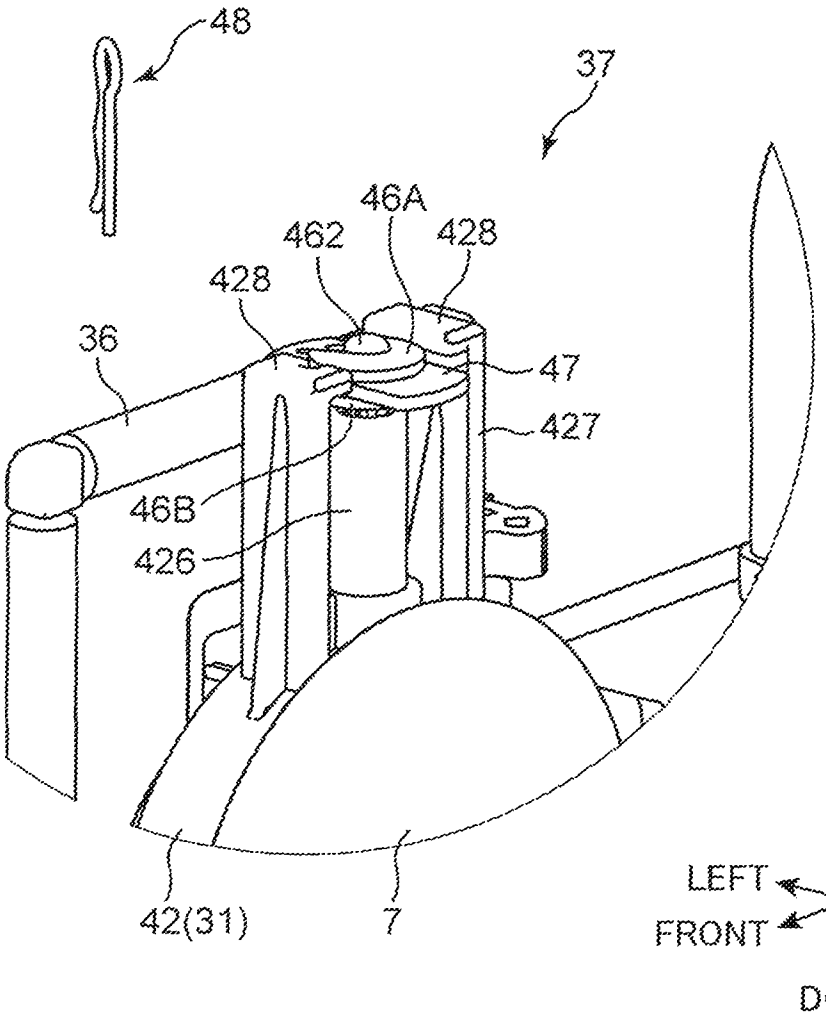

In venting the air in the second chamber 42, an operator first pulls the pin member 48 from the stopper 47 as shown in FIG. 23B. In this way, the stopper 47 becomes rotatable about the axis of the rod-like member 461. Subsequently, the operator rotates the stopper 47 only by 90° such that the longitudinal direction thereof faces in the lateral direction as shown in FIG. 24A. By this rotation, the stopper 47 becomes capable of vertically passing through the clearance between the pair of front and rear locking claws 428. In such a state, the operator presses down the upper end part 462 to push down the lever member 46. The lever member 46 is pushed down until the upper surface of the stopper 47 reaches a position below the lower surfaces 428B of the locking claws 428.

Thereafter, as shown in FIG. 24B, the operator rotates the stopper 47 only by 90° such that the longitudinal direction thereof faces in the front-rear direction. In this way, the front end side of the stopper 47 is overlapped below the front locking claw 428 and the rear end side thereof is overlapped below the rear locking claw 428. In this state, as shown in FIG. 22B, the lever member 46 is pushed downward to reach the opening posture in which the sealing ring 46C is separated from the inner peripheral surface IS of the boss hole 42A and the sealing effect is lost. Further, an operational pressing force applied to the upper end part 462 is transmitted to the receiving slopes 55 from the pressing piece 464 to rotate the pressing member 5 against the biasing force of the biasing spring 45. The stopper 47 is pressed against the lower surfaces 428B of the locking claws 428 by a reaction force of the biasing spring 45 at this time, whereby the lever member 46 in the opening posture is fixed.

As just described, regardless of whether the lever member 46 is in the sealing posture or in the opening posture, these postures can be easily maintained utilizing the locking claws 428. For example, since the air in the second chamber 42 needs to be vented in filling the liquid into the second chamber 42 during initial usage, the lever member 46 needs to be maintained in the opening posture. In this case, the operator may push down the upper end part 462 of the lever member 46 and slip the stopper 47 under the lower surfaces 428B of the locking claws 428. Accordingly, this operator needs not continue to push down the upper end part 462, wherefore operability can be improved. Further, during normal usage of the liquid supply unit 3, the lever member 46 needs to be set to the sealing posture. In this case, it is sufficient to perform a simple operation of overlapping the stopper 47 above the upper surfaces 428A of the locking claws 428 and fixing the stopper 47 with the pin member 48.

[Backflow Prevention Mechanism]

Figure 25:
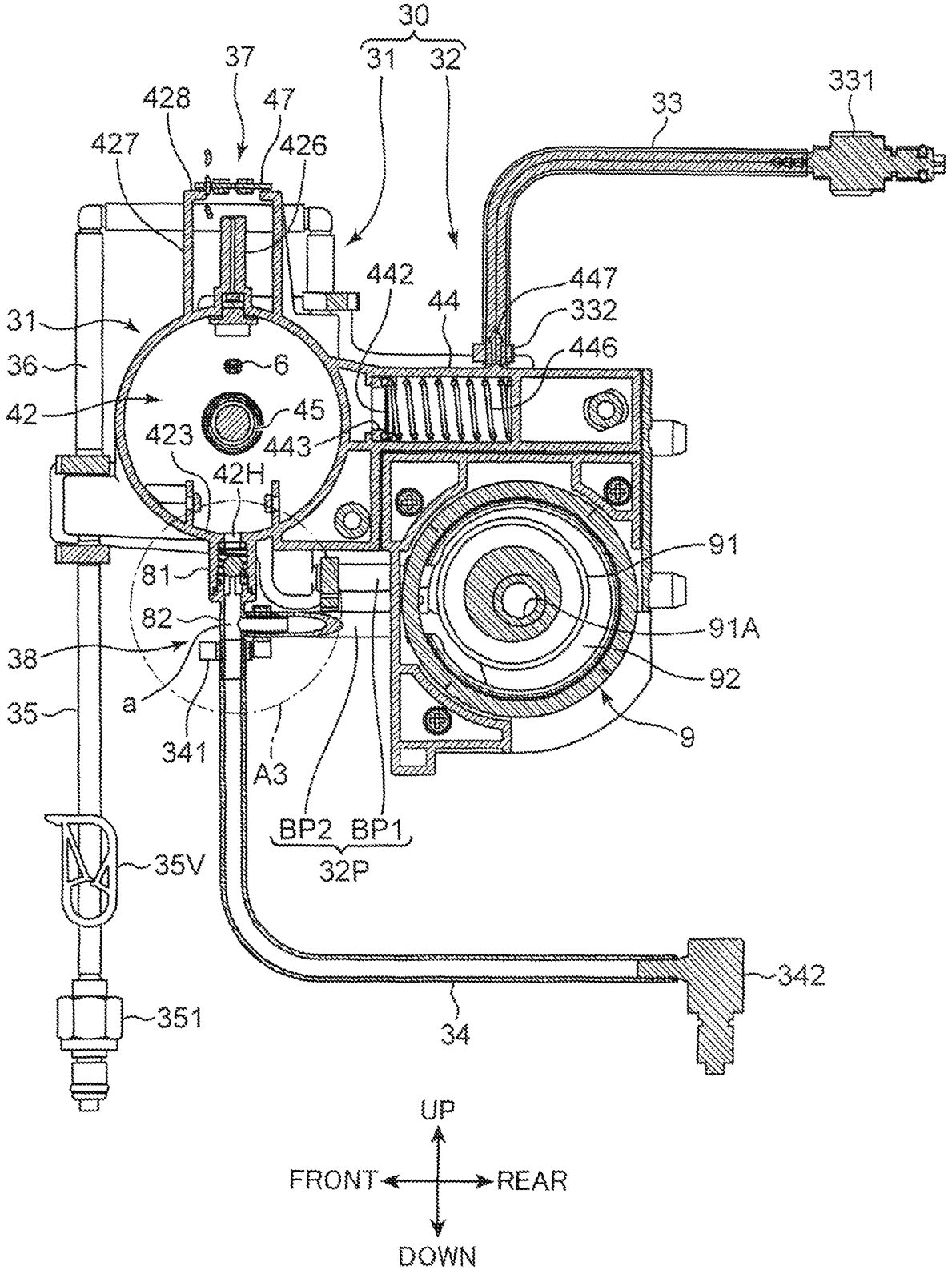
FIG. 25 is a sectional view of the liquid supply unit along the front-rear direction.
Figure 26:
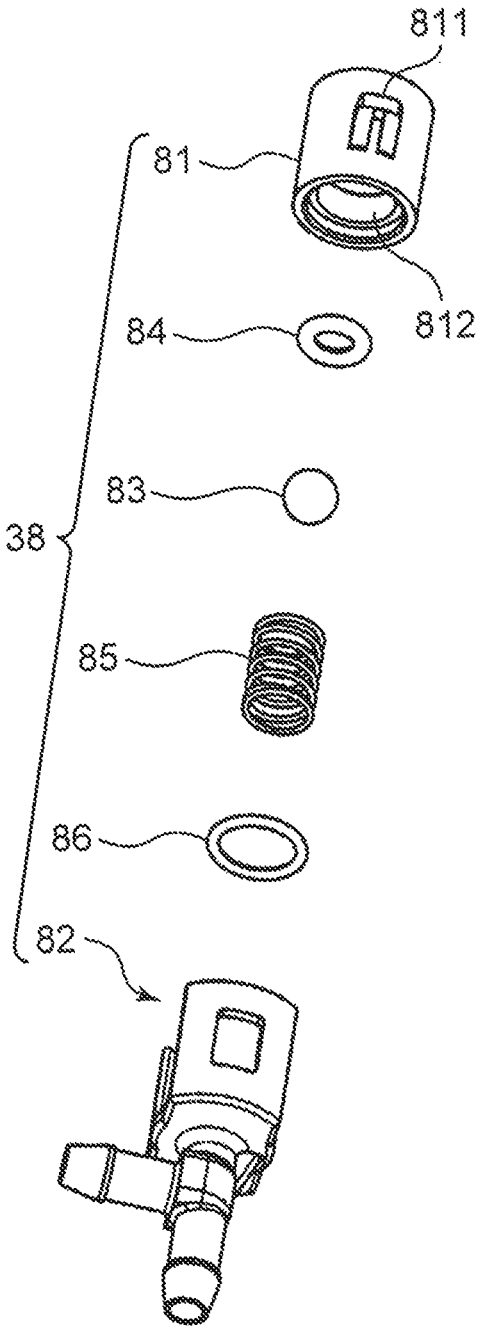
FIG. 26 is an exploded perspective view of a backflow prevention mechanism.
Figure 27C:
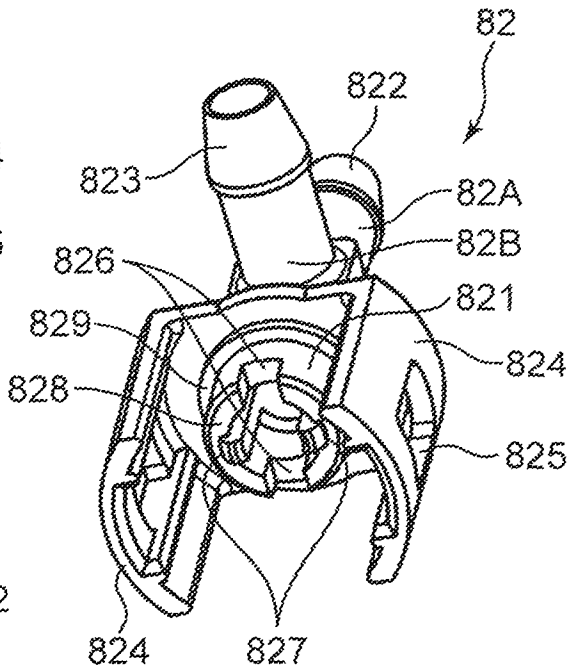
FIG. 27B is a view showing a state where the valve conduit is closed by the spherical body and FIG. 27C is a perspective view of a branched head portion.
Figure 27B:
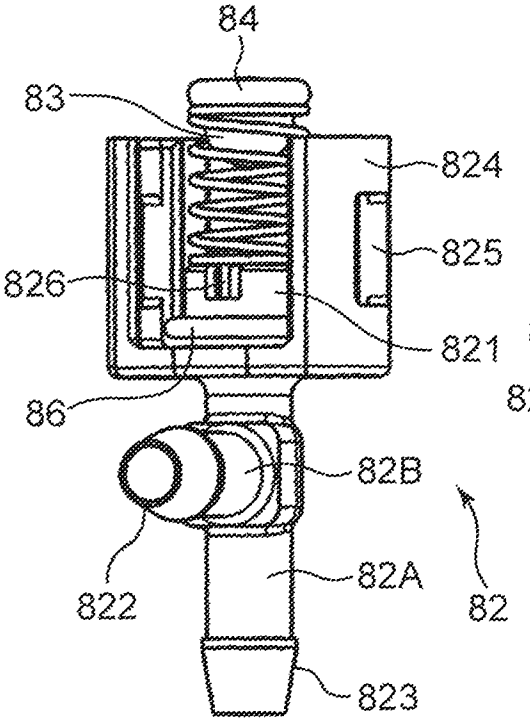
Figure 27A:
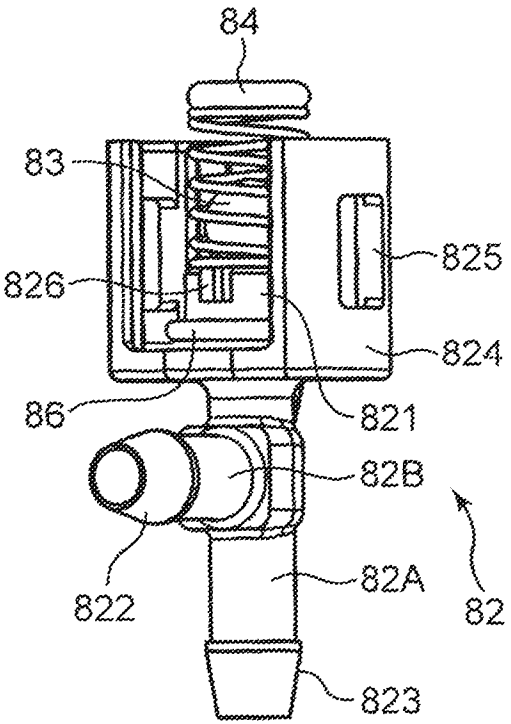
FIG. 27A is a perspective view of the backflow prevention mechanism showing a state where a valve conduit is opened by a spherical body.
Figure 28B:
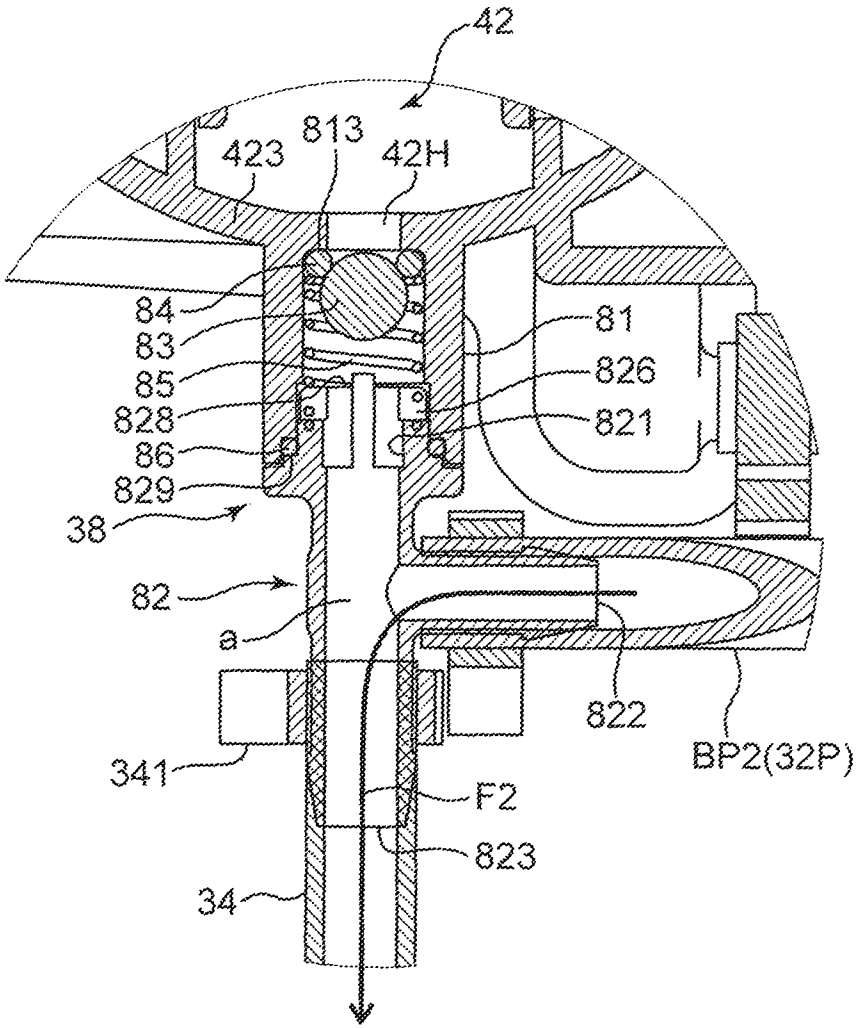
Figure 28A:
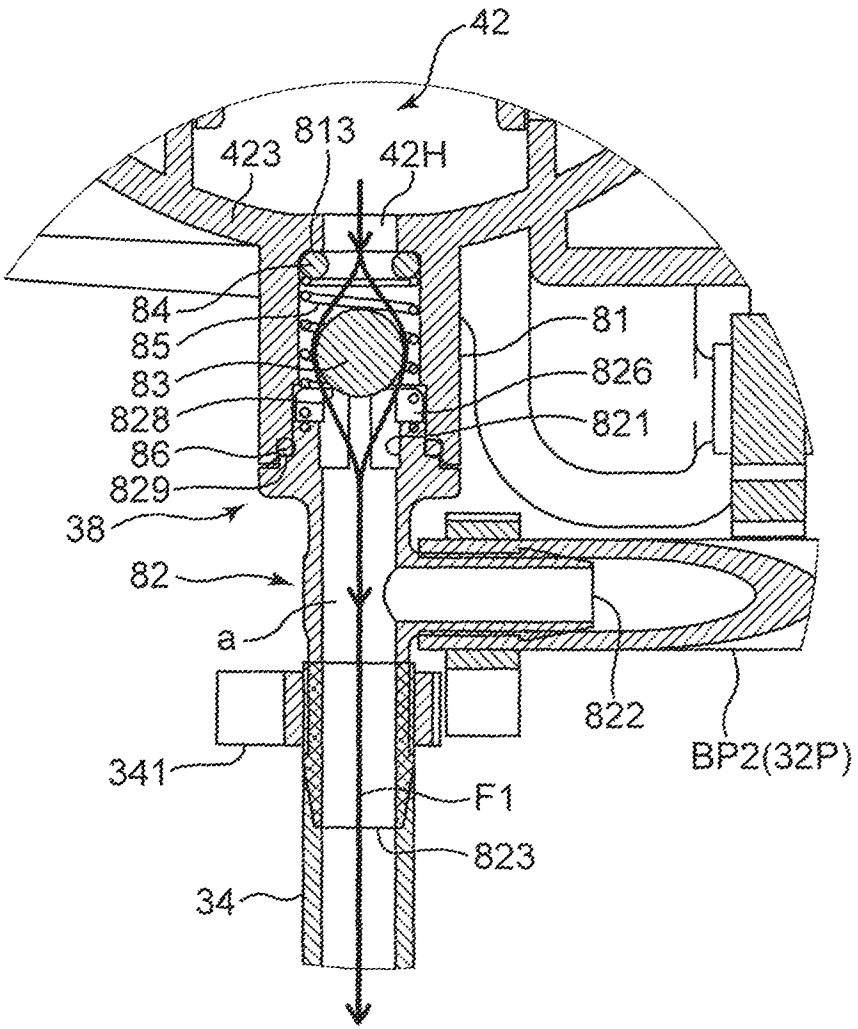

Next, the configuration of the backflow prevention mechanism 38 for preventing the ink pressurized by the pump 9 from flowing back to the second chamber 42 when the pressurized purge mode described on the basis of FIG. 9A is performed is described. FIG. 25 is a sectional view of the liquid supply unit 3 along the front-rear direction including a cross-section of the backflow prevention mechanism 38. FIG. 26 is an exploded perspective view of the backflow prevention mechanism 38. FIGS. 27A to 27C are perspective views of the backflow prevention mechanism 38. FIGS. 28A and 28B are enlarged views of a part A3 of FIG. 25, wherein FIG. 28A is a sectional view showing a state of the backflow prevention mechanism 38 in the print mode and FIG. 28B is a sectional view showing a state of the backflow prevention mechanism 38 in the pressurized purge mode.

The backflow prevention mechanism 38 includes a valve conduit 81, a branched head portion 82, a spherical body 83, a sealing member 84, a coil spring 85 and an O-ring 86. The valve conduit 81 is a member integrated with the lower end part 423 of the second chamber 42, and the other components are mounted into the valve conduit 81. FIGS. 27A and 27B are perspective views of the backflow prevention mechanism 38 excluding the valve conduit 81 and FIG. 27C is a perspective view of the branched head portion 82 viewed from below.

The valve conduit 81 is a conduit extending vertically downward from the supply hole 42H (liquid discharge opening) perforated in the lower end part 423 (lowermost end part) of the second chamber 42, and integrated with the second partition wall 421. The valve conduit 81 provides an ink flow passage linking the second chamber 42 and the downstream pipe 34 and constitutes a part of an ink supply passage from the second chamber 42 to the ink discharging portion 22. A locking piece 811 projects on the outer peripheral surface of the valve conduit 81 and a fitting annular projection 812 projects on the inner peripheral surface of the valve conduit 81 to lock the branched head portion 82.

The branched head portion 82 is a member for forming the joint part a described above on the basis of FIGS. 7 to 9. The branched head portion 82 includes a first inlet port 821, a second inlet port 822, an outlet port 823, trunk portions 824, a locking window 825, a cutout portion 826 and fitting claws 827. The first inlet port 821 is a port connected to the second chamber 42 and, in this embodiment, communicates with the second chamber 42 via the valve conduit 81. The second inlet port 822 is a port connected to the downstream end of the bypass pipe 32P (bypass downstream pipe BP2). The outlet port 823 is a port connected to the upstream end 341 of the downstream pipe 34.

The trunk portions 824 are composed of a pair of arcuate pieces arranged to face each other outside the first inlet port 821 facing downward. The valve conduit 81 enters a clearance between a pair of the trunk portions 824 and the first inlet port 821. The locking window 825 is an opening which is provided in the pair of trunk portions 824 and with which the locking piece 811 of the valve conduit 81 is engaged. The cutout portion 826 is a part formed by partially cutting a peripheral wall of the tubular first inlet port 821 and a part for securing the ink flow passage. The fitting claws 827 are hook-shaped parts projecting upward from the upper end of the first inlet port 821, and engage the fitting annular projection 812 of the valve conduit 81. That is, the branched head portion 82 is fixed to the valve conduit 81 by the engagement of the locking piece 811 and the locking window 825 on the inner periphery of the valve conduit 81 and by the engagement of the fitting annular projection 812 and the fitting claw 827 on the outer periphery of the valve conduit 81. An upper end edge 828 of the first inlet port 821 serves as a sphere receiving portion for receiving the spherical body 83 described next.

The spherical body 83 is housed into the valve conduit 81 movably in the ink supply direction and works as a valve. An outer diameter of the spherical body 83 is smaller than an inner diameter of the valve conduit 81 and smaller than an inner diameter of the coil spring 85. Various materials can be used as a material for forming the spherical body 83, but the spherical body 83 is preferably formed of a material having a specific weight equal to or less than twice the specific weight of the ink, particularly a material having a specific weight in the range of 1.1-fold to 1.5-fold of the specific weight of the ink. If a material within this range is used, the spherical body 83 can easily descend by dead weight in the valve conduit 81 since the specific weight of the spherical body 83 is larger than that of the ink, whereas the spherical body 83 can quickly ascend in the valve conduit 81 during pressurized purging since the specific weight of the spherical body 83 is close to that of the ink.

Generally, ink used in an ink jet printer is water-soluble solution and has a specific weight equal to or near 1. Thus, it is desirable to select a material having a specific weight less than 2 as the material of the spherical body 83. Further, the above material desirably has properties such as chemical resistance and wear resistance not to be deteriorated even if the material is constantly in contact with the ink. From these perspectives, it is particularly preferable to use polyacetal (specific weight=1.42), polybutylene terephthalate (specific weight=1.31 to 1.38), polyvinyl chloride (specific weight=1.35 to 1.45) and polyethylene terephthalate (specific weight=1.34 to 1.39) as the material of the spherical body 83.

The sealing member 84 is a sealing component having a ring shape and to be seated on a seat portion 813 above the spherical body 83 and on an upper end side of the valve conduit 81 as shown in FIGS. 28A and 28B. A ring inner diameter (through hole) of the sealing member 84 is set smaller than the outer diameter of the spherical body 83. When the spherical body 83 is separated downward from this sealing member 84 as shown in FIG. 28A, the valve conduit 81 is opened. On the other hand, when the spherical body 83 contacts the sealing member 84 as shown in FIG. 28B, the valve conduit 81 is closed.

The coil spring 85 is a compression spring mounted in the valve conduit 81 such that a lower end part thereof comes into contact with the sealing member 84 and an upper end part thereof comes into contact with the lower end edge 828 of the first inlet port 821 of the branched head portion 82. The coil spring 85 biases the sealing member 84 toward the seat portion 813, whereby the sealing member 84 is constantly pressed into contact with the seat portion 813. Further, the spherical body 83 is housed inside the coil spring 85 and the coil spring 85 also functions to guide a movement of the spherical body 83 in the ink supply direction. Thus, a loose movement of the spherical body 83 in the valve conduit 81 can be restricted and a valve structure realized by movements of the spherical body 83 toward and away from the sealing member 84 can be stabilized.

The O-ring 86 seals butting parts of the valve conduit 81 and the branched head portion 82. The O-ring 86 is fit on the outer peripheral surface of the first inlet port 821 and in contact with a projecting base portion 829 of the first inlet port 821.

FIG. 25 shows the pump 9 housed in the pump portion 32. The pump 9 is arranged in the bypass pipe 32P and pressurizes the ink flowing in this bypass pipe 32P. The pump 9 is a tube pump including the eccentric cam 91 and a squeeze tube 92. The cam shaft 93 (FIG. 4) serving as an axis of rotation of the eccentric cam 91 is inserted into a shaft hole 91A of the eccentric cam 91. A rotational drive force is applied to this eccentric cam 91 from an unillustrated drive gear. The squeeze tube 92 is arranged on the peripheral surface of the eccentric cam 91 and squeezed by the rotation of the eccentric cam 91 around the cam shaft 93 to feed the liquid (ink) in the tube from one end side toward the other end side. In this embodiment, the squeeze tube 92 is a tube integral with the bypass pipe 32P. Specifically, one end side of the squeeze tube 92 is the bypass upstream pipe BP1 communicating with the bypass communication chamber 413 of the first chamber 41, the other end side thereof is the bypass downstream pipe BP2 communicating with the second inlet port 822 of the branched head portion 82 and a central part serves as a squeezing portion arranged on the peripheral surface of the eccentric cam 91.

As described above, the pump 9 is stopped in the print mode shown in FIG. 7. In this case, the eccentric cam 91 is stopped with the squeeze tube 92 squeezed, wherefore the ink supply passage passing through the bypass pipe 32P is closed. On the other hand, the pump 9 is driven in the forward rotation direction in the circulation mode shown in FIG. 8 and the pressurized purge mode shown in FIG. 9A. In FIG. 25, the forward rotation direction of the eccentric cam 91 is a counterclockwise direction. By this forward drive of the pump 9, the ink is sucked from the first chamber 41 through the bypass upstream pipe BP1 and flows toward the backflow prevention mechanism 38, which is the joint part a, from the bypass downstream pipe BP2. Note that when the pump 9 is driven in the reverse rotation direction, the second chamber 42 and the downstream pipe 34 are set to the negative pressure through the bypass pipe 32P and the branched head portion 82 as shown in FIG. 9B.

Next, the operation of the backflow prevention mechanism 38 is described. In the print mode (first state), the ink is supplied to the head unit 21 along a supply route passing through the backflow prevention mechanism 38 and the downstream pipe 34 from the second chamber 42. In such a print mode, the spherical body 83 is separated downward from the sealing member 84 and seated on the upper end edge 828 (sphere receiving portion) of the branched head portion 82 as shown in FIG. 28A. This relies on the fact that the specific weight of the spherical body 83 is larger than that of the ink and the spherical body 83 descends by dead weight. Further, it also contributes to maintaining the seated state of the spherical body 83 on the upper end edge 828 that the supply route from the second chamber 42 to the downstream pipe 34 is maintained at the negative pressure in the print mode and the ink present in the supply route is sucked every time the ink discharging portion 22 of the head unit 21 discharges ink droplets.

Since the spherical body 83 is separated from the sealing member 84, the supply hole 42H is opened. Further, since the cutout portion 826 is provided in the upper end edge 828 of the first inlet port 821 where the spherical body 83 is seated, the ink passage is ensured. Thus, the ink in the second chamber 42 can pass through the branched head portion 82 from the second chamber 42 and flows toward the downstream pipe 34 as shown by arrows μl in FIG. 28A.

FIG. 28B is a sectional view showing a state of the backflow prevention mechanism 38 in the pressurized purge mode (second state). In the pressurized purge mode, the ink pressurized through the bypass pipe 32P is supplied to the second inlet port 822 (joint part a) of the branched head portion 82 by the forward drive of the pump 9. Thus, the pressurized ink is present in the bypass pipe 32P and the downstream pipe 34 located downstream of the joint part a. In this case, the ink is pressurized to a high pressure exceeding 100 kPa. If such a high pressure is applied to the second chamber 42, the atmospheric pressure detection film 7 defining a part of the second chamber 42 may be broken or a part thereof attached to the second partition wall 421 may be peeled off.

However, in this embodiment, the spherical body 83 is pressed upward (upstream side in the ink supply direction) to contact the sealing member 84 by a pressurizing force applied to the joint part a. Specifically, the spherical body 83 is lifted up to fit into the ring-shaped sealing member 84 by the above pressing. By the contact of the spherical body 83 with the sealing member 84 pressed against the seat portion 813 by the coil spring 85, the supply hole 42H is closed. Specifically, out of the ink supply path in the print mode, the ink supply path located upstream of the joint part a and the second chamber 42 are blocked from pressurization by the pressurized ink. Thus, the breakage of the atmospheric pressure detection film 7 and the like can be prevented.

Further, in this embodiment, there is also an advantage that the ink containing air is unlikely to be supplied to the head unit 21. Once air dissolved into the ink or air mixed when the ink liquid is filled into the liquid supply unit 3 enters the head unit 21 while being contained in the ink and enters the individual passages 26 and the common passage 27 (FIG. 6A), this air is not easily vented and may not be discharged even if pressurized purging is performed. In this case, the discharge of the ink from the ink discharge holes 22H is hindered. However, in this embodiment, the second chamber 42, the backflow prevention mechanism 38 and the downstream pipe 34 are successively arranged in this order from top to down. Thus, air generated from the ink stored in the second chamber 42 or air mixed into the second chamber 42 does not flow toward the backflow prevention mechanism 38 and the downstream pipe 34 located below. Therefore, the flow of the ink containing air to the head unit 21 can be prevented and a discharge failure of the head unit 21 can be prevented.

Further, even if air is mixed into the branched head portion 82 or the downstream pipe 34, this air can be allowed to escape into the second chamber 42 from the vertical portion 82A through the valve conduit 81 and the supply hole 42H by a lifting action of air bubbles. Note that the above air can be discharged from the second chamber 42 by the air vent mechanism 37. Thus, it can be prevented that the volume in the second chamber 42 is excessively taken up by the above air.

[Double Protection Mechanism by Umbrella Valve]

As described above, in this embodiment, a backflow of the ink pressurized in the pressurized purge mode to the second chamber 42 is prevented by providing the backflow prevention mechanism 38. However, the pressurizing force may possibly act on the second chamber 42 due to a certain trouble of the backflow prevention mechanism 38 such as an operation failure of the spherical body 83. In view of this point, a double protection mechanism for releasing the pressure to the on-off valve 6 is provided in this embodiment. That is, the on-off valve 6 has a pressure release mechanism for releasing the pressure from the second chamber 42 to the first chamber 41 if a pressure relationship that the second chamber 42 is set at a negative pressure and the first chamber 41 is set at the atmospheric pressure+ρgh at normal time is reversed and the second chamber 42 is set at a pressure higher than in the first chamber 41.

The umbrella valve 66 of the on-off valve 6 functions as the above pressure release mechanism. As described on the basis of FIGS. 16A to 17B, the umbrella valve 66 seals the communication opening 43 by the sealing surface 67 coming into contact with the sealing wall surface 43S if the second chamber 42 is at a negative pressure below the predetermined threshold value. In this way, the inflow of the ink from the first chamber 41 to the second chamber 42 is prohibited. On the other hand, if the second chamber 42 is at a negative pressure exceeding the predetermined threshold value, the umbrella valve 66 moves leftward together with the valve holder 61 link-connected to the pressing member 5 and the sealing surface 67 is separated from the sealing wall surface 43S to open the communication opening 43 (release of sealing). In this way, the inflow of the ink from the first chamber 41 into the second chamber 42 is allowed.

In addition, the umbrella valve 66 singly opens the communication opening 43 if the pressure relationship of the second chamber 42 and the first chamber 41 is reversed, such as due to the application of the pressure of the pressurized ink to the second chamber 42 in the pressurized purge mode. That is, the umbrella valve 66 releases the sealed state of the communication opening 43 to release the pressure in the second chamber 42 to the first chamber 41 without being pressed by the pressing member 5. Specifically, the umbrella shape of the umbrella portion 661 (sealing surface 67) of the umbrella valve 66 is inverted when a predetermined pressure applied to the right surface side of the umbrella portion 661.

Figures 29A, 29B:
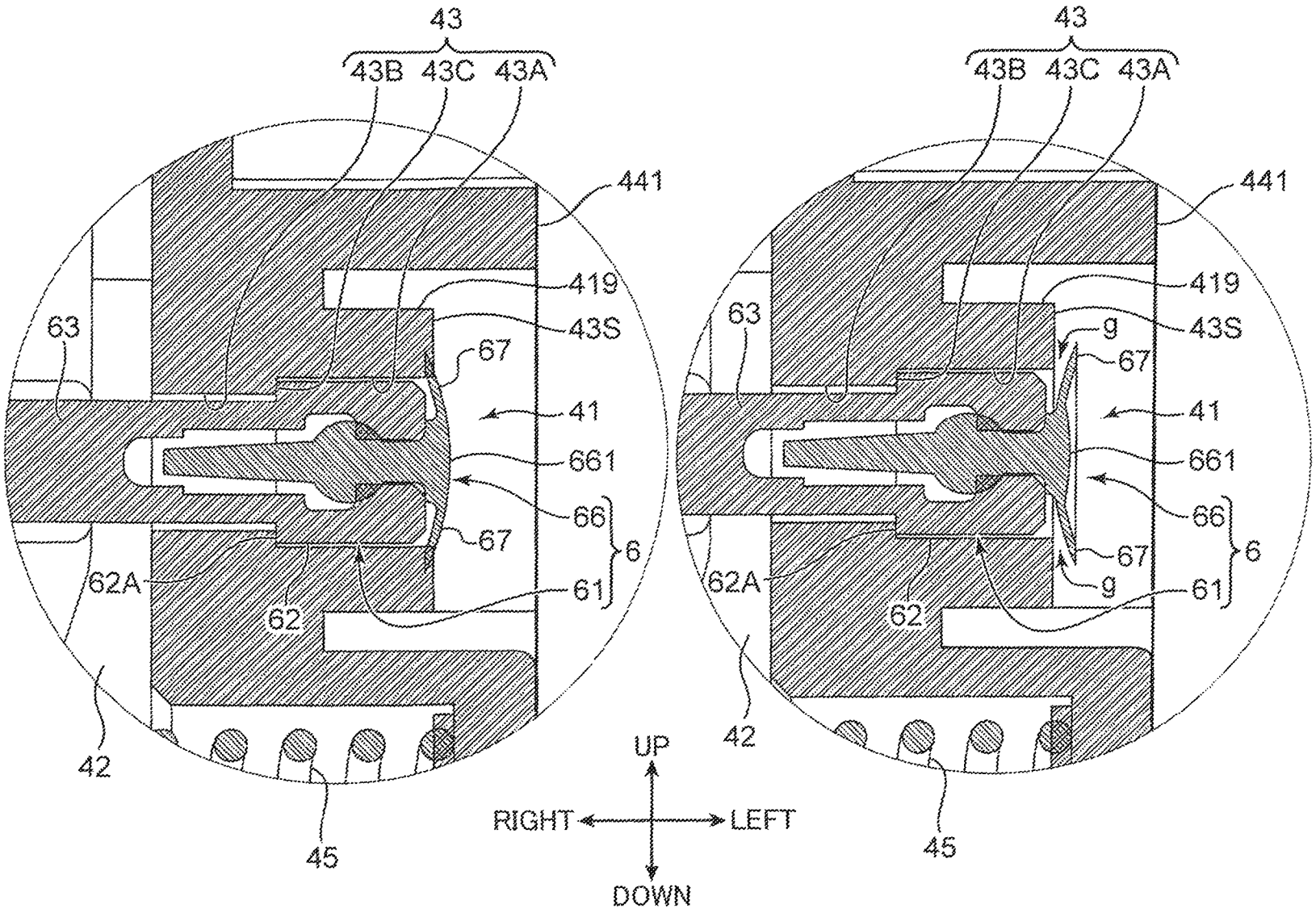
FIG. 29A is a sectional view showing a state where a communication opening is sealed by an umbrella valve and FIG. 29B is a sectional view showing a state where the communication opening is opened by the umbrella valve.

FIGS. 29A and 29B are sectional views respectively showing a state where the umbrella valve 66 seals the communication opening 43 and a state where the umbrella valve 66 opens the communication opening 43. The state of FIG. 29A is equal to the state of FIG. 16B previously described. The umbrella portion 661 has the umbrella shape convex leftward. Further, the valve holder 61 is located at a rightmost position by the biasing force of the biasing spring 45 and the annular contact portion 62A thereof is stopped in contact with the step portion 43C of the communication opening 43. Thus, the sealing surface 67 is in contact with the sealing wall surface 43S.

The state of FIG. 29B is a state where the umbrella shape of the umbrella portion 661 of the umbrella valve 66 is inverted by the pressure applied from the side of the second chamber 42. That is, the umbrella portion 661 is deformed into an umbrella shape convex rightward. This inverted state is obtained when the pressure in the second chamber 42 becomes higher than that in the first chamber 41 by a predetermined value. In this embodiment, a case is assumed where a high positive pressure by pressurized purge is applied to the second chamber 42 and, as a result, the second chamber 42 is set to a higher pressure than in the first chamber 41 set at the atmospheric pressure+ρgh. The predetermined value depends on an inverted pressure of the umbrella portion 661. This inverted pressure is set at a value lower than the burst strength of the atmospheric pressure detection film 7 or the attachment strength of the atmospheric pressure detection film 7 to the second partition wall 421.

If the second chamber 42 is pressurized, the pressing member 5 does not rotate leftward. That is, the pressing member 5 generates no pressing force for pressing the on-off valve 6 leftward. This is because the atmospheric pressure detection film 7 is displaced to bulge rightward by a pressure increase of the second chamber 42 and applies no displacement force to the pressure receiving portion 5A. Thus, the valve holder 61 is maintained at the rightmost position by the biasing force of the biasing spring 45.

However, even if the valve holder 61 does not move, the sealing surface 67 is separated from the sealing wall surface 43S to create the gap g between the both by the inversion of the umbrella shape of the umbrella portion 661. Accordingly, the communication opening 43 is opened. In this way, the pressurized ink (pressure) in the second chamber 42 is allowed to escape (release) toward the first chamber 41 through the communication opening 43. Thus, it can be made possible to prevent an excessive force from acting on the atmospheric pressure detection film 7 itself or the attaching part thereof and prevent breakage.

[Flow of Ink in Each Mode]

Figure 30:
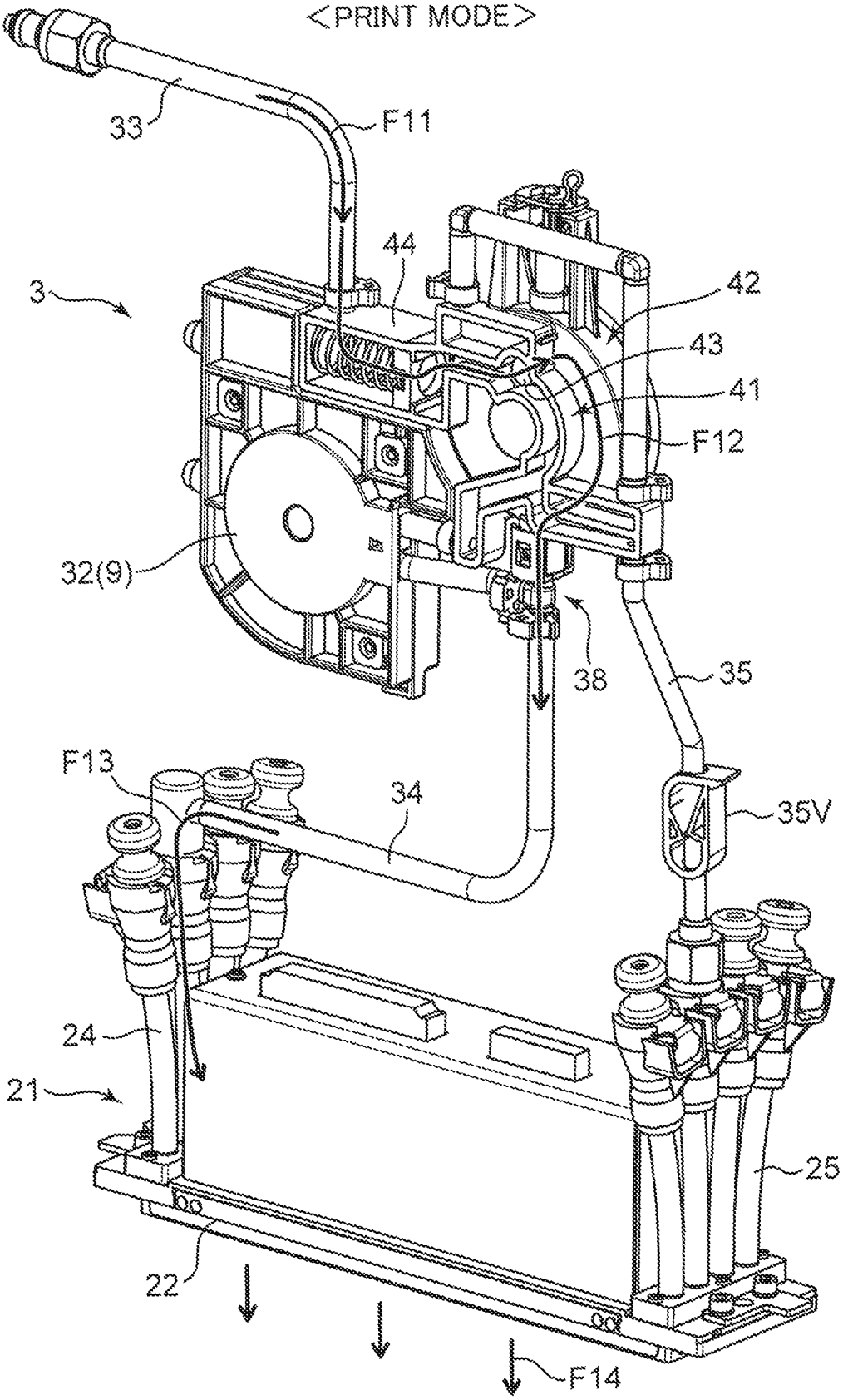
FIG. 30 is a perspective view showing a flow of ink in the print mode.
Figure 31:
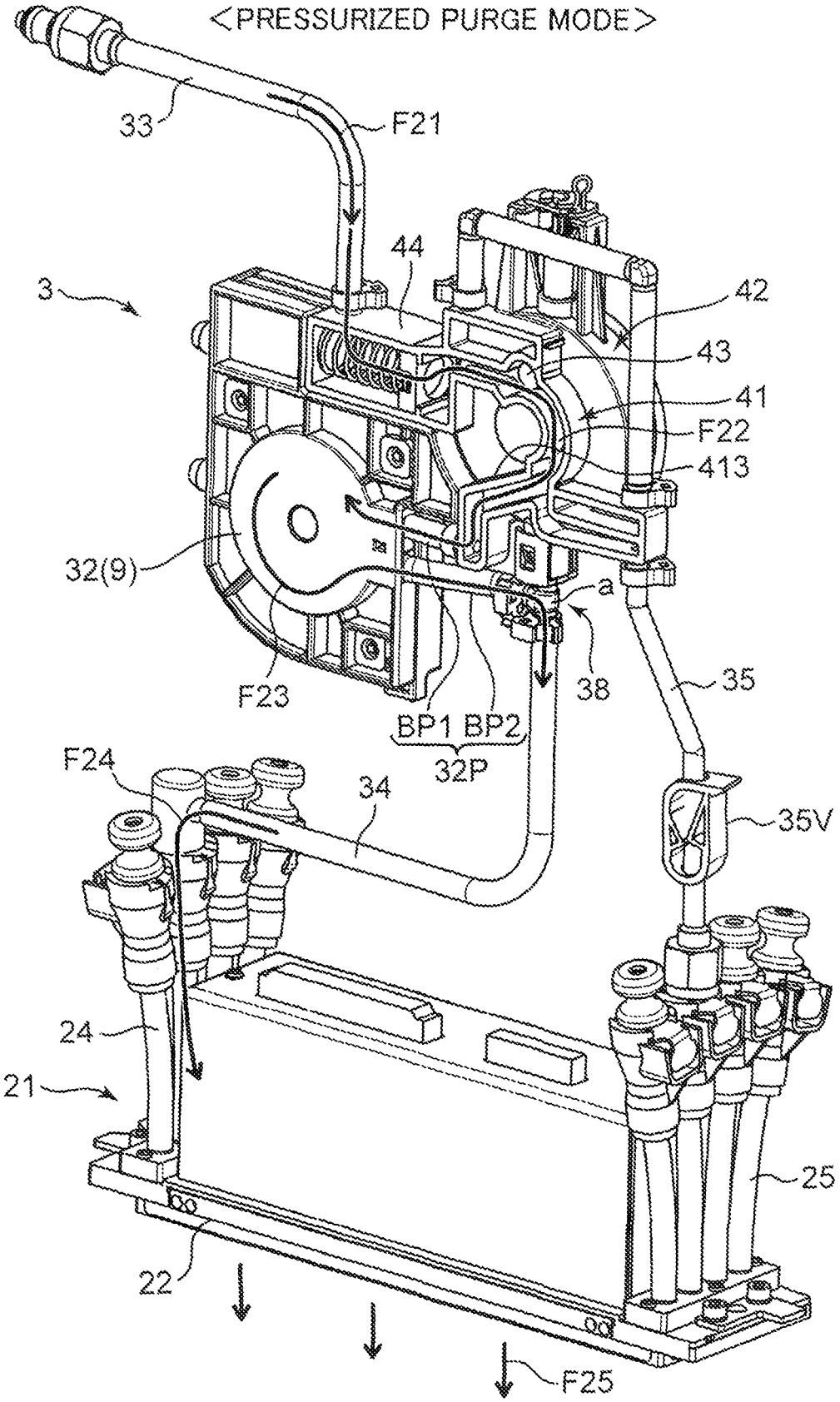
FIG. 31 is a perspective view showing a flow of the ink in the pressurized purge mode.
Figure 32:
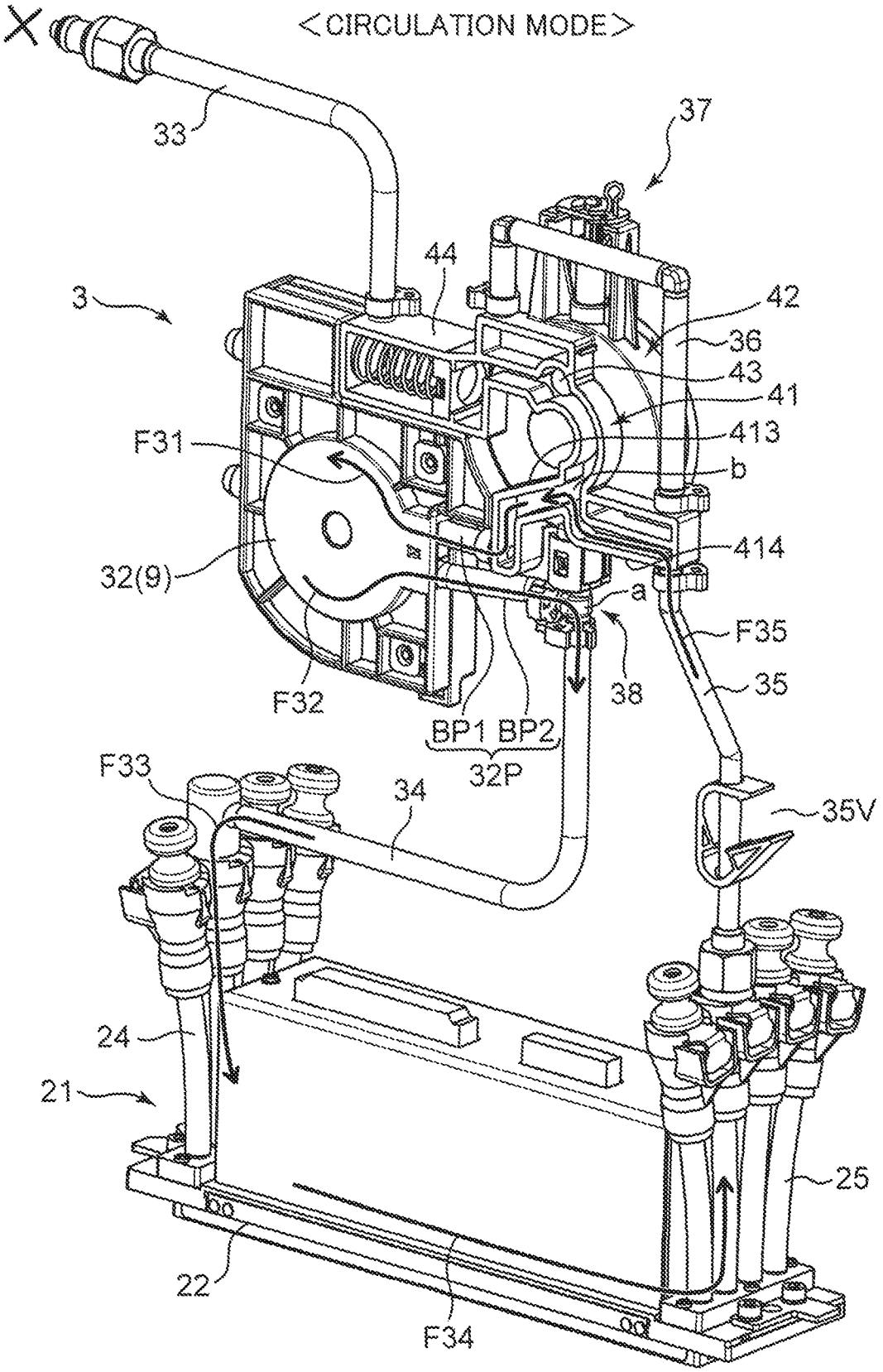
FIG. 32 is a perspective view showing a flow of the ink in the circulation mode.

Next, a flow of the ink in each mode of the liquid supply unit 3 is described. FIGS. 30, 31 and 32 are perspective views respectively showing flows of the ink in the print mode, in the pressurized purge mode and in the circulation mode.

In the print mode (FIG. 30), the return pipe 35 is closed by the clip 35V since the ink is not circulated using the return pipe 35. Of course, the supply valve 33V (FIG. 5) is opened. The ink discharged from the ink cartridge IC enters the filter chamber 44 through the upstream pipe 33 by the water head difference as indicated by an arrow F11 of FIG. 30. When the ink passes through the filter member 442 in this filter chamber 44, solid foreign matters contained in the ink are removed. Thereafter, the ink enters the first chamber 41.

When the on-off valve 6 is opened by the operation of the pressing member 5, the ink is stored into the second chamber 42 through the communication opening 43 from the first chamber 41 as indicated by an arrow F12. By an ink discharging operation in the ink discharging portion 22, the ink in the second chamber 42 is sucked and enters the downstream pipe 34 after successively passing through the supply hole 42H and the backflow prevention mechanism 38. Thereafter, the ink enters the common passage 27 (FIG. 6A) of the head unit 21 via the end tube 24 as indicated by an arrow F13. Then, the ink is discharged from the respective ink discharge holes 22H through the individual passages 26 (arrows F14).

Also in the pressurized purge mode (FIG. 31), the return pipe 35 is closed by the clip 35V since the ink is not circulated using the return pipe 35. The supply valve 33V is opened. In this pressurized purge mode, the pump 9 is driven in the forward rotation direction and the ink is forcibly supplied to the head unit 21 without depending on the water head difference. When the pump 9 is operated, the ink enters the filter chamber 44 through the upstream pipe 33 as indicated by an arrow F21 and further enters the first chamber 41. Then, the ink enters the bypass upstream pipe BP1 via the bypass communication chamber 413 without flowing toward the second chamber 42 as indicated by an arrow F22.

The ink is pressurized by the squeezing operation of the pump 9 and fed to the downstream side. Specifically, as indicated by an arrow F23, the ink is fed from the bypass downstream pipe BP2 to the downstream pipe 34. As described above, since the backflow prevention mechanism 38 is provided in the joint part a of the bypass downstream pipe BP2 to the downstream pipe 34, the ink does not flow back to the second chamber 42. Thereafter, as indicated by an arrow F24, the ink enters the common passage 27 (FIG. 6A) of the head unit 21 via the end tube 24. Then, the ink is discharged at a high pressure from the respective ink discharge holes 22H through the individual passages 26 (arrows F25). In this way, foreign matters clogging the ink discharge holes 22H, air staying in the individual passages 26 and the like are removed.

In the circulation mode (FIG. 32), the closed state by the clip 35V is released and the return pipe 35 is opened to circulate the ink using the return pipe 35. On the other hand, since the ink is circulated between the liquid supply unit 3 and the head unit 21, the supply valve 33V (FIG. 5) is closed. In this way, a closed ink circulation path composed of the bypass pipe 32P, the downstream pipe 34, the common passage 27 of the head unit 21, the return pipe 35, the return communication chamber 414 and the bypass communication chamber 413 is formed. Also in this circulation mode, the pump 9 is driven in the forward rotation direction as described on the basis of FIG. 8.

When the pump 9 operates, the circulation of the ink in the ink circulation path starts. Specifically, by the operation of the pump 9, the ink is sucked into the bypass upstream pipe BP1 from the bypass communication chamber 413 as indicated by an arrow F31 and, subsequently, fed to the bypass downstream pipe BP2 as indicated by an arrow F32. Thereafter, the ink flows into the head unit 21 via the joint part a, the downstream pipe 34 and the end tube 24 (arrow F33), passes through the common passage 27 in the head unit 21 and enters the collection tube 25 (arrow F34). Then, as indicated by an arrow F35, the ink returns to the bypass communication chamber 413 after successively passing through the return pipe 35, the return communication chamber 414 and the joint part b from the collection tube 25. At this time, since the supply valve 33V is closed, the return pipe 35 and the common passage 27 from which the ink is sucked by the pump 9 are set to the negative pressure. Thus, the ink does not leak from the ink discharge holes 22H during ink circulation.

When the circulation mode is performed, the ink can be circulated in the ink circulation path as described above. In other words, the ink once fed to the head unit 21 can be returned toward the liquid supply unit 3 using the return pipe 35. Thus, even if air is mixed into the head unit 21 such as due to the feed of the ink containing the air, this air can be collected toward the liquid supply unit 3 together with the ink by the circulation. The air (air bubbles) collected toward the liquid supply unit 3 enters the first chamber 41 located above from the return communication chamber 414 by buoyancy, and moves from the communication opening 43 arranged near the uppermost part of the first chamber 41 to the second chamber 42. The operator can allow the air to escape to outside from the second chamber 42 by operating the air vent mechanism 37 at an appropriate timing while confirming an air staying status in the second chamber 42 using the monitor pipe 36.

As described above, air can be prevented from staying near the individual passages 26 and the ink discharge holes 22H of the head unit 21 by performing the circulation mode. Air having entered the head unit 21 can be removed also by the pressurized purge mode. However, the air having once entered the head unit 21 cannot be easily vented and the pressurized purge mode for discharging a considerable amount of the ink needs to be performed in some cases. Thus, the problem is that a large amount of the ink is consumed only to vent air from the head unit 21. However, since the ink is circulated to collect air into the liquid supply unit 3 according to the circulation mode, the ink is not consumed. Further, in the circulation mode, it is sufficient to circulate the ink in the ink circulation path and the ink needs not be pressurized unlike in the pressurized purge mode. Thus, it is sufficient to operate the pump 9 at a low speed. Therefore, the application of a large pressure load to the liquid supply unit 3 can be avoided, and the breakage of the atmospheric pressure detection film 7 and the sealing film 7A can be prevented.

[Liquid Injection Head of Second Embodiment]

Figure 33C:
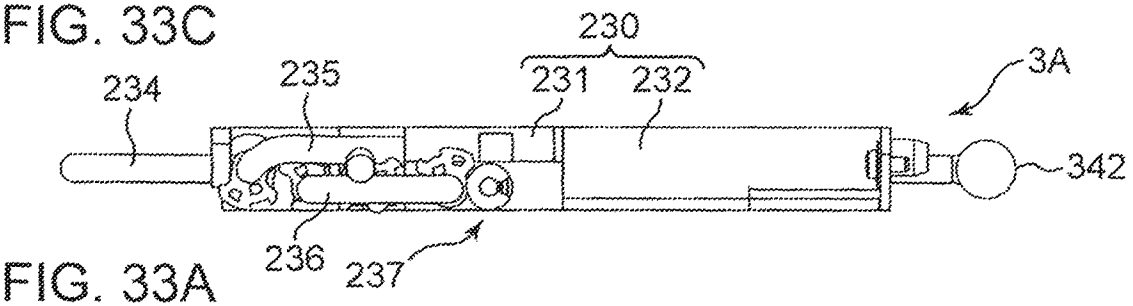
FIG. 33B is a side view of the liquid supply unit and FIG. 33C is a top view of the liquid supply unit.
Figure 33A:
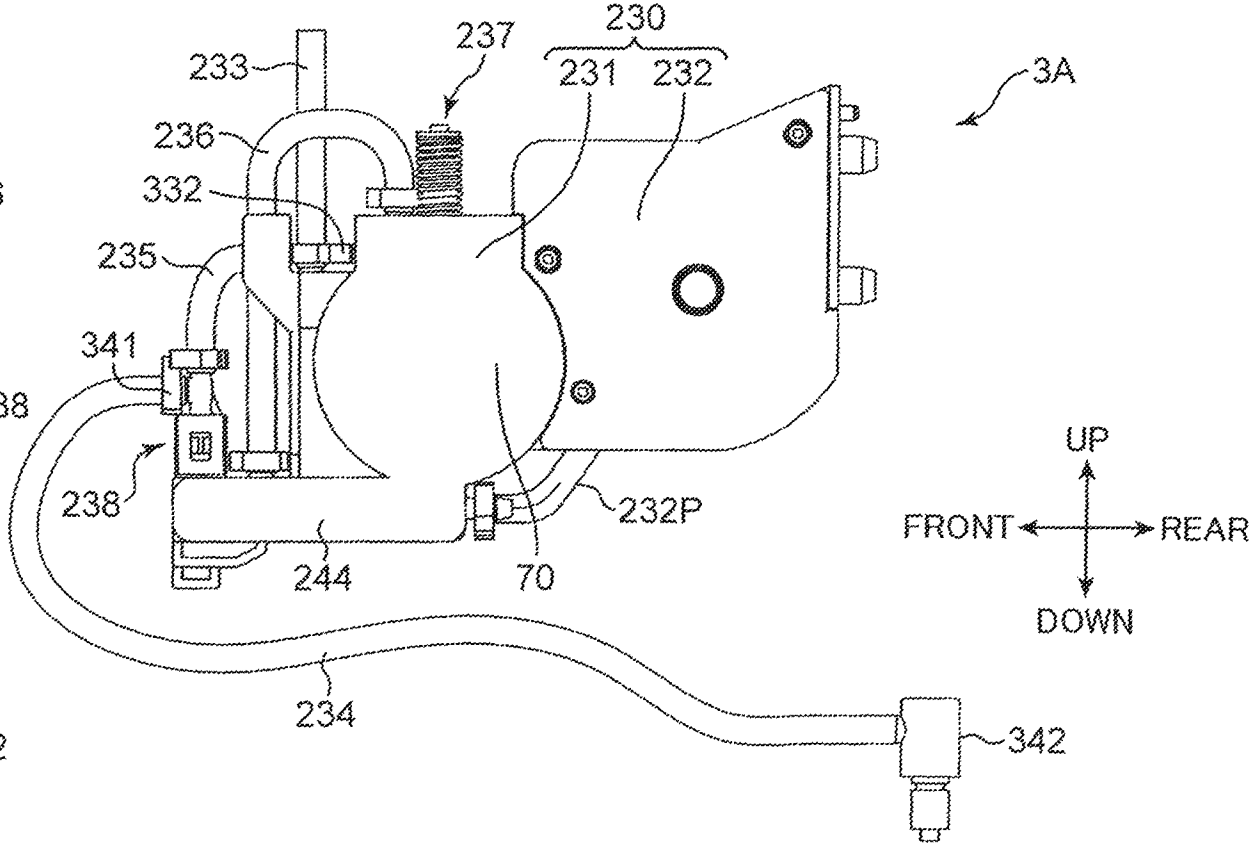
FIG. 33A is a front view of a liquid supply unit according to a second embodiment.
Figure 33B:
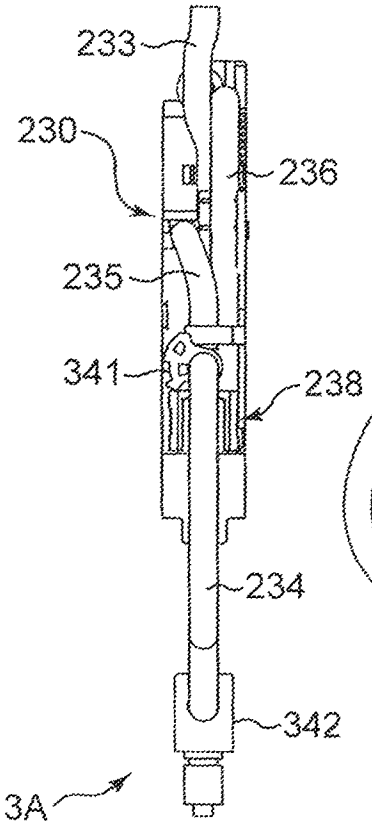
Figure 34:
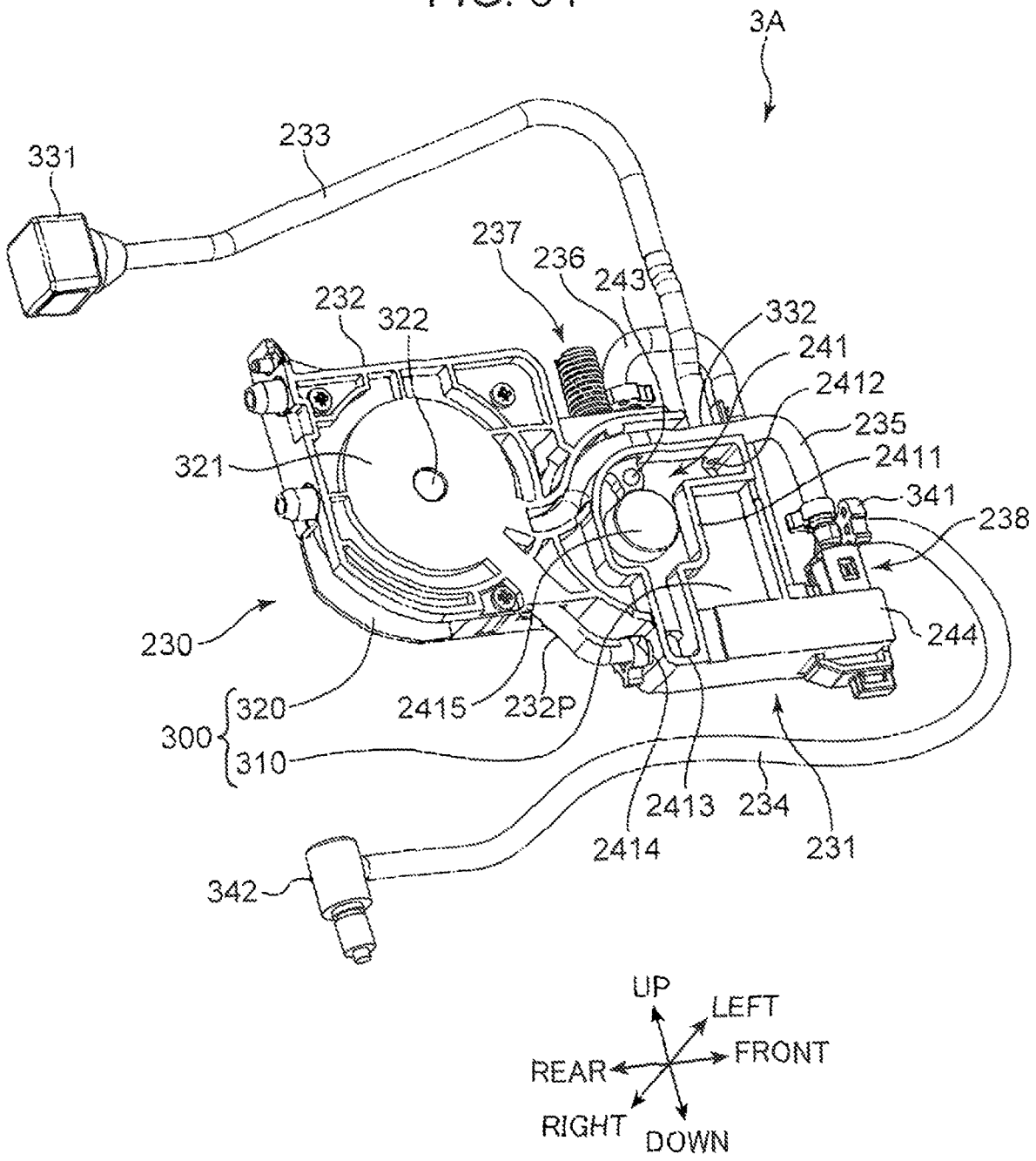
FIG. 34 is a perspective view showing an internal structure of the liquid supply unit of the second embodiment.
Figure 35:
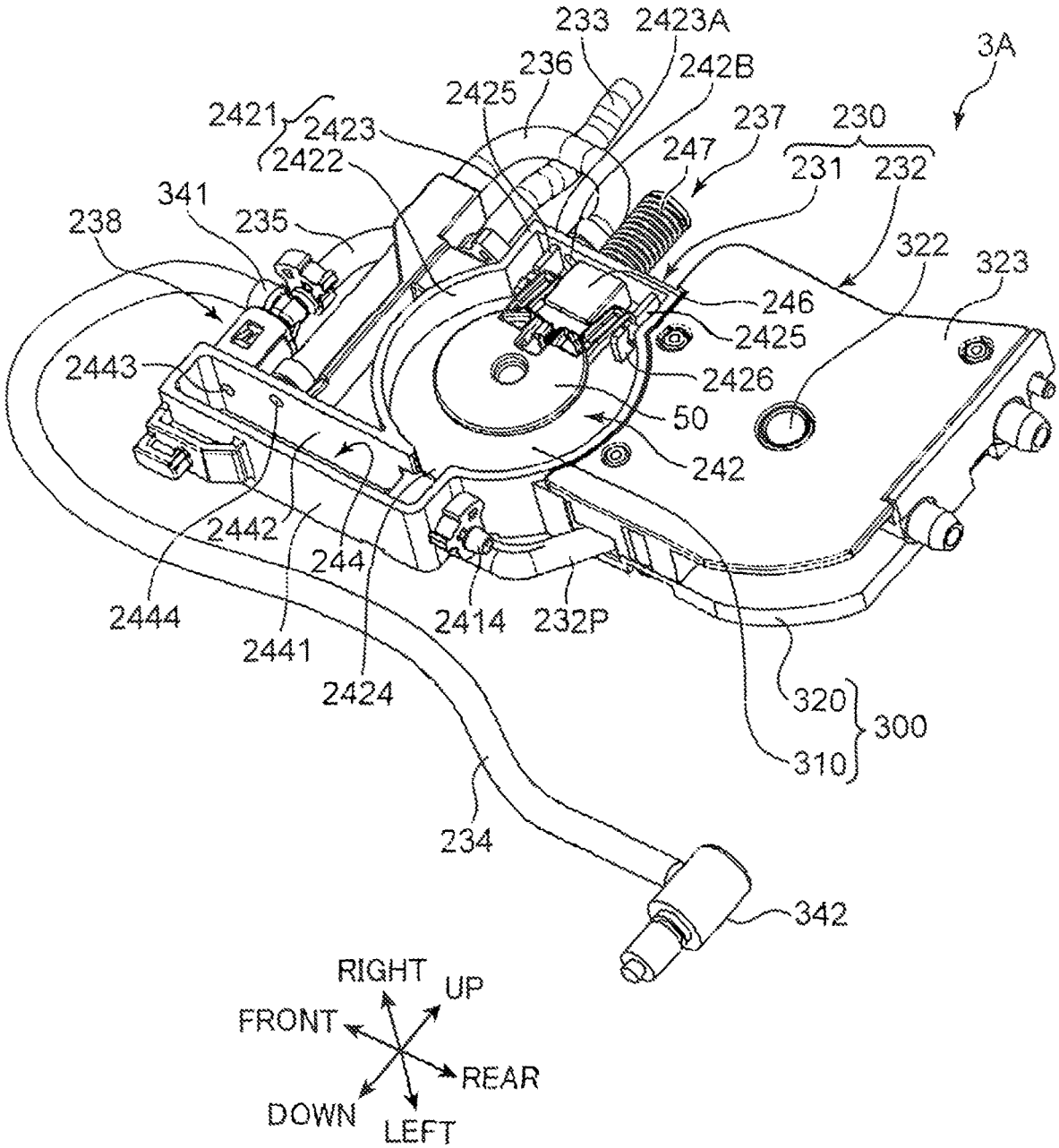
FIG. 35 is a perspective view showing the internal structure of the liquid supply unit of the second embodiment.
Figure 36A:
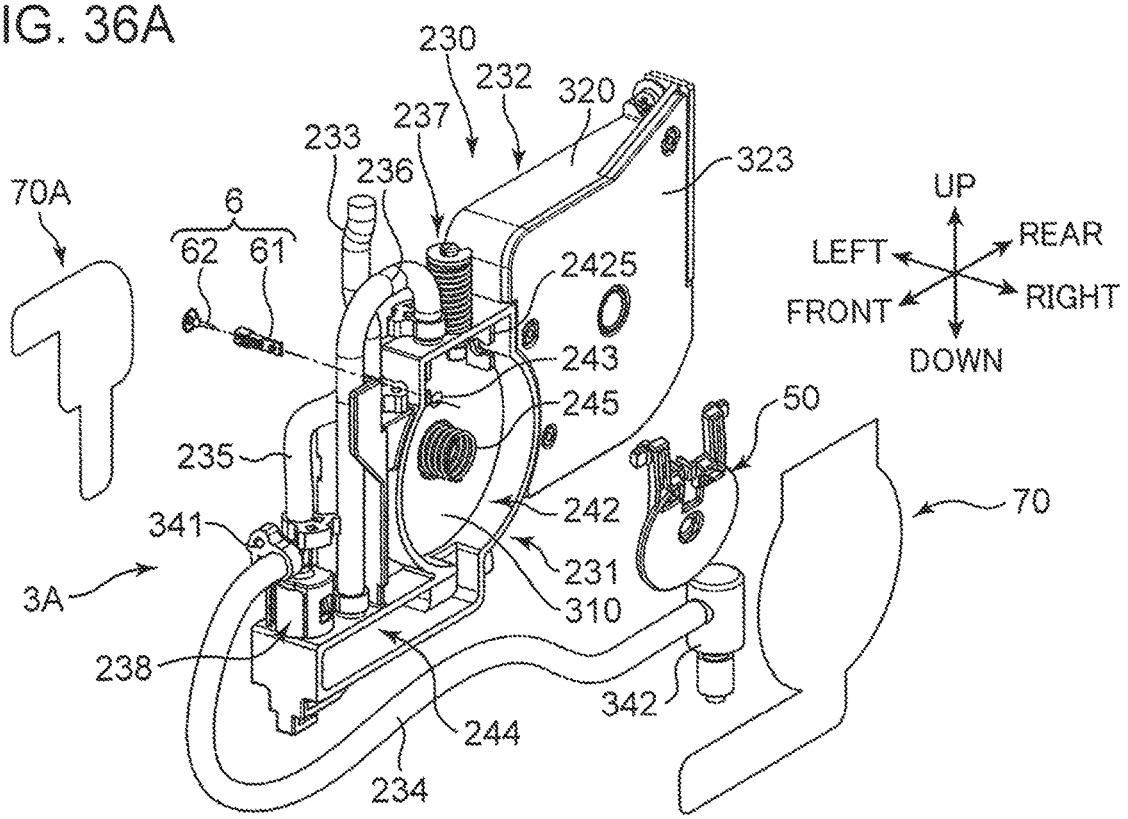
FIG. 36A is an exploded perspective view of the liquid supply unit and FIG. 36B is an exploded perspective view of the liquid supply unit viewed in a different direction.
Figure 36B:
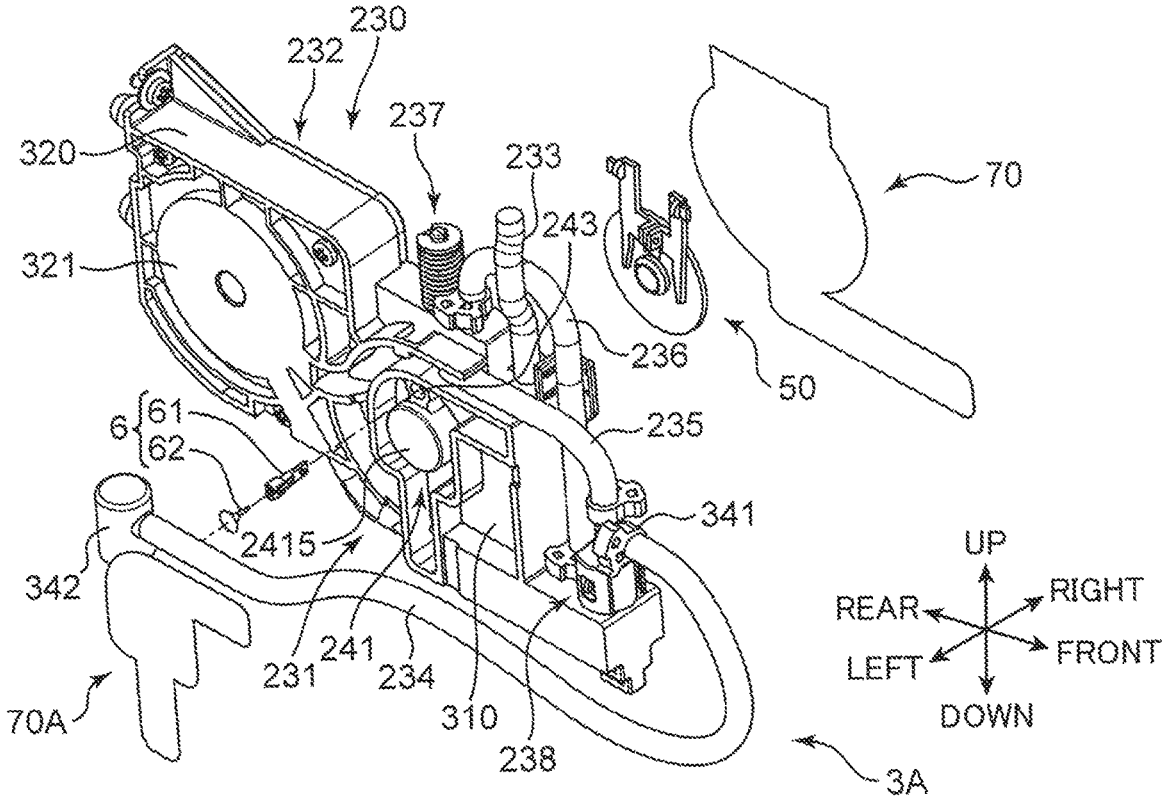
Figure 37:
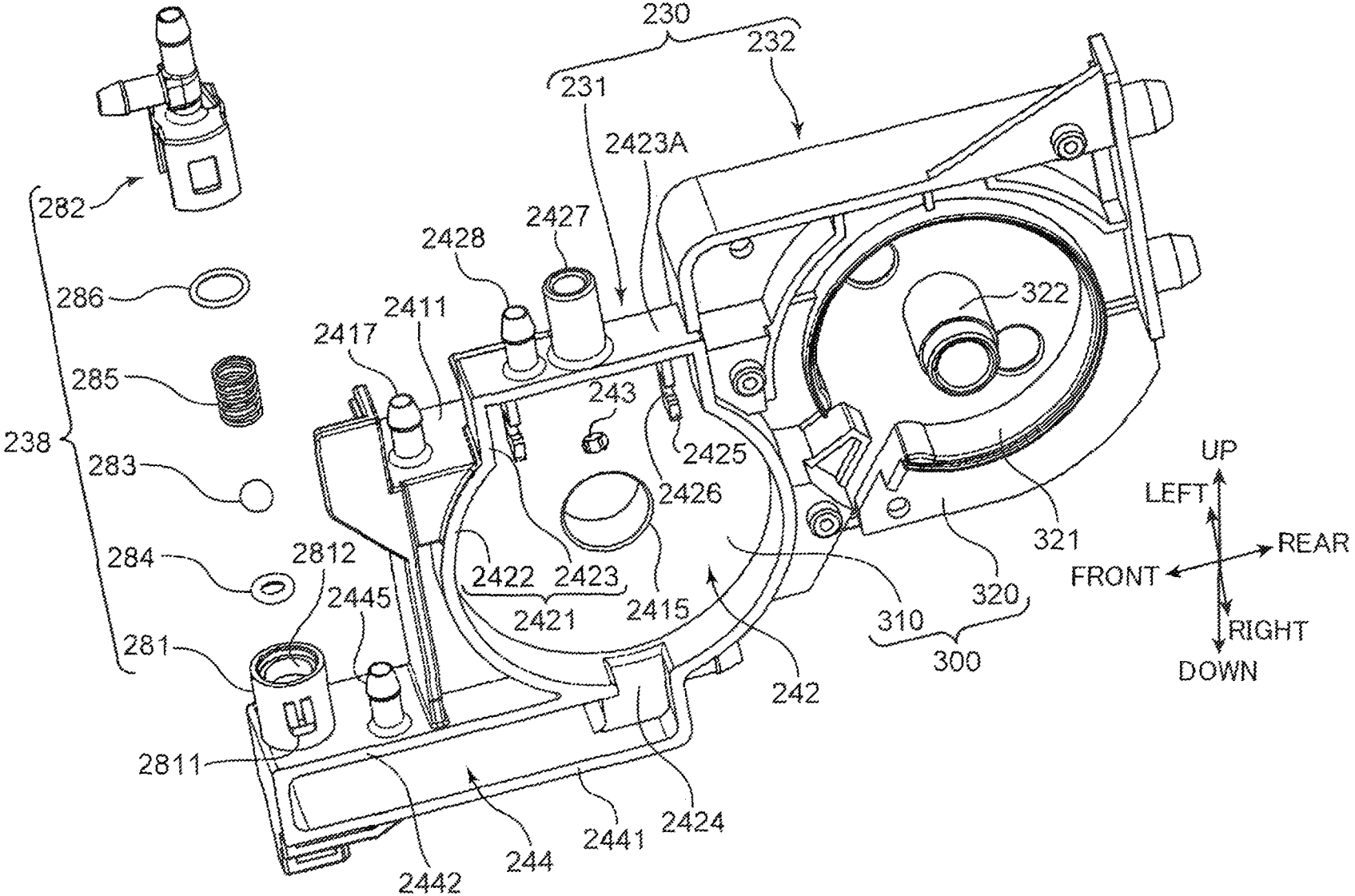
FIG. 37 is a perspective view of a body portion of the liquid supply unit including an exploded perspective view of a backflow prevention mechanism of the liquid supply unit.

Next, a liquid supply unit 3A according to a second embodiment having a structure different from that of the liquid supply unit 3 described above is described. FIG. 33A is a front view of the liquid supply unit 3A, FIG. 33B is a side view thereof, and FIG. 33C is a top view thereof. FIGS. 34 and 35 are perspective views showing an internal structure of the liquid supply unit 3A on the side of a first chamber 241 and on the side of a second chamber 242. FIGS. 36A, 36B are exploded perspective views of the liquid supply unit 3A viewed from the side of the second chamber 242 and the side of the first chamber 241. FIG. 37 is a perspective view of a body portion 230 including an exploded perspective view of a backflow prevention mechanism 238.

The liquid supply unit 3A includes the body portion 230 having a tank portion 231 and a pump portion 232, an upstream pipe 233, a downstream pipe 234, a bypass pipe 235, an air vent mechanism 237, the backflow prevention mechanism 238, a pressing member 50, an on-off valve 6 and an atmospheric pressure detection film 70. Besides these, the liquid supply unit 3A includes a monitor pipe 236 for monitoring an ink liquid surface in the second chamber 242, a communication pipe 232P allowing communication between the pump portion 232 and the first chamber 241 and a sealing film 70A constituting a part of a wall surface defining the first chamber 241.

The body portion 230 includes a base board 300 formed of a flat plate extending in the front-rear direction. A front side of the base board 300 is a tank portion base plate 310 (wall portion) serving as a board of the tank portion 231 and a rear side thereof is a pump portion housing 320 forming a housing structure in the pump portion 232. The first chamber 241 (upstream chamber) is arranged on a left surface side of the tank portion base plate 310, and the second chamber 242 (pressure chamber) is arranged on a right surface side thereof. The tank portion base plate 310 is perforated to form a communication opening 243 allowing communication between the first chamber 241 and the second chamber 242. The same on-off valve 6 as in the first embodiment is arranged in this communication opening 243.

The first chamber 241 is roughly L-shaped in a plan view. The first chamber 241 is defined by a first partition wall 2411 projecting leftward from the tank portion base plate 310. An inflow opening 2412 for ink is perforated in a wall of an uppermost part of the first partition wall 2411. An inflow port 2417 (FIG. 37) formed of a receiving plug stands on an outer side surface of the first partition wall 2411 in correspondence with the inflow opening 2412 for the ink. A downstream end 332 of the upstream pipe 233 is inserted and connected to this inflow port 2417. That is, the inflow opening 2412 is an opening allowing communication between an ink cartridge IC and the first chamber 241, and the ink flows into the first chamber 241 through this inflow opening 2412 by a water head difference.

A bottom wall portion 2413 of the first partition wall 2411 is located on the lower end of the tank portion base plate 310. A purge port 2414 is provided in a rear side wall of the first partition wall 2411 near the bottom wall portion 2413. An upstream end of the communication pipe 232P is connected to this purge port 2414. A spring seat 2415 formed of a hollow cylindrical cavity projects near a vertical center of the first chamber 241. The spring seat 2415 is a cavity for housing a biasing spring 245, and open toward the second chamber 242.

The communication opening 243 is located above the spring seat 2415 in the first chamber 241. The first chamber 241 is a chamber in which a decompression process and the like are not performed and to which a pressure $P=\rho gh$ by the water head difference is applied in addition to an atmospheric pressure. When the ink flows through the inflow opening 2412, the ink starts being pooled from the bottom wall portion 2413. When an ink liquid level exceeds the communication opening 243, the ink can be supplied into the second chamber 242 through this communication opening 243. Further, when a pump 9 housed in the pump portion 232 is operated, the ink stored in the first chamber 241 is sucked through the purge port 2414 and the communication pipe 232P and the pressurized ink is supplied to the head unit 21 through the bypass pipe 235 and the downstream pipe 234.

With reference to FIGS. 35 and 37, the second chamber 242 roughly has a circular shape in a plan view. The second chamber 242 is defined by a second partition wall 2421 projecting rightward from the tank portion base plate 310. The second partition wall 2421 includes a hollow cylindrical wall 2422 having a hollow cylindrical shape and an upper wall 2423 formed of a rectangular part projecting further upward than the hollow cylindrical wall 2422. The aforementioned spring seat 2415 is recessed in the tank portion base plate 310 at a center position of a region surrounded by the hollow cylindrical wall 2422, i.e. at a position concentric with the hollow cylindrical wall 2422. The communication opening 243 is arranged on the spring seat 2415 on a vertical line passing through a center point of the spring seat 2415.

A communication chamber 244 (part of the second supply passage) is connected to the lower end of the second chamber 242. The communication chamber 244 is a rectangular space elongated in the front-rear direction and extends straight forward from the lower end of the hollow cylindrical wall 2422. The communication chamber 244 is defined by a wall portion 2441. A lower passage 2424 allowing communication between the second chamber 242 and the communication chamber 244 is provided on the lower end of the hollow cylindrical wall 2422. The wall portion 2441 is linked to the hollow cylindrical wall 2422 at the position of the lower passage 2424. The communication chamber 244 is a space linking the second chamber 242 and the downstream pipe 234 and set to a negative pressure, and substantially constitutes a part of the second chamber 242.

In a region surrounded by the upper wall 2423 of the second chamber 242, a pair of front and rear supporting plates 2425 project rightward from the tank portion base plate 310. Each of the pair of supporting plates 2425 includes a pivotally supporting portion 2426 for pivotally supporting the pressing member 50 to be described later. A boss portion 2427 and an upper monitor port 2428 project upward on a top wall 2423A constituting an uppermost part of the upper wall 2423 (defining a top wall of the second chamber 242). The boss portion 2427 internally includes a boss hole, which is an opening allowing the second chamber 242 to communicate with the atmosphere. This boss portion 2427 constitutes a part of the air vent mechanism 237, and a lever member 246 and a return spring 247 are assembled therewith.

On the top wall 2423A, an upper monitor hole 242B is perforated in front of the boss portion 2427. Further, a top wall 2442 of the wall portion 2441 defining the communication chamber 244 is perforated with a lower monitor hole 2444. The upper monitor port 2428 stands on the top wall 2423A in correspondence with the upper monitor hole 242B. A lower monitor port 2445 stands on the top wall 2442 in correspondence with the lower monitor hole 2444. The upper end of the monitor pipe 236 is connected to the upper monitor port 2428, and the lower end thereof is connected to the lower monitor port 2445. That is, the monitor pipe 236 communicates with upper and lower end sides of the second chamber 242 and the ink liquid level in the monitor pipe 236 is linked with that in the second chamber 242. The monitor pipe 236 is formed of a transparent resin tube. Accordingly, a user can know the ink liquid level in the second chamber 242 by seeing the monitor pipe 236.

The backflow prevention mechanism 238 is installed on the top wall 2442 near the front end of the communication chamber 244. The top wall 2442 is perforated with a supply hole 2443 in correspondence with the backflow prevention mechanism 238. An upstream end 341 of the downstream pipe 234 is connected to the backflow prevention mechanism 238. The ink stored in the second chamber 242 is supplied to the downstream pipe 234 through the support hole 2443 and the backflow prevention mechanism 238 by being sucked by the ink discharging portion 22 (FIG. 5). The backflow prevention mechanism 238 is described in detail later.

With reference to FIGS. 36A and 36B, an opening in a left surface side of the first chamber 241 is sealed by the sealing film 70A made of resin. The sealing film 70A has an outer shape matching a wall shape of the first partition wall 2411 viewed from left. A peripheral edge part of the sealing film 70A is welded or adhered to an end surface of the first partition wall 2411, whereby the sealing film 70A seals the opening of the first chamber 241.

An opening in a right surface side of the second chamber 242 is sealed by the atmospheric pressure detection film 70 made of a flexible resin film member. The atmospheric pressure detection film 70 has an outer shape matching a wall shape of an integral assembly of the second partition wall 2421 of the second chamber 242 and the wall portion 2441 of the communication chamber 244. The atmospheric pressure detection film 70 seals the openings of the second chamber 242 and the communication chamber 244 by being welded or adhered to an end surface of the hollow cylindrical wall 2422, an end surface of the upper wall 2423 and the end surface of the wall portion 2441. Note that the atmospheric pressure detection film 70 is welded or adhered without particular tension being applied thereto.

The pump portion 232 is arranged behind and adjacent to the tank portion 231 and includes a pump cavity 321 for housing the pump 9 and a cam shaft insertion hole 322 into which a cam shaft 93 (FIG. 4) for pivotally supporting an eccentric cam 91 of the pump 9 is inserted. An opening in a right surface side of the pump cavity 321 is sealed by a pump cover 323.

[Negative Pressure Supply Mechanism of Second Embodiment]

The liquid supply unit 3A according to the second embodiment also includes a negative pressure supply mechanism for supplying the ink from the first chamber 241 to the second chamber 242 as the ink in the second chamber 242 decreases. The second embodiment has the same basic configuration as the first embodiment, but differs in that the pressing member 50 presses the on-off valve 6, utilizing the principle of leverage.

Figure 38A:
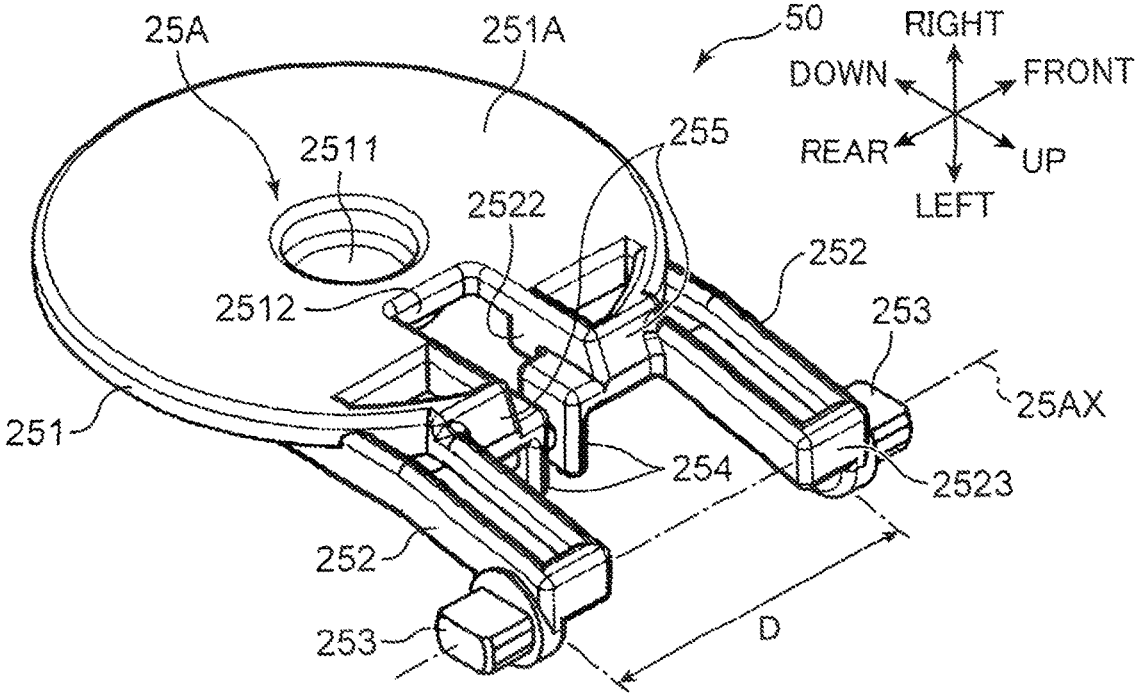
FIG. 38A is a perspective view of a pressing member of the second embodiment and FIG. 38B is a perspective view of the pressing member viewed in a different direction.
Figure 38B:
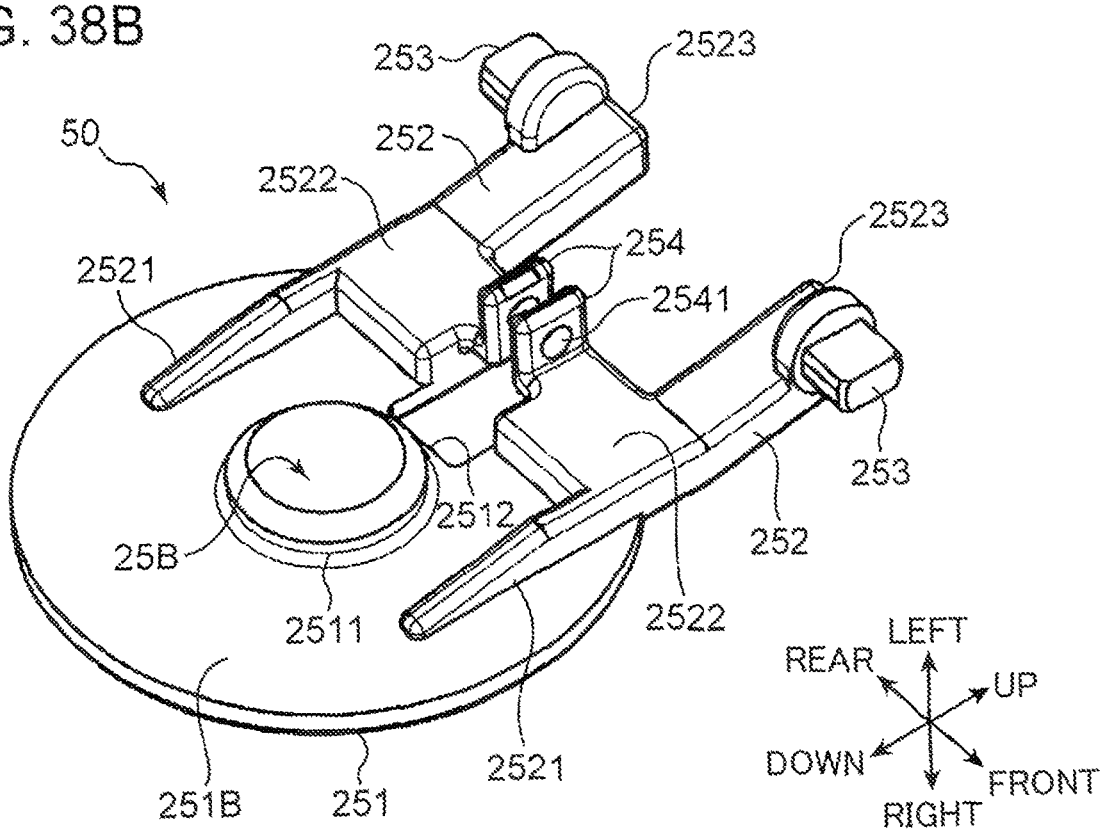

FIGS. 38A and 38B are perspective views of the pressing member 50 viewed in different directions. The pressing member 50 is a member rotatably arranged in the second chamber 242. The pressing member 50 includes a disk portion 251 formed of a circular flat plate, a pair of arm portions 252 extending outward from an upper end side of the disk portion 251, pivot portions 253 provided on extending tip parts of the respective arm portions 252 and a pair of link bosses 254. The pair of pivot portions 253 are pivotally supported by the pivotally supporting portions 2426 (FIGS. 35 and 37) of the pair of supporting plates 2425 arranged in the second chamber 242. In this way, the disk portion 251 is rotatable about an axis of the pivot portions 253. The pressing member 5 of the first embodiment is rotatably supported on the lower end side, but the pressing member 50 of the second embodiment differs from the former pressing member 5 in being rotatably supported on an upper end side.

The disk portion 251 is a disk having a diameter, which is about half the inner diameter of the hollow cylindrical wall 2422 defining most of the second chamber 242. The hollow cylindrical wall 2422 and the disk portion 251 in a state pivotally supported by the pivotally supporting portions 2426 are substantially concentrically arranged. The disk portion 251 has a first surface 251A facing the atmospheric pressure detection film 70 and a second surface 251B facing the on-off valve 6. A spring fitting projection 2511 is provided to project from the second surface 251B in a radial center of the disk portion 251. A right end part of the biasing spring 245 formed of a coil spring is fit to this spring fitting projection 2511. Note that a region of the spring fitting projection 2511 is formed into a cylindrical recess on the side of the first surface 251A.

The disk portion 251 includes a pressure receiving portion 25A for receiving a displacement force from the atmospheric pressure detection film 70 and a biased portion 25B for receiving a biasing force from the biasing spring 245. The pressure receiving portion 25A is a region of a peripheral edge part of the spring fitting projection 2511 on the first surface 251A of the disk portion 251. The biased portion 25B is a region of the spring fitting projection 2511, to which the biasing spring 245 is fit, on the side of the second surface 251B. Specifically, the biased portion 25B is set at a position corresponding to the pressure receiving portion 25A.

If the pressure receiving portion 25A receives no displacement force from the atmospheric pressure detection film 70, the disk portion 251 is in a state close to a naturally hanging state. However, the right end of the biasing spring 245 is in contact with the biased portion 25B and the first surface 251A is in contact with the inner surface of the atmospheric pressure detection film 70. On the other hand, if the pressure receiving portion 25A receives a displacement force equal to or larger than the biasing force of the biasing spring 245 from the atmospheric pressure detection film 70, the disk portion 251 rotates leftward about the axis of pivot portions 253 and is inclined leftward from the hanging state.

Lower end parts 2521 of the pair of arm portions 252 are respectively located on both lateral parts of the spring fitting projection 2511, whereby the spring fitting projection 2511 is positioned to be sandwiched by a pair of the lower end parts 2521. The pair of arm portions 252 extend straight upward from the respective lower end parts 2521. A cutout portion 2512 cut along a radial direction is provided in the disk portion 251 between the pair of arm portions 252. The pair of arm portions 252 extend in parallel from the disk portion 251 with this cutout portion 2512 therebetween.

Rectangular thick portions 2522 are provided at vertical intermediate positions of the respective arm portions 252. The thick portions 2522 are arranged near the upper end of the disk portion 251 and lateral to the cutout portion 2512. That is, a pair of the thick portions 2522 face each other in the front-rear direction across the cutout portion 2512. The pivot portion 253 projects in the front-rear direction from a tip part 2523, which is an extending end of each arm portion 252. In particular, the pivot portions 253 project in directions separating from each other such that the pivot portion 253 projects forward from the front surface of the front tip part 2523 and the pivot portion 253 projects rearward from the rear surface of the rear tip part 2523. The pivot portions 253 are fit into the pivotally supporting portions 2426 of the pivot portions 2425. It contributes to increasing a leverage ratio to be described later to provide the pivot portions 253 on the extending tip parts of the arm portions 252.

The pair of pivot portions 253 are arranged on an axis of rotation 25AX extending in the front-rear direction. The front and rear pivot portions 253 are arranged at a predetermined distance D from each other. That is, the pair of pivot portions 253 are arranged apart from each other across a part equivalent to a central region in a plane direction of the disk portion 251. The distance D can be set to about 40% to 80% of a diameter of the disk portion 251. In this way, pivot points formed by the pair of pivot portions 253 are pivot points spaced wide apart to sandwich the central region of the disk portion 251. Thus, the disk portion 251 rotating about the pivot points is less likely to be twisted about an axis perpendicular to the axis of rotation 25AX. Therefore, the rotating operation of the disk portion 251 can be stabilized.

The pair of link bosses 254 project leftward from the second surface 251B near the upper end of the disk portion 251. In particular, the link bosses 254 formed of rectangular flat plates respectively stand from end edges of the pair of thick portions 2522 facing the cutout portion 2512. Accordingly, the pair of link bosses 254 are located inwardly of the pair of pivot portions 253 in the central region of the disk portion 251. Each link boss 254 includes a link hole 2541. This link hole 2541 is used to link and connect the pressing member 50 and the on-off valve 6 shown in the first embodiment. By this link connection, opening and closing operations of the on-off valve 6 are linked with the rotating operation of the pressing member 50.

In other words, the link bosses 254 serve as pressing portions for pressing and moving the on-off valve 6 in the lateral direction according to the rotating operation of the pressing member 50 rotating about the axis of the pivot portions 253. In a relationship of the pressure receiving portion 25A (point of force application) and the pivot portions 253 (fulcrum), the link bosses 254 (point of action) are set between the pressure receiving portion 25A and the pivot portions 253. That is, the pressure receiving portion 25A, the pivot portions 253 and the link bosses 254 are set to satisfy a positional relationship of a second class lever. Thus, a pressing force can be applied to the on-off valve 6 from the link bosses 254 by increasing the displacement force of the atmospheric pressure detection film 70 received by the pressure receiving portion 25A by the leverage ratio.

Figure 39A:
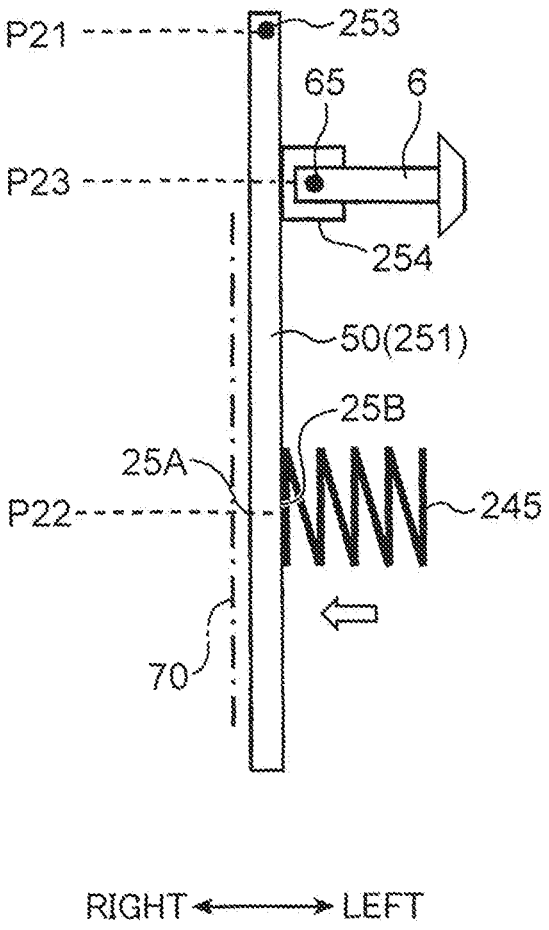
FIGS. 39A and 39B are diagrams showing the operation of the pressing member utilizing a leverage ratio.
Figure 39B:
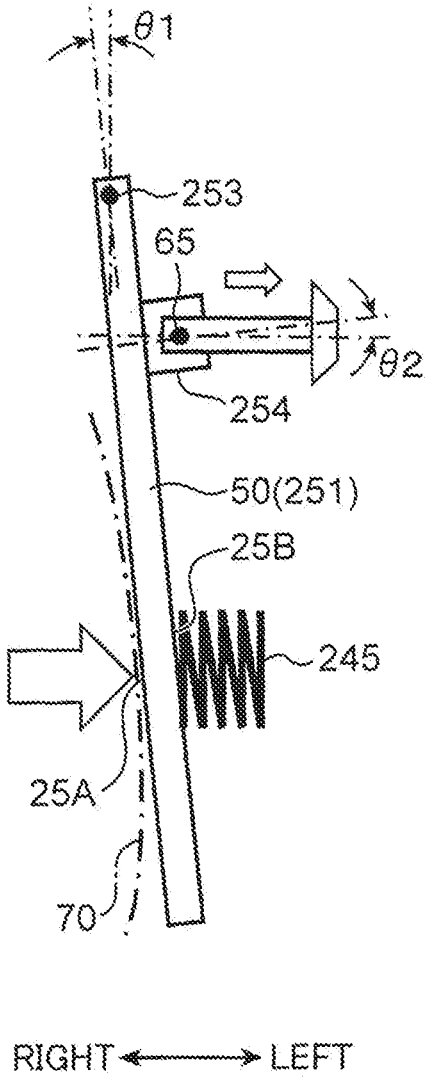

The operation of the negative pressure supply mechanism of the second embodiment including the above pressing member 50 is described using diagrams of FIGS. 39A and 39B. FIG. 39A shows a state where the pressing member 50 (disk portion 251) is in the hanging posture and the on-off valve 6 is in the closing posture, and FIG. 39B shows a state where the pressing member 50 is rotated to reach an oblique posture and the on-off valve 6 is in the opening posture.

The state of FIG. 39A is a state where the atmospheric pressure detection film 70 does not generate such a displacement force as to rotate the disk portion 251, i.e. a state where the sum of a spring pressure of the biasing spring 245 and an internal pressure of the second chamber 242 exceeds the atmospheric pressure. Although the second chamber 242 is at a negative pressure, the biasing spring 245 biases the biased portion 25B with a biasing force exceeding the displacement force of the atmospheric pressure detection film 70 by the negative pressure. Thus, the disk portion 251 does not rotate about the axis of the pivot portions 253 and is maintained in the hanging posture described above.

When a negative pressure degree of the second chamber 242 increases by the consumption of the ink and the second chamber 242 reaches a negative pressure exceeding a predetermined value, the atmospheric pressure detection film 70 applies a pressing force acting against the biasing force of the biasing spring 245 to the pressure receiving portion 25A of the disk portion 251. Specifically, a state is entered where the sum of the spring pressure of the biasing spring 245 and the inner pressure of the second chamber 242 is smaller than the atmospheric pressure. In this case, the disk portion 251 rotates leftward about the axis of the pivot portions 253 against the biasing force of the biasing spring 245 as shown in FIG. 39B. Then, by this rotation, the link bosses 254 generate a pressing force for moving the on-off valve 6 leftward to change the posture of the on-off valve 6 to the opening posture.

According to the pressing member 50 of the second embodiment, the link bosses 254 can be caused to generate a large pressing force, utilizing a lever force. Specifically, the link bosses 254 for pressing the on-off valve 6 are arranged between the pressure receiving portion 25A and the pivot portions 253. That is, the pressing member 50 realizes a pressing structure for the on-off valve 6 utilizing the principle of leverage with the pivot points by the pivot portions 253 serving as a fulcrum P21, the pressure receiving portion 25A serving as a point of force application P22 and the link bosses 254 serving as a point of action P23. Accordingly, a pressing force applied to the pressure receiving portion 25A by a displacement force of the atmospheric pressure detection film 70 can be applied from the link bosses 254 to the on-off valve 6 while being increased by the leverage ratio. Thus, the link bosses 254 can be caused to press the on-off valve 6 by a large pressing force and a sufficient pressing force for timely moving the on-off valve 6 can be ensured.

The pressing member 50 includes the arm portions 252 extending upward from the upper end side of the disk portion 251, and the pivot portions 253 serving as the pivot points are provided on the extending tip parts 2523 of the arm portions 252. This configuration contributes to extending a distance between the pressure receiving portion 25A (point of force application P22) and the link bosses 254 (point of action P23) and increasing the leverage ratio. Thus, the pressing force generated by the pressing member 50 can be made even larger.

[Backflow Prevention Mechanism of Second Embodiment]

Figure 40C:
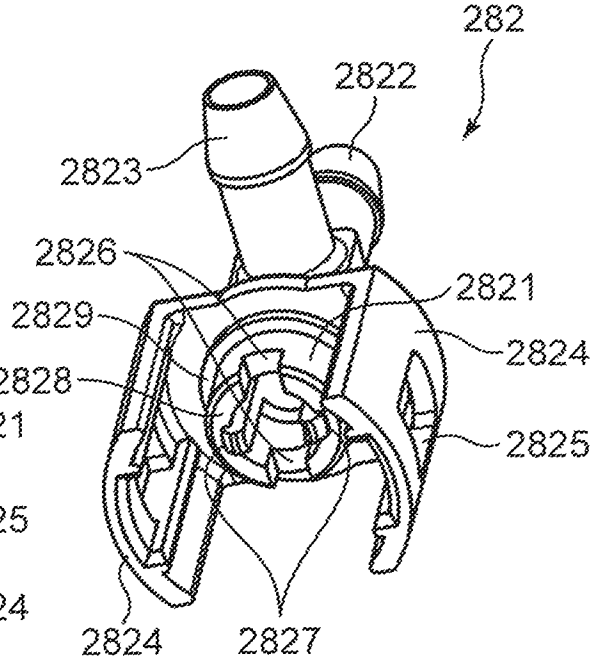
FIG. 40B is a view showing a state where the valve conduit is closed by the spherical body and FIG. 40C is a perspective view of a branched head portion.
Figure 40B:
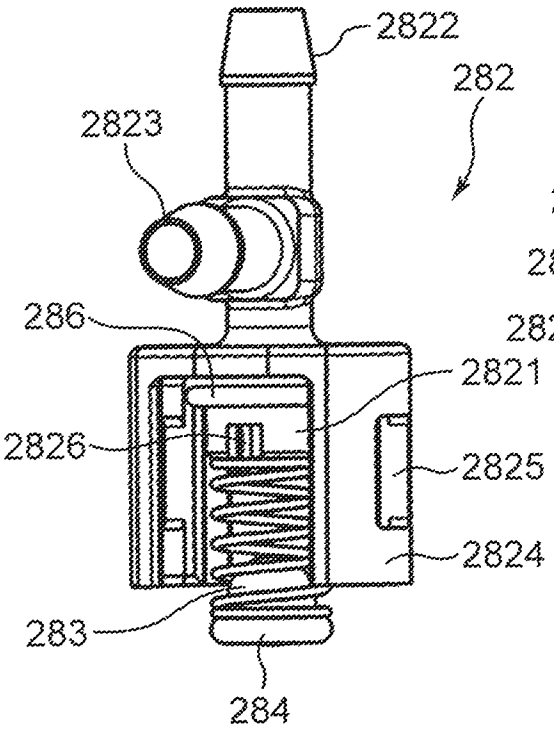
Figure 40A:
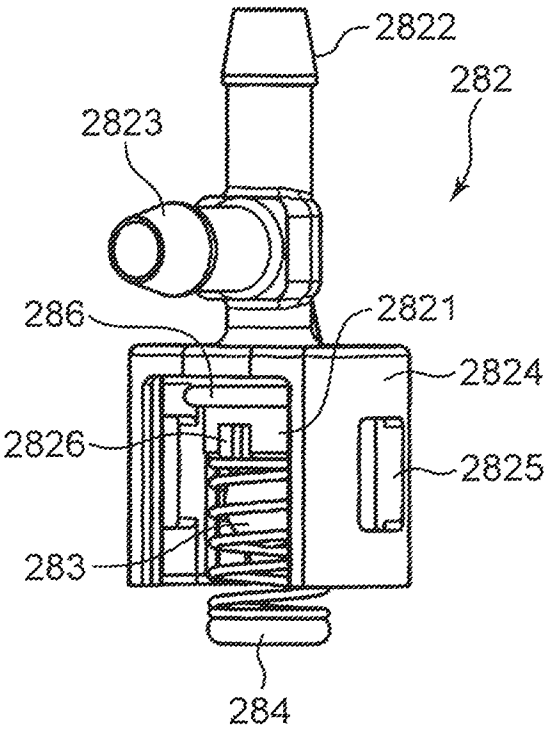
FIG. 40A is a perspective view of the backflow prevention mechanism of the second embodiment showing a state where a valve conduit is opened by a spherical body.

Next, the backflow prevention mechanism 238 according to the second embodiment is described with reference to FIGS. 37, 40A to 42B. The backflow prevention mechanism 238 is a mechanism for preventing the pressurized ink from flowing back to the second chamber 242 when the aforementioned pressurized purge mode is performed. FIG. 37 includes an exploded perspective view of the backflow prevention mechanism 238. The backflow prevention mechanism 238 includes a valve conduit 281, a branched head portion 282, a spherical body 283, a sealing member 284, a coil spring 285 and an O-ring 286. The valve conduit 281 is a member integral with the top wall 2442 of the communication chamber 244 and the other components are mounted into the valve conduit 281. FIGS. 40A and 40B are perspective views of the backflow prevention mechanism 238 excluding the valve conduit 281, and FIG. 40C is a perspective view of the branched head portion 282 viewed from below.

The valve conduit 281 is a conduit extending in the vertical direction from the upper surface of the top wall 2442. The valve conduit 281 provides an ink flow passage linking the communication chamber 244 and the downstream pipe 234 and constitutes a part of an ink supply passage from the second chamber 242 to the ink discharging portion 22 (FIG. 5). A locking piece 2811 projects on the outer peripheral surface of the valve conduit 281 and a fitting annular projection 2812 projects on the inner peripheral surface of the valve conduit 281 to lock the branched head portion 282.

The branched head portion 282 is a member for forming a joint part a of the bypass pipe 235 and the downstream pipe 234. The branched head portion 282 includes a first inlet port 2821, a second inlet port 2822, an outlet port 2823, trunk portions 2824, a locking window 2825, a cutout portion 2826 and fitting claws 2827. The first inlet port 2821 is a port connected to the downstream end of the second chamber 242 and, in this embodiment, communicates with the second chamber 242 via the valve conduit 281 and the communication chamber 244. The second inlet port 2822 is a port connected to a downstream end of the bypass pipe 235. The outlet port 2823 is a port connected to an upstream end 2341 of the downstream pipe 234. In the aforementioned print mode, the ink is supplied to the downstream pipe 234 through the first inlet port 2821. On the other hand, in the pressurized purge mode, the ink is supplied to the downstream pipe 234 through the second inlet port 2822.

The trunk portions 2824 are composed of a pair of arcuate pieces arranged to face each other outside the first inlet port 2821 facing downward. The valve conduit 281 enters a clearance between a pair of the trunk portions 2824 and the first inlet port 2821. The locking window 2825 is an opening which is provided in the pair of trunk portions 2824 and with which the locking piece 2811 of the valve conduit 281 is engaged. The cutout portion 2826 is a part formed by partially cutting a peripheral wall of the tubular first inlet port 2821 and a part for securing the ink flow passage. The fitting claws 2827 are hook-shaped parts projecting downward from the lower end of the first inlet port 2821, and engage the fitting annular projection 2812 of the valve conduit 281. That is, the branched head portion 282 is fixed to the valve conduit 281 by the engagement of the locking piece 2811 and the locking window 2825 on the inner periphery of the valve conduit 281 and by the engagement of the fitting annular projection 2812 and the fitting claws 2827 on the outer periphery of the valve conduit 281.

The spherical body 283 is housed into the valve conduit 281 movably in the ink supply direction and works as a valve. An outer diameter of the spherical body 283 is smaller than an inner diameter of the valve conduit 281 and smaller than an inner diameter of the coil spring 285. Various materials can be used as a material for forming the spherical body 283, but the spherical body 283 is preferably formed of a material having a specific weight equal to or less than twice the specific weight of the ink. The spherical body 283 is immersed in the ink in the valve conduit 281. By approximating the specific weight of the spherical body 283 to that of the ink, an operating pressure of the spherical body 283 in the ink supply direction (vertical direction here) can be made smaller.

Generally, ink used in an ink jet printer is water-soluble solution and has a specific weight equal to or near 1. Thus, it is desirable to select a material having a specific weight less than 2 as the material of the spherical body 283. Further, the above material desirably has properties such as chemical resistance and wear resistance not to be deteriorated even if the material is constantly in contact with the ink. From these perspectives, it is particularly preferable to use polyacetal resin (specific weight≈1.5) as the material of the spherical body 283.

Figure 41A:
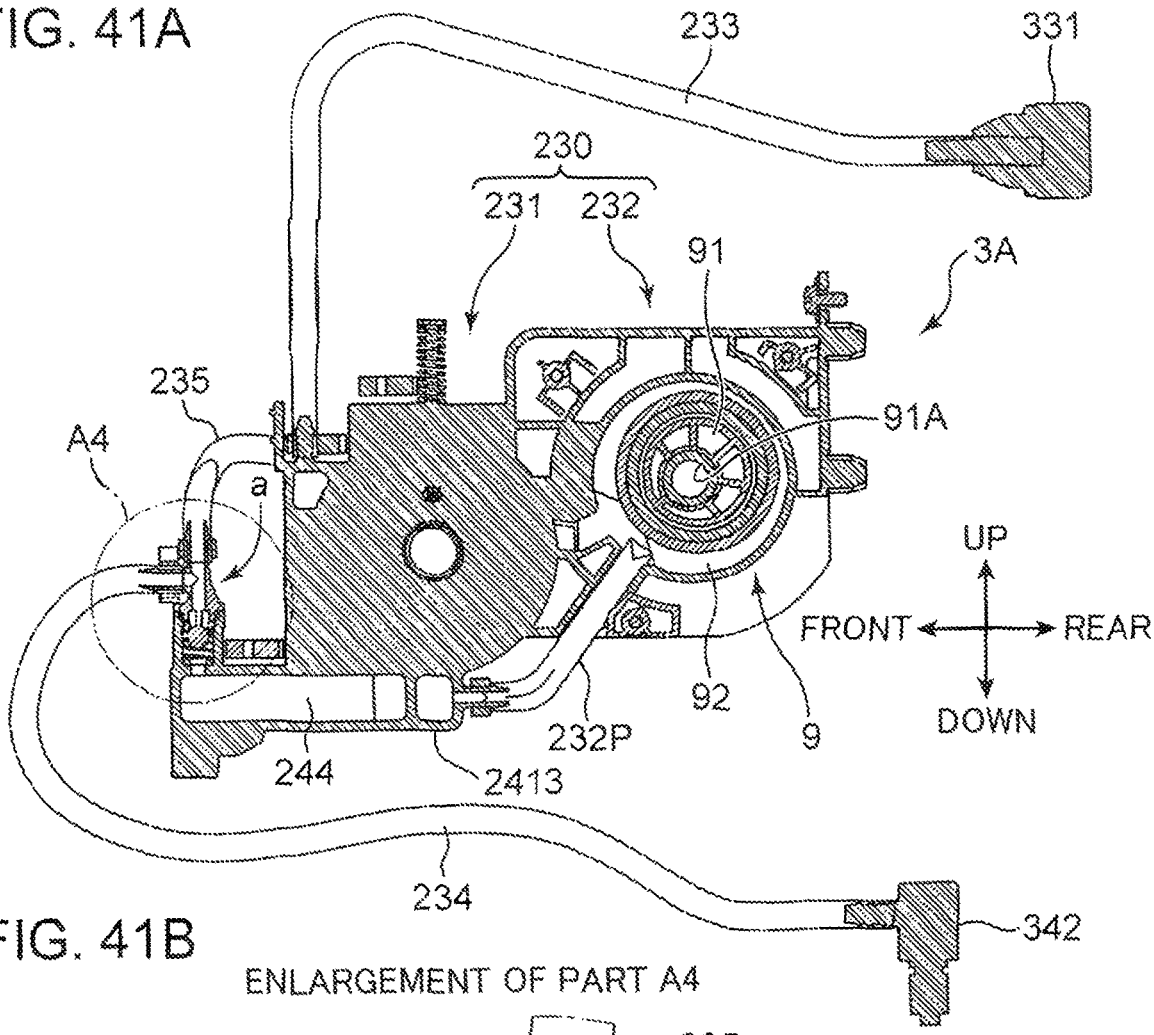
FIG. 41A is a sectional view showing a state of the backflow prevention mechanism in a print mode and FIG. 41B is an enlarged view of a part A4 of FIG. 41A.
Figure 41B:
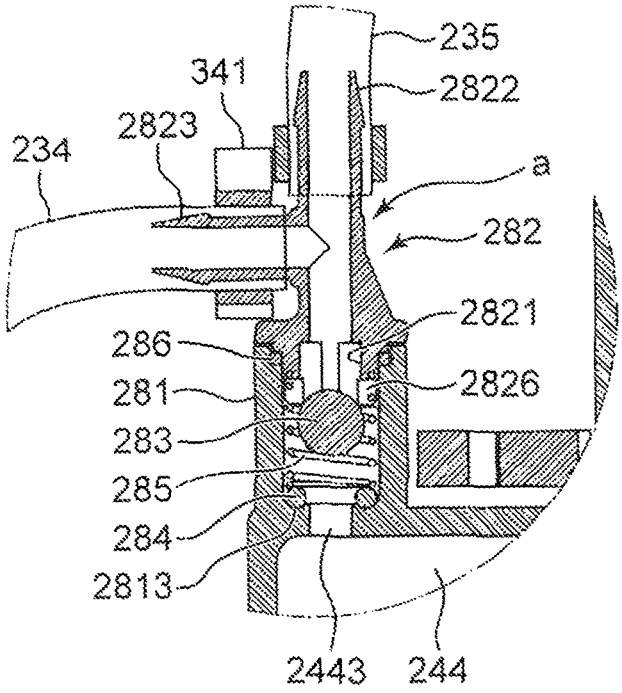

The sealing member 284 is a sealing component having a ring shape and to be seated on a seat portion 2813 below the spherical body 283 and on a bottom wall of the valve conduit 281 (upper surface of the top wall 2442), for example, as shown in FIG. 41B. A ring inner diameter (through hole) of the sealing member 284 is set smaller than the outer diameter of the spherical body 283, but larger than the supply hole 2443 perforated in the top wall 2442. When the spherical body 283 is separated from this sealing member 284 as shown in FIG. 40A, the valve conduit 281 is opened. On the other hand, when the spherical body 283 contacts the sealing member 284 as shown in FIG. 40B, the valve conduit 281 is closed.

The coil spring 285 is a compression spring mounted in the valve conduit 281 such that a lower end part thereof comes into contact with the sealing member 284 and an upper end part thereof comes into contact with a lower end edge 2828 of the first inlet port 2821 of the branched head portion 282. The coil spring 285 biases the sealing member 284 toward the seat portion 2813, whereby the sealing member 284 is constantly pressed into contact with the seat portion 2813. Further, the spherical body 283 is housed inside the coil spring 285 and the coil spring 285 also functions to guide a movement of the spherical body 283 in the ink supply direction. Thus, a loose movement of the spherical body 283 in the valve conduit 281 can be restricted and a valve structure realized by movements of the spherical body 283 toward and away from the sealing member 284 can be stabilized.

The O-ring 286 seals butting parts of the valve conduit 281 and the branched head portion 282. The O-ring 286 is fit on the outer peripheral surface of the first inlet port 2821 and in contact with a projecting base portion 2829 of the first inlet port 2821.

FIG. 41A is a sectional view showing a state of the backflow prevention mechanism 238 in the print mode, and FIG. 41B is an enlarged view of a part A4 of FIG. 41A. FIG. 41A shows the pump 9 housed in the pump portion 232. The pump 9 has the same structure as in the first embodiment. In this embodiment, a squeeze tube 92 is a tube integral with the communication pipe 232P and the bypass pipe 235. Specifically, one end side of the squeeze tube 92 communicates with the bottom wall portion 2413 of the first chamber 241 (communication pipe 232P), the other end side communicates with the second inlet port 2822 of the branched head portion 282 (bypass pipe 235) and a central part serves as a squeezing portion arranged on the peripheral surface of the eccentric cam 91.

The pump 9 is stopped in the print mode. In this case, the eccentric cam 91 is stopped by squeezing the squeeze tube 92, wherefore the ink supply passage passing through the bypass pipe 235 is closed. On the other hand, the pump 9 is driven in a forward rotation direction in the pressurized purge mode. In FIG. 41A, the forward rotation direction of the eccentric cam 91 is a counterclockwise direction. By this forward drive of the pump 9, the ink is sucked from the first chamber 241 through the communication pipe 232P and flows toward the backflow prevention mechanism 238, which is the joint part a, from the bypass pipe 235. Note that when the pump 9 is driven in a reverse rotation direction, a decompression mode as shown in FIG. 9B is set and the communication chamber 244, the second chamber 242 and the downstream pipe 234 are set to the negative pressure through the bypass pipe 235 and the branched head portion 282.

Next, the operation of the backflow prevention mechanism 238 is described. In the print mode (first state), the ink is supplied to the head unit 21 along a supply route passing through the communication chamber 244, the backflow prevention mechanism 238 and the downstream pipe 234 from the second chamber 242. In such a print mode, the spherical body 283 is separated from the sealing member 284 and lifted upward as shown in FIG. 41B. This relies on the fact that a supply route from the second chamber 242 to the downstream pipe 234 is maintained at the negative pressure in the print mode. Coupled with the suction of the ink present in the supply route by the ink discharging portion 22 of the head unit 21 every time ink droplets are discharged, a force acts on the spherical body 283 in the ink supply direction and the spherical body 283 is lifted from the sealing member 284 in the liquid ink.

Since the spherical body 283 is separated from the sealing member 284, the supply hole 2443 of the communication chamber 244 is opened. On the other hand, the spherical body 283 may be lifted to contact the lower end edge 2828 of the first inlet port 2821 by a suction force of the ink discharging portion 22. FIG. 40A shows a state where the spherical body 283 is lifted to an uppermost position. Even in such a state, since the cutout portion 2826 is provided in the peripheral wall of the first inlet port 2821, a passage for the ink is ensured. Thus, the ink can pass from the communication chamber 244 to the branched head portion 282.

Figure 42A:
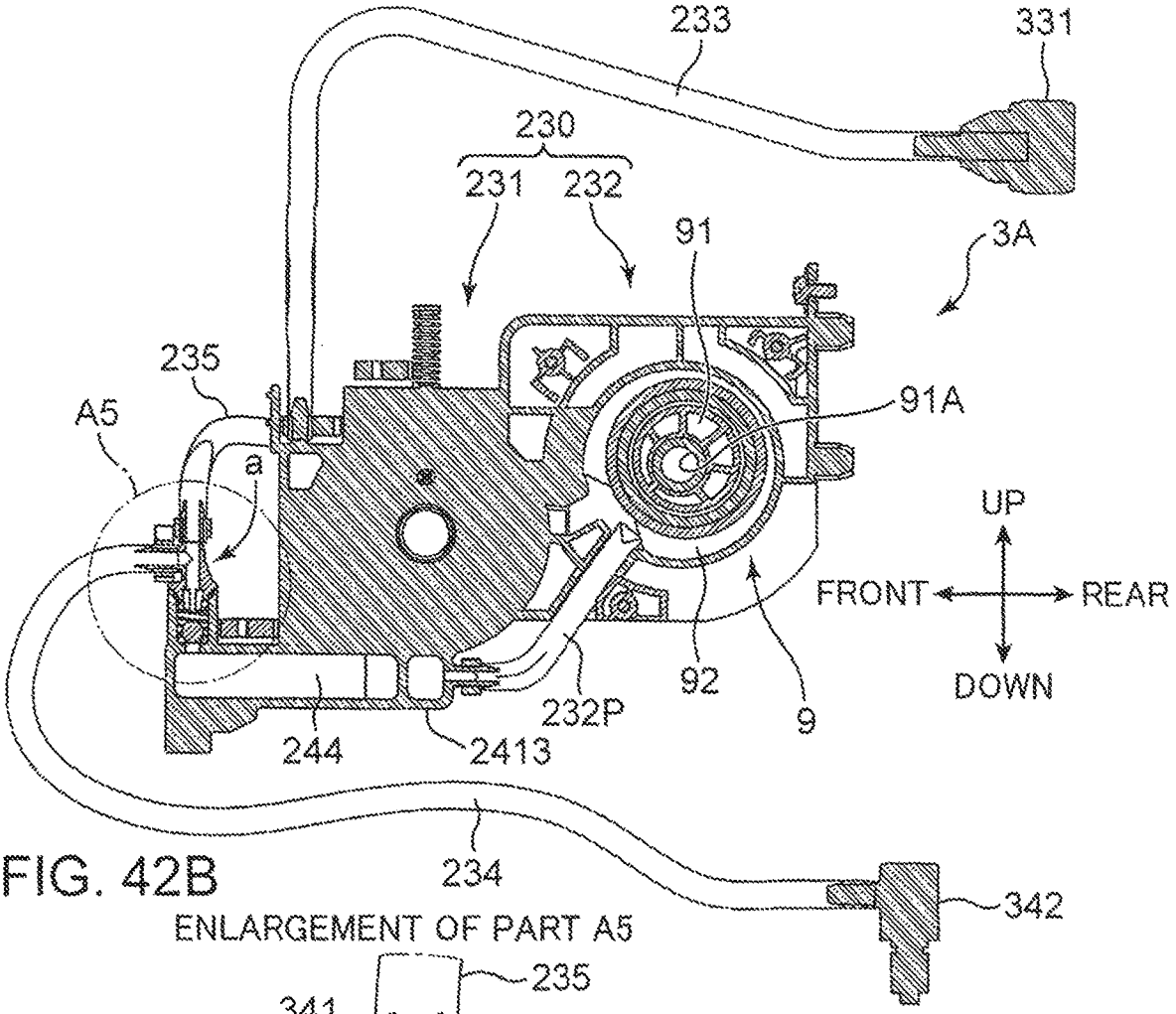
FIG. 42A is a sectional view showing a state of the backflow prevention mechanism in a pressurized purge mode and FIG. 42B is an enlarged view of a part A5 of FIG. 42A.
Figure 42B:
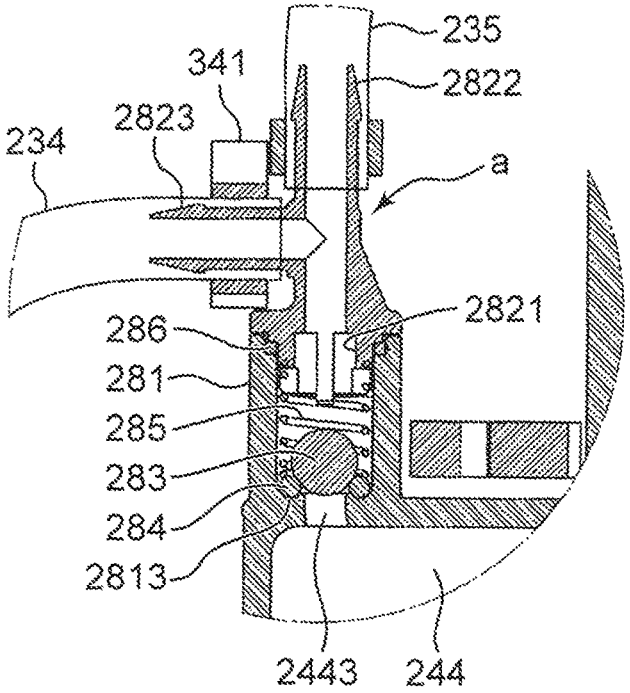

FIG. 42A is a sectional view showing a state of the backflow prevention mechanism 238 in the pressurized purge mode (second state) and FIG. 42B is an enlarged view of a part A5 of FIG. 42A. In the pressurized purge mode, the ink pressurized through the bypass pipe 235 is supplied to the second inlet port 2822 (joint part a) of the branched head portion 282 by the forward drive of the pump 9. Thus, the bypass pipe 235 and the downstream pipe 234 located downstream of the joint part a are pressurized by the pressurized ink. In this case, the ink is pressurized to a high pressure exceeding 100 kPa. If such a high pressure is applied to the second chamber 242, the atmospheric pressure detection film 70 defining a part of the second chamber 242 may be broken or a part thereof attached to the second partition wall 2421 may be peeled off.

However, in this embodiment, the spherical body 283 is pressed downward (upstream side in the ink supply direction) to contact the sealing member 284 by a pressurizing force applied to the joint part a. FIGS. 40B and 42B show a state where the spherical body 283 is fit into the ring-shaped sealing member 284 by being pressed. By the contact of the spherical body 283 with the sealing member 284 pressed against the seat portion 2813 by the coil spring 285, the supply hole 2443 is closed. Specifically, out of the ink supply path in the print mode, the communication chamber 244 and the second chamber 242 located upstream of the joint part a are blocked from pressurization by the pressurized ink. Thus, the breakage of the atmospheric pressure detection film 70 and the like can be prevented.

[Modification]

Although the embodiments of the present disclosure have been described above, the present disclosure is not limited to this. For example, the following modifications can be employed.

(1) In the above embodiments, the liquid supply unit 3, 3A according to the present invention supplies the ink to the head unit 21 of the ink jet printer 1. The liquid stored in and supplied by the liquid supply unit 3, 3A is not limited to the ink and can be any one of various liquids. For example, water, various solutions, chemicals, industrial chemical solutions and the like can be stored in and supplied by the liquid supply unit 3, 3A.

(2) Although the backflow prevention mechanism 38 utilizing the spherical body 83 is illustrated in the first embodiment, this is an example and various backflow prevention structures can be adopted. For example, a configuration in which a valve body with a return spring is arranged to face the supply hole 42H in the valve conduit 81 and closes the supply hole 42H when a pressure of pressurized purge is applied can be adopted.

(3) Although the on-off valve 6 with the umbrella valve 66 is illustrated in the above embodiments, various movable valves may be used as an opening/closing member instead of this. Further, for example, although the pressing member 5 and the on-off valve 6 are link-connected by the link bosses 54 and the link pins 65 in the above first embodiments, the both may not be link-connected. For example, a state may be formed in which a part of the pressing member 5 and a part of the on-off valve 6 are constantly held in contact by a spring or the like and the pressing member 5 may press the on-off valve 6 through the contact parts.

(4) In the above first embodiments, for example, the pressing member 5 includes the pair of pivot portions 53 spaced apart in the direction of the axis of rotation. Instead of this, one long shaft extending in the direction of the axis of rotation may be used as the pivot portions 53. Alternatively, if the rotational twist of the pressing member 5 is not problematic, one arm having pivot portions formed on tips may be used in place of the pair of arm portions 52 and the pair of pivot portions 53 of the above embodiments. Further, the arm portions 52 may be omitted and the pivot portions 53 may be provided near the upper end of the disk portion 51.

Figure 43B:
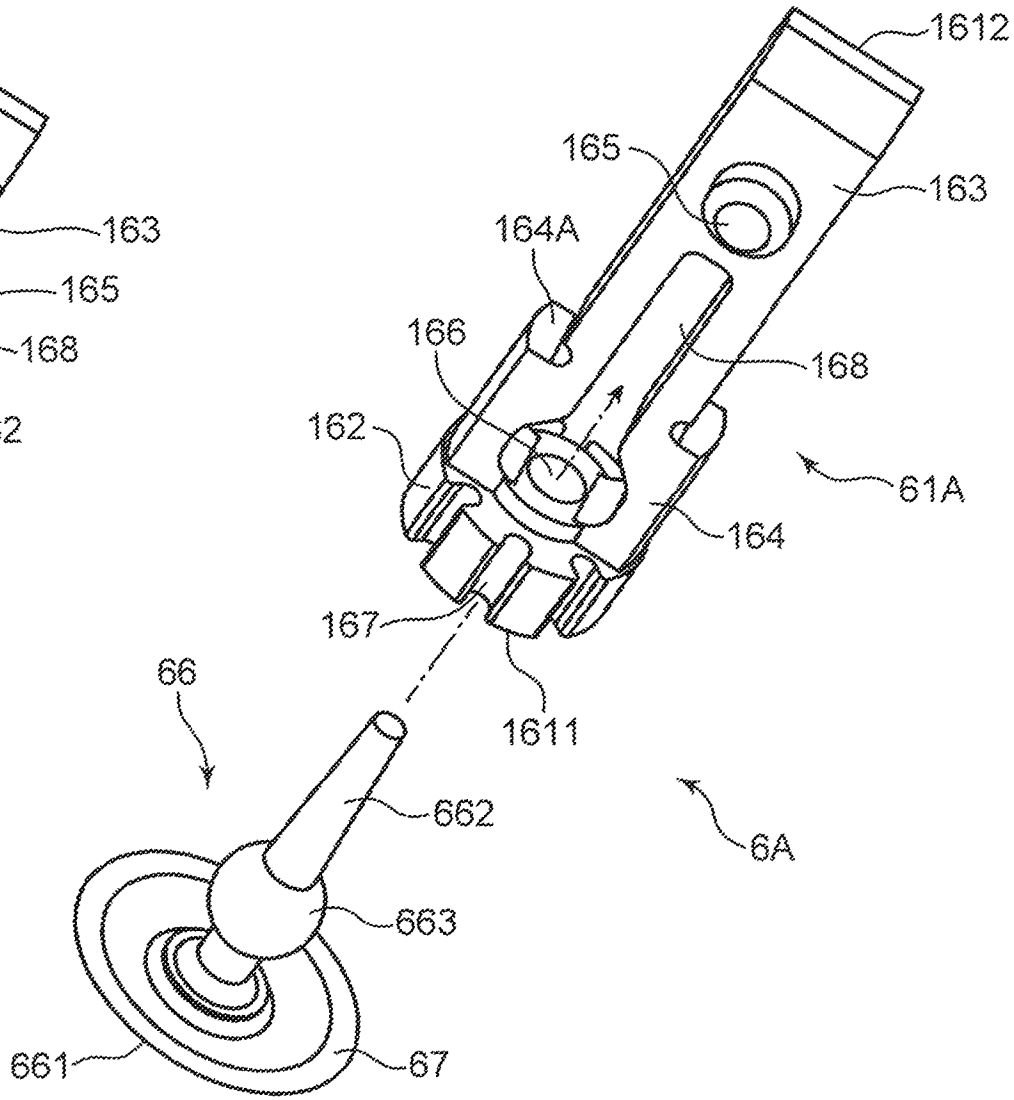
FIG. 43A is a perspective view of an on-off valve according to a modification and FIG. 43B is an exploded perspective view of the on-off valve.
Figure 43A:
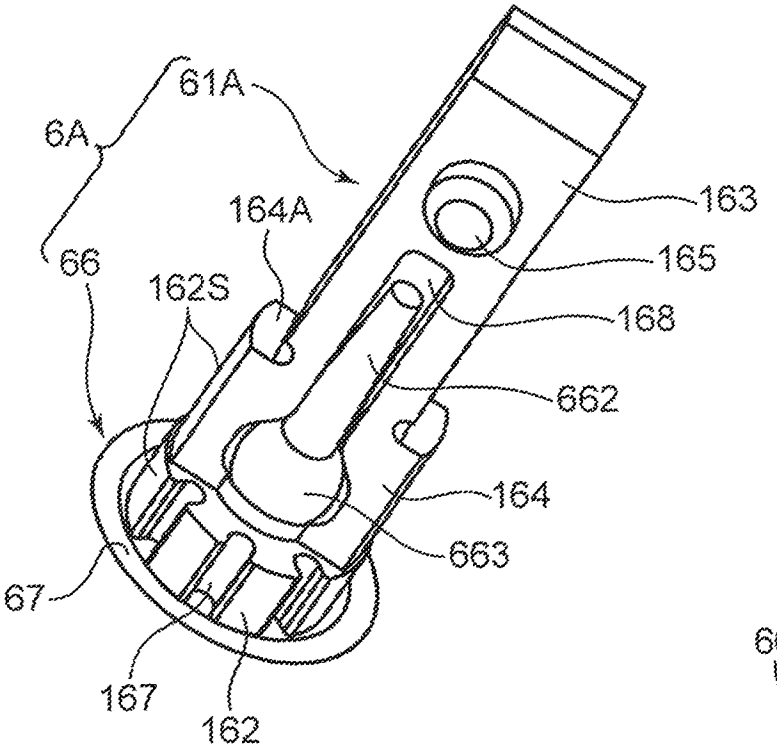

(5) Also the on-off valve shown in FIGS. 15A and 15B is illustrated as the opening/closing member in the above embodiments, the opening/closing member may be changed to a valve of another form. FIG. 43A is a perspective view of an on-off valve 6A according to a modification and FIG. 43B is an exploded perspective view of the on-off valve 6A. The on-off valve 6A is an assembly of a valve holder 61A and an umbrella valve 66 held by this valve holder 61A. The umbrella valve 66 is not described here since having the same structure as the one previously described on the basis of FIG. 15B.

In a state mounted in the communication opening 43, the valve holder 61A includes a first end part 1611 located on the side of the first chamber 41 and a second end part 1612 located on the side of the second chamber 42. The valve holder 61A includes a tube portion 162 on the side of the first end part 1611, a flat plate portion 163 on the side of the second end part 1612, an intermediate portion 164 located between the tube portion 162 and the flat plate portion 163 and link pins 165 disposed on the flat plate portion 163. The umbrella valve 66 is held on the side of the first end part 1611 of the valve holder 61A.

The tube portion 162 is a hollow cylindrical part including a through hole 166, through which a pin portion 662 of the umbrella valve 66 is inserted, in a radial center. An inner diameter of the through hole 166 is smaller than a locking spherical portion 663 of the umbrella valve 66, but the pin portion 662 is inserted into the through hole 166 from the side of the first end part 1611 in such a manner that the locking spherical portion 663 is pressed to pass through the through hole 166 utilizing rubber elasticity. A plurality of radially recessed flow passage grooves 167 are provided at equal intervals in a circumferential direction on the outer peripheral surface of the tube portion 162. The flow passage grooves 167 serve as flow passages in which the ink flows when the on-off valve 6A is in an opening posture.

The intermediate portion 164 is a flat plate part having a width substantially equal to an outer diameter of the tube portion 162 and wider than the flat plate portion 163. A pin housing portion 168 formed by a cutout for housing the pin portion 662 is provided from the intermediate portion 164 to the flat plate portion 163. The tube portion 162 and the intermediate portion 164 are housed into the large-diameter portion 43A of the communication opening 43. The outer peripheral surfaces of the tube portion 162 and the intermediate portion 164 serve as guide surfaces 162S to be guided by the large-diameter portion 43A when the on-off valve 6A moves in the lateral direction. A contact portion 164A formed by a step based on a width difference of the flat plate portion 163 and the intermediate portion 164 is present on a boundary part between the flat plate portion 163 and the intermediate portion 164. The contact portion 164A faces and comes into contact with the step portion 43C (FIG. 17B) of the communication opening 43. The link pins 165 projecting on the flat plate portion 163 are fit into the link holes 541 (FIG. 14B) provided in the link bosses 54 of the pressing member 54.

Also in this on-off valve 6A, a sealing surface 67 of the umbrella valve 66 comes into contact with the sealing wall surface 426 in the closing posture (FIG. 16B), whereby the communication opening 43 is sealed. On the other hand, in the opening posture, the sealing surface 67 is separated from the sealing wall surface 416 and the ink flows through the flow passage grooves 167. Further, the umbrella shape of an umbrella portion 661 is inverted when an excessive inner pressure acts in the second chamber 42 as described with reference to FIGS. 29A and 29B. The on-off valve 6A as described above also can function as the opening/closing member.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A liquid supply unit for supplying predetermined liquid from a liquid storage container storing the liquid to a liquid injection head for injecting the liquid, comprising:

a pressure chamber capable of storing the liquid;

a first supply passage allowing communication between the liquid storage container and the pressure chamber to supply the liquid from the liquid storage container to the pressure chamber;

a second supply passage allowing communication between the pressure chamber and the liquid injection head to supply the liquid from the pressure chamber to the liquid injection head;

a bypass supply passage having an upstream end in a liquid supply direction connected to the first supply passage and a downstream end joining the second supply passage; and a pump arranged in the bypass supply passage and configured to operate selectively in either of a forward rotation direction or a reverse rotation direction, the forward rotation direction of the pump causing the liquid flowing in the bypass supply passage to flow from the upstream end to the downstream end relative to the liquid supply direction, and the reverse rotation direction of the pump causing the liquid flowing in the bypass supply passage to flow from the downstream end to the upstream end relative to the liquid supply direction.

2. The liquid supply unit according to claim 1, further comprising:

a backflow prevention mechanism arranged on a side upstream of a joint part of the second supply passage and the downstream end of the bypass supply passage in the second supply passage and configured to prevent the liquid pressurized by the pressurizing mechanism from flowing back to the pressure chamber.

3. The liquid supply unit according to claim 2, wherein:

the pressure chamber, the backflow prevention mechanism and the second supply passage are arranged in a vertical direction such that the backflow prevention mechanism is located below the pressure chamber and the joint part is located below the backflow prevention mechanism.

4. The liquid supply unit according to claim 1, wherein:

a part of a wall portion defining the pressure chamber is formed by a flexible film member.

5. The liquid supply unit according to claim 1, wherein:

the pressure chamber includes an air vent mechanism configured to vent air from the pressure chamber.

6. The liquid supply unit according to claim 3, wherein:

the backflow prevention mechanism includes:

a valve conduit extending in the vertical direction and constituting a part of the second supply passage;

a spherical body housed in the valve conduit movably in the liquid supply direction; and a sealing member arranged in an upper end of the valve conduit and configured to close the valve conduit when the spherical body is in contact therewith and open the valve conduit when the spherical body is separated therefrom by moving in the liquid supply direction; and the spherical body descends by its own weight to be separated from the sealing member in the valve conduit in a first state where the liquid is supplied from the pressure chamber to the liquid injection head, and ascends by pressurization to contact the sealing member in the valve conduit in a second state where the pressurized liquid is supplied to the liquid injection head through the bypass supply passage.

7. The liquid supply unit according to claim 6, wherein:

the pressure chamber includes a liquid discharge opening in a lowermost end part thereof;

the valve conduit is a conduit extending vertically downward from the liquid discharge opening and includes a seat portion on an upper end side thereof, the sealing member being seated on the seat portion, and a sphere receiving portion on a lower end side thereof, the sphere receiving portion receiving the spherical body in the first state and having a cutout portion serving as a liquid flow passage;

a conduit constituting another part of the second supply passage includes a vertical portion extending vertically downward from the lower end side of the valve conduit; and the downstream end of the bypass supply passage joins the vertical portion.

8. The liquid supply unit according to claim 2, wherein:

the backflow prevention mechanism includes:

a valve conduit constituting a part of the second supply passage;

a spherical body housed in the valve conduit movably in the liquid supply direction; and a sealing member configured to close the valve conduit when the spherical body is in contact therewith and open the valve conduit when the spherical body is separated therefrom by moving in the liquid supply direction; and the spherical body is separated from the sealing member in a first state where the liquid is supplied from the pressure chamber to the liquid injection head, and is in contact with the sealing member in a second state where the pressurized liquid is supplied to the liquid injection head through the bypass supply passage.

9. The liquid supply unit according to claim 8, wherein:

the liquid storage container is arranged above the liquid supply unit, the liquid injection head is arranged below the liquid supply unit, and the liquid is supplied from the liquid storage container to the liquid injection head utilizing a water head difference;

the pressure chamber and the second supply passage are maintained at a negative pressure in the first state;

the bypass supply passage and a part of the second supply passage downstream of the joint part are pressurized by the pressurized liquid in the second state; and the spherical body is separated from the sealing member by the negative pressure in the first state and in contact with the sealing member by the pressurization in the second state.

10. The liquid supply unit according to claim 8, wherein:

the sealing member has a ring shape with a through hole having a diameter smaller than an outer diameter of the spherical body;

the valve conduit includes a seat portion on which the sealing member is seated;

the backflow prevention mechanism further includes a coil spring mounted in the valve conduit and configured to bias the sealing member toward the seat portion and guide a movement of the spherical body in the liquid supply direction.

11. The liquid supply unit according to claim 6, wherein:

a specific weight of the spherical body is set in the range of 1.1-fold to 1.5-fold of a specific weight of the liquid.

12. The liquid supply unit according to claim 8, wherein:

the valve conduit is a conduit extending in a vertical direction; and a specific weight of the spherical body is set equal to or less than twice the specific weight of the liquid.

13. The liquid supply unit according to claim 4, further comprising:

an upstream chamber constituting a part of the first supply passage and arranged upstream of the pressure chamber in the liquid supply direction;

a chamber wall portion including a communication opening allowing communication between the upstream chamber and the pressure chamber;

an opening/closing member arranged in the communication opening and configured to change a posture between a closing posture for closing the communication opening and an opening posture for opening the communication opening;

a biasing member configured to bias the opening/closing member in a direction toward the closing posture; and a pressing member capable of pressing the opening/closing member in a direction toward the opening posture;

wherein:

the flexible film member is a member configured to be displaced based on a negative pressure generated as the liquid in the pressure chamber decreases and transmit a displacement force thereof to the pressing member; and the pressing member includes:

a pressure receiving portion configured to receive the displacement force from the flexible film member; and a pressing portion configured to press the opening/closing member against a biasing force of the biasing member by the displacement force received by the pressure receiving portion.

14. The liquid supply unit according to claim 13, wherein:

the liquid storage container is arranged above the liquid supply unit, the liquid injection head is arranged below the liquid supply unit, and the liquid is supplied from the liquid storage container to the liquid injection head utilizing a water head difference;

the pressure chamber and the second supply passage are maintained at a negative pressure in a first state where the liquid is supplied from the pressure chamber to the liquid injection head; and the bypass supply passage and a part of the second supply passage downstream of the joint part are pressurized by the pressurized liquid and a part of the second supply passage upstream of the joint part and the pressure chamber are blocked from the pressurization by the backflow prevention mechanism in a second state where the pressurized liquid is supplied to the liquid injection head through the bypass supply passage.

15. A liquid injection device, comprising:

a liquid injection head configured to inject predetermined liquid; and the liquid supply unit according to claim 1 configured to supply the liquid from the liquid storage container storing the liquid to the liquid injection head.

16. A liquid supply unit for supplying predetermined liquid from a liquid storage container storing the liquid to a liquid injection head for injecting the liquid, comprising:

a pressure chamber capable of storing the liquid;

a first supply passage allowing communication between the liquid storage container and the pressure chamber to supply the liquid from the liquid storage container to the pressure chamber;

a second supply passage allowing communication between the pressure chamber and the liquid injection head to supply the liquid from the pressure chamber to the liquid injection head;

a bypass supply passage having an upstream end in a liquid supply direction connected to the first supply passage and a downstream end joining the second supply passage;

a pressurizing mechanism arranged in the bypass supply passage and configured to pressurize the liquid flowing in the bypass supply passage; and a backflow prevention mechanism arranged on a side upstream of a joint part of the second supply passage and the downstream end of the bypass supply passage in the second supply passage and configured to prevent the liquid pressurized by the pressurizing mechanism from flowing back to the pressure chamber, the backflow prevention mechanism including:

a valve conduit extending in the vertical direction and constituting a part of the second supply passage;

a spherical body housed in the valve conduit movably in the liquid supply direction; and a sealing member arranged in an upper end of the valve conduit and configured to close the valve conduit when the spherical body is in contact therewith and open the valve conduit when the spherical body is separated therefrom by moving in the liquid supply direction, wherein:

the spherical body descends by its own weight to be separated from the sealing member in the valve conduit in a first state where the liquid is supplied from the pressure chamber to the liquid injection head, and ascends by pressurization to contact the sealing member in the valve conduit in a second state where the pressurized liquid is supplied to the liquid injection head through the bypass supply passage, and a specific weight of the spherical body is in a range of 1.1-fold to 1.5-fold of a specific weight of the liquid.

17. The liquid supply unit according to claim 16, wherein:

the pressure chamber, the backflow prevention mechanism and the second supply passage are arranged in a vertical direction such that the backflow prevention mechanism is located below the pressure chamber and the joint part is located below the backflow prevention mechanism.

* * * * *